US012366063B2

(12) United States Patent
Say

(10) Patent No.: US 12,366,063 B2
(45) **Date of Patent: *Jul. 22, 2025**

(54) COVER ASSEMBLY AND METHODS

(71) Applicant: ZURN WATER, LLC, Milwaukee, WI (US)

(72) Inventor: Christopher J. Say, Waterford, PA (US)

(73) Assignee: Zurn Water, LLC, Milwaukee, WI (US)

( * ) Notice: Subject to any disclaimer, the term of this patent is extended or adjusted under 35 U.S.C. 154(b) by 827 days.

This patent is subject to a terminal disclaimer.

(21) Appl. No.: 17/387,773

(22) Filed: Jul. 28, 2021

(65) Prior Publication Data

US 2021/0355670 A1 Nov. 18, 2021

Related U.S. Application Data

(63) Continuation of application No. 16/380,039, filed on Apr. 10, 2019, now Pat. No. 11,078,658.

(60) Provisional application No. 62/659,103, filed on Apr. 17, 2018.

(51) Int. Cl.
*E03F 5/04* (2006.01)

(52) U.S. Cl.
CPC ..... *E03F 5/0407* (2013.01)

(58) Field of Classification Search
CPC ..... E03F 5/041; E03F 3/04
See application file for complete search history.

(56) References Cited

U.S. PATENT DOCUMENTS

| | | | | |
|---|---|---|---|---|
| 1,007,463 | A | 10/1911 | Madden | |
| 1,107,094 | A | 8/1914 | Mitchell | |
| 1,779,936 | A | 10/1930 | Hess | |
| 1,792,345 | A * | 2/1931 | Williams | E03F 5/0407 285/391 |
| 1,951,645 | A | 3/1934 | Boosey | |
| 1,993,534 | A | 3/1935 | Stoltz | |
| 2,121,984 | A | 6/1938 | Rieger et al. | |
| 2,190,532 | A | 2/1940 | Lukomski | |
| 2,324,545 | A | 7/1943 | Svirsky | |
| 2,471,301 | A | 5/1949 | Boosey | |
| 2,490,075 | A | 12/1949 | Matheis | |
| 2,749,999 | A | 6/1956 | Schmid | |

(Continued)

FOREIGN PATENT DOCUMENTS

| | | | |
|---|---|---|---|
| CH | 614004 | A5 | 10/1979 |
| CN | 2460566 | Y | 11/2001 |

(Continued)

OTHER PUBLICATIONS

American Society of Mechanical Engineers, Floor and Trench Drains, ASME A112.6.3-2001, 2001, 13 pages.

(Continued)

*Primary Examiner* — Joshua K Ihezie
(74) *Attorney, Agent, or Firm* — Husch Blackwell LLP

(57) ABSTRACT

Systems and methods of installing a fixture into a material are provided. The fixture includes a body and a cover assembly that is removably coupled to the body and configured to move relative to the body once the body has been secured within the material. The cover assembly includes a movable component configured to aid removal of the cover assembly.

11 Claims, 40 Drawing Sheets

(56) References Cited

U.S. PATENT DOCUMENTS

| | | | | |
|---|---|---|---|---|
| 2,783,852 | A | 3/1957 | Siak | |
| 3,071,781 | A | 1/1963 | Seewack | |
| 3,173,443 | A | 3/1965 | Saville | |
| 3,285,289 | A | 11/1966 | Titus | |
| 3,420,552 | A | 1/1969 | Mork | |
| 3,445,973 | A | 5/1969 | Stone | |
| 3,703,302 | A | 11/1972 | Demier, Sr. | |
| 3,814,276 | A | 6/1974 | Van Gordon et al. | |
| 3,893,919 | A | 7/1975 | Flegel et al. | |
| 3,951,172 | A * | 4/1976 | Flegel | F16L 55/115 220/259.4 |
| 4,067,072 | A | 1/1978 | Izzi | |
| 4,092,745 | A | 6/1978 | Oropallo | |
| 4,233,697 | A | 11/1980 | Cornwall | |
| 4,261,824 | A | 4/1981 | Cuschera | |
| 4,360,041 | A | 11/1982 | Hagan et al. | |
| 4,463,461 | A | 8/1984 | Van Den Broeke et al. | |
| 4,614,065 | A | 9/1986 | Papp | |
| 4,620,330 | A | 11/1986 | Izzi, Sr. | |
| 4,694,513 | A | 9/1987 | Kiziah | |
| 4,823,411 | A | 4/1989 | Nettel | |
| 4,832,375 | A | 5/1989 | Emerson | |
| 4,883,590 | A * | 11/1989 | Papp | E03F 5/0407 210/232 |
| 5,010,957 | A | 4/1991 | Kenner | |
| 5,063,718 | A | 11/1991 | Nonis | |
| 5,209,257 | A | 5/1993 | Baker, Jr. | |
| 5,299,836 | A | 4/1994 | Woods | |
| 5,341,523 | A | 8/1994 | Barnes | |
| 5,408,706 | A | 4/1995 | Barnes | |
| 5,450,868 | A | 9/1995 | Young, Jr. | |
| 5,692,248 | A | 12/1997 | Ball | |
| 5,695,222 | A | 12/1997 | Hodges | |
| 5,745,931 | A | 5/1998 | Ball | |
| 5,921,282 | A | 7/1999 | Castillo et al. | |
| 6,053,197 | A | 4/2000 | Gorges | |
| 6,076,559 | A | 6/2000 | Castillo et al. | |
| 6,269,495 | B1 | 8/2001 | Sondrup | |
| 6,273,124 | B1 | 8/2001 | Huber et al. | |
| 6,290,279 | B1 | 9/2001 | Haight et al. | |
| 6,350,373 | B1 | 2/2002 | Sondrup | |
| 6,361,099 | B1 | 3/2002 | McIntosh et al. | |
| 6,381,775 | B1 | 5/2002 | Sondrup | |
| 6,457,901 | B1 | 10/2002 | Sondrup | |
| 6,687,925 | B2 | 2/2004 | Minnick | |
| 6,745,408 | B2 | 6/2004 | Spella, Sr. | |
| 6,755,966 | B1 | 6/2004 | Reed | |
| 6,763,533 | B2 | 7/2004 | Mayer et al. | |
| 6,799,606 | B1 | 10/2004 | Howson | |
| 6,799,920 | B2 | 10/2004 | Sondrup | |
| 6,955,499 | B2 | 10/2005 | Sondrup | |
| 7,213,274 | B2 | 5/2007 | Cotton et al. | |
| 7,465,888 | B2 | 12/2008 | Fischer et al. | |
| 7,503,083 | B2 | 3/2009 | Ball | |
| 7,735,512 | B1 | 6/2010 | Ismert et al. | |
| 8,096,002 | B2 * | 1/2012 | Stimpson | E03F 5/0409 52/302.1 |
| 8,347,906 | B1 | 1/2013 | Ismert et al. | |
| 8,566,976 | B2 | 10/2013 | Evans et al. | |
| 8,607,376 | B2 | 12/2013 | Ball | |
| 8,658,033 | B2 | 2/2014 | Farkas | |
| 9,015,870 | B2 | 4/2015 | Ball | |
| 9,015,876 | B2 * | 4/2015 | Ball | E03C 1/22 285/46 |
| 9,086,174 | B2 | 7/2015 | McConnell et al. | |
| 9,103,116 | B2 | 8/2015 | McConnell et al. | |
| 9,366,017 | B2 | 6/2016 | Cook | |
| 9,388,570 | B2 | 7/2016 | Brown et al. | |
| 9,422,707 | B2 * | 8/2016 | Hull | E03F 5/0404 |
| 9,422,708 | B2 * | 8/2016 | Hull | E03F 5/041 |
| 9,428,900 | B2 | 8/2016 | Wroblewski et al. | |
| 9,476,199 | B2 | 10/2016 | McConnell et al. | |
| 9,551,141 | B2 * | 1/2017 | Clinton | F16L 57/005 |
| 9,869,081 | B1 | 1/2018 | Pardo, Jr. | |
| 10,167,622 | B2 | 1/2019 | Brooks et al. | |
| 10,370,841 | B2 | 8/2019 | Huber | |
| 10,378,196 | B2 * | 8/2019 | Huber | E03F 5/0407 |
| 10,683,654 | B2 * | 6/2020 | Priester | E03F 5/0407 |
| 10,711,447 | B2 * | 7/2020 | Say | E03F 5/0407 |
| 11,078,658 | B2 * | 8/2021 | Say | E03F 5/041 |
| 2008/0290012 | A1 * | 11/2008 | Shih | E03F 5/0407 210/163 |
| 2008/0308476 | A1 | 12/2008 | Silverstein et al. | |
| 2009/0223884 | A1 | 8/2009 | Wroblewski | |
| 2010/0126917 | A1 | 5/2010 | Wroblewski | |
| 2011/0173747 | A1 | 7/2011 | Evans et al. | |
| 2012/0036629 | A1 | 2/2012 | Cook | |
| 2012/0036697 | A1 | 2/2012 | Cook | |
| 2013/0193042 | A1 | 8/2013 | Hull | |
| 2014/0020174 | A1 | 1/2014 | Evans et al. | |
| 2014/0116527 | A1 | 5/2014 | Wroblewski et al. | |
| 2014/0130902 | A1 | 5/2014 | Lucas et al. | |
| 2014/0138297 | A1 | 5/2014 | Hull | |
| 2014/0157514 | A1 | 6/2014 | Cook | |
| 2015/0121782 | A1 | 5/2015 | McConnell et al. | |
| 2015/0292662 | A1 * | 10/2015 | Majocka | E03F 5/041 29/527.1 |
| 2016/0002906 | A1 | 1/2016 | Adams | |
| 2016/0032578 | A1 * | 2/2016 | Toms | E03F 5/0407 137/15.01 |
| 2017/0130442 | A1 | 5/2017 | Brooks et al. | |
| 2017/0159278 | A1 | 6/2017 | Huber | |
| 2017/0247872 | A1 | 8/2017 | Huber | |
| 2018/0073237 | A1 | 3/2018 | Say et al. | |
| 2019/0119896 | A1 | 4/2019 | Priester | |
| 2019/0242107 | A1 | 8/2019 | McLeod | |
| 2019/0316341 | A1 * | 10/2019 | Say | E04G 15/061 |

FOREIGN PATENT DOCUMENTS

| | | | |
|---|---|---|---|
| CN | 204590078 | U | 8/2015 |
| CN | 105756093 | A | 7/2016 |
| DE | 3328613 | A1 | 2/1985 |
| DE | 3620132 | A1 | 9/1987 |
| EP | 0612893 | A1 | 8/1994 |
| EP | 1344874 | A2 | 9/2003 |
| EP | 1811093 | A1 | 7/2007 |
| KR | 200291494 | Y1 | 10/2002 |
| KR | 200302234 | Y1 | 2/2003 |
| KR | 20050095997 | A | 10/2005 |
| WO | 2019161874 | A1 | 8/2019 |

OTHER PUBLICATIONS

Blucher, Drainage Systems—Product Catalogue for Drains, Pipes and Channels, Copyright by Blucher, 2000, 162 pages.

MIFAB, F1100-C-T Floor Drain With Spanner Wrench Cover for Membrane Floor Areas, 2001, 1 page.

MIFAB, "Floor Drain Selection Guide", Publicly available prior to Apr. 17, 2018 (6 Pages).

MIFAB Engineered Plumbing and Drainage Products Price Guide, MPF-2004, 2004, 17 pages.

Proset Systems, Excerpts from ProSet Systems' ProSeal Closet Assembly, 2002, 9 pages.

Sioux Chief Manufacturing Company, Specification Guide for Drainage Products, 2004, 7 pages.

Jay R. Smith Mfg. Co., Excerpts from Product Guide, Copyright 2002 Jay R. Smith Mfg_ Co., 3 pages.

Tyler Pipe/ Wade Division, Drawing: Adjustable Floor Drain, 900-C, Apr. 2, 2003, 1 page.

Tyler Pipe/ Wade Division, Excerpts from Wade Plumbing Products' Specification Drainage Products, Aug. 18, 2003, 6 pages.

Zurn Plumbing Products Group, "Specification Drainage Engineering Guide", Floor Drains, Publicly available prior to Apr. 17, 2018, (5 Pages).

Zurn, Cast Iron EZ1(TM) Nomenclature Decoder, Specification Drain Customer Guide, Oct. 1, 2018, 1 page.

Zurn, EZ1(TM)-6 6" Top Assembly Adjustable Floor Drain with EZ1(TM) Technology Specification Sheet, Oct. 24, 2017, 1 Page.

Zurn, EZ1 (TM) Drainage Series—EZ1 (TM) Floor Drain Installation Instructions, Nov. 6, 2017, 6 pages.

(56) References Cited

OTHER PUBLICATIONS

Second Examination Report for Australian Application No. 2019202535, dated Jan. 10, 2025, 5 pages.

* cited by examiner

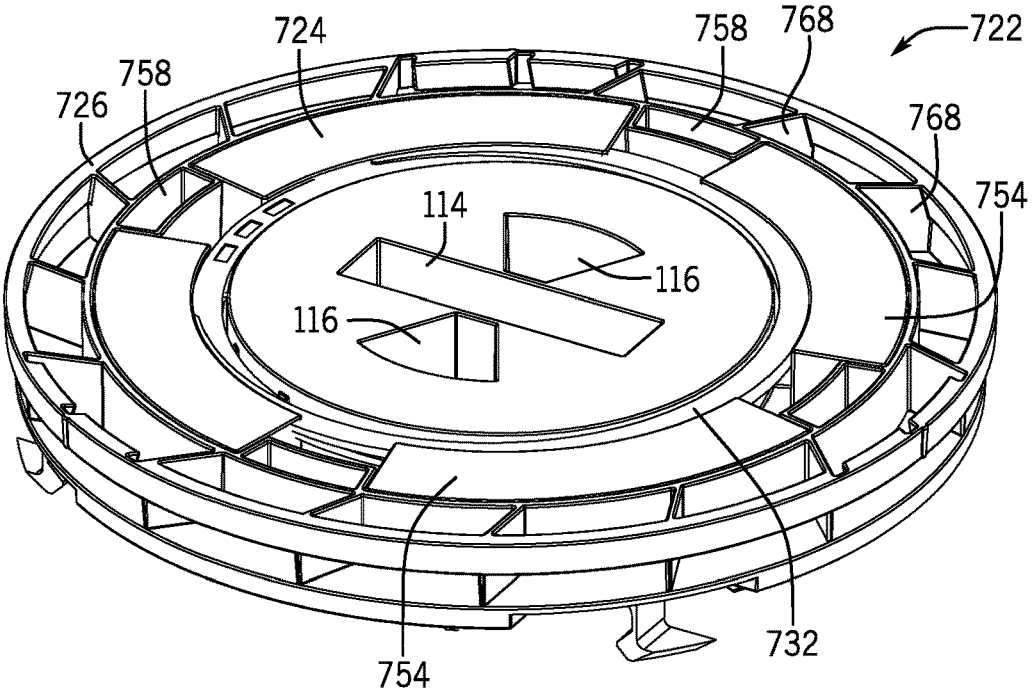
FIG. 26A
FIG. 26B
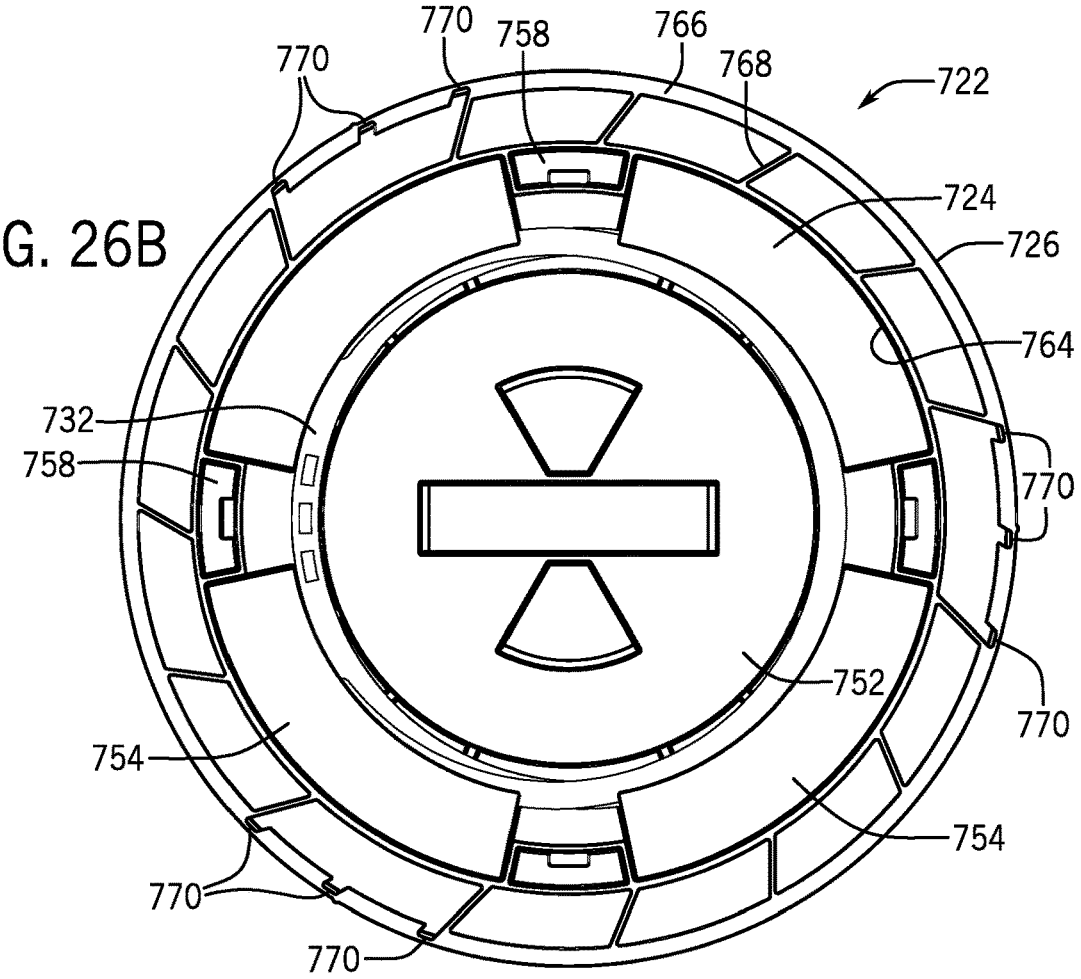

COVER ASSEMBLY AND METHODS

CROSS-REFERENCE TO RELATED APPLICATION

This application is a continuation of U.S. patent application Ser. No. 16/380,039, filed on Apr. 10, 2019, which claims priority under 35 U.S.C. § 119 to U.S. Provisional Patent Application No. 62/659,103 filed on Apr. 17, 2018, the entire contents of which are incorporated herein by reference.

STATEMENT REGARDING FEDERALLY SPONSORED RESEARCH

Not Applicable.

BACKGROUND

The present disclosure relates, in general, to systems and methods for installing fixtures in a material. More particularly, this disclosure relates to systems and methods of installing fixtures, such as plumbing and electrical fixtures, that are at least partially encased into a material, such as concrete and potting compound.

Building foundations, floors, ceilings, beams, and walls are often formed by poured concrete slabs or forms that transition from flowable to compliant or more viscous during the installation process. Generally, various fixtures are installed into and secured within the concrete, including conduits, plumbing fixtures, and other building reinforcement and infrastructure elements. The fixtures to be installed into the concrete can be first located at a desired, finished location relative to the anticipated finished surface. Concrete can then be poured around the fixtures, which cures (and may dimensionally change) to secure the fixtures in place relative to the cured concrete.

It may be advantageous to preserve the adjustability of some fixtures after concrete has been poured and set around the fixture. For example, drain and cleanout assemblies may need to be vertically adjusted once the concrete floor has set to position a grate or other fixture head approximately level with a top surface of the finished concrete slab. Additionally, concrete and other debris should be prevented from entering into a drain or conduit during the concrete pour and from hindering the adjustability of the fixture (e.g., by fouling threaded components).

Covers have been provided to drain and cleanout assemblies. The covers can be coupled to the fixture initially when the fixture is installed into the floor. Once concrete has been poured and set around the fixture, the cover can be removed. Depending on the positioning of the cover relative to the body of the fixture, the cover can become stuck within the concrete, and can be difficult to remove, potentially making the fixture inaccessible. Therefore, a need exists for improved systems and methods for installing fixtures in a material.

BRIEF SUMMARY

The present disclosure provides systems and methods for installing fixtures into materials, such as concrete surfaces. The fixtures include a body and a cover assembly that includes a component that can generally move, for instance, collapse, transform, deform, bow, bend, flex, shear, or fracture away from (e.g., tangentially, inwardly, or radially inwardly) a material (e.g., finished concrete) to aid in the removal of the cover assembly. The component can preserve the adjustability of other features positioned beneath the cover assembly, such as a drain, for example. Benefits of using the systems and methods disclosed herein include, but are not limited to, establishing and achieving a fast, easy, and effective fixture installation process.

In some embodiments, a drain assembly is disclosed. The drain assembly includes a coring sleeve including a stem and a bowl. The bowl extends radially outward and upward from the stem to define a bowl cavity. A drain is received within the coring sleeve. The drain has a drain head received within the bowl cavity, as well as a drain stem adjustably coupled to the coring sleeve stem. A cover assembly is removably coupled to the drain head, and extends over the bowl cavity. The cover assembly includes a cover and a ring received around a portion of the cover. The cover is received within the bowl cavity and is releasably coupled to the drain head.

In another embodiment, a method of installing a fixture into a material, such as concrete, is disclosed. The method includes first positioning a fixture at a desired level relative to an intended finished concrete surface (e.g., level with the intended finished concrete surface). The fixture has a body and a cover assembly removably coupled to the body. The method next includes pouring concrete around the fixture to secure the body with the concrete. Once the concrete hardens around the body, the cover assembly is moved relative to the body to move an outer surface of the cover assembly away from the concrete. The cover assembly can then be removed from the body, if desired.

In some embodiments, a fixture assembly is provided. The fixture assembly includes a body defining an interior and a cover assembly extending above the interior. The cover assembly is removably coupled to the body and is configured to move relative to the body. The cover assembly has a cover and a movable outer component removably coupled to the cover and configured to move with the cover. The outer component has a discontinuity.

These and still other advantages of the disclosure will be apparent from the detailed description and drawings. What follows is merely a description of some preferred embodiments of the present disclosure. To assess the full scope of the disclosure, the claims should be looked to as these preferred embodiments are not intended to be the only embodiments within the scope of the claims.

BRIEF DESCRIPTION OF DRAWINGS

The invention will be better understood and features, aspects, and advantages other than those set forth above will become apparent when consideration is given to the following detailed description thereof. Such detailed description makes reference to the following drawings.

FIG. 26A is a top isometric view of the cover assembly present in the drain assembly of FIG. 19.

FIG. 26B is a top view of the cover assembly of FIG. 26A.

Figure 1:
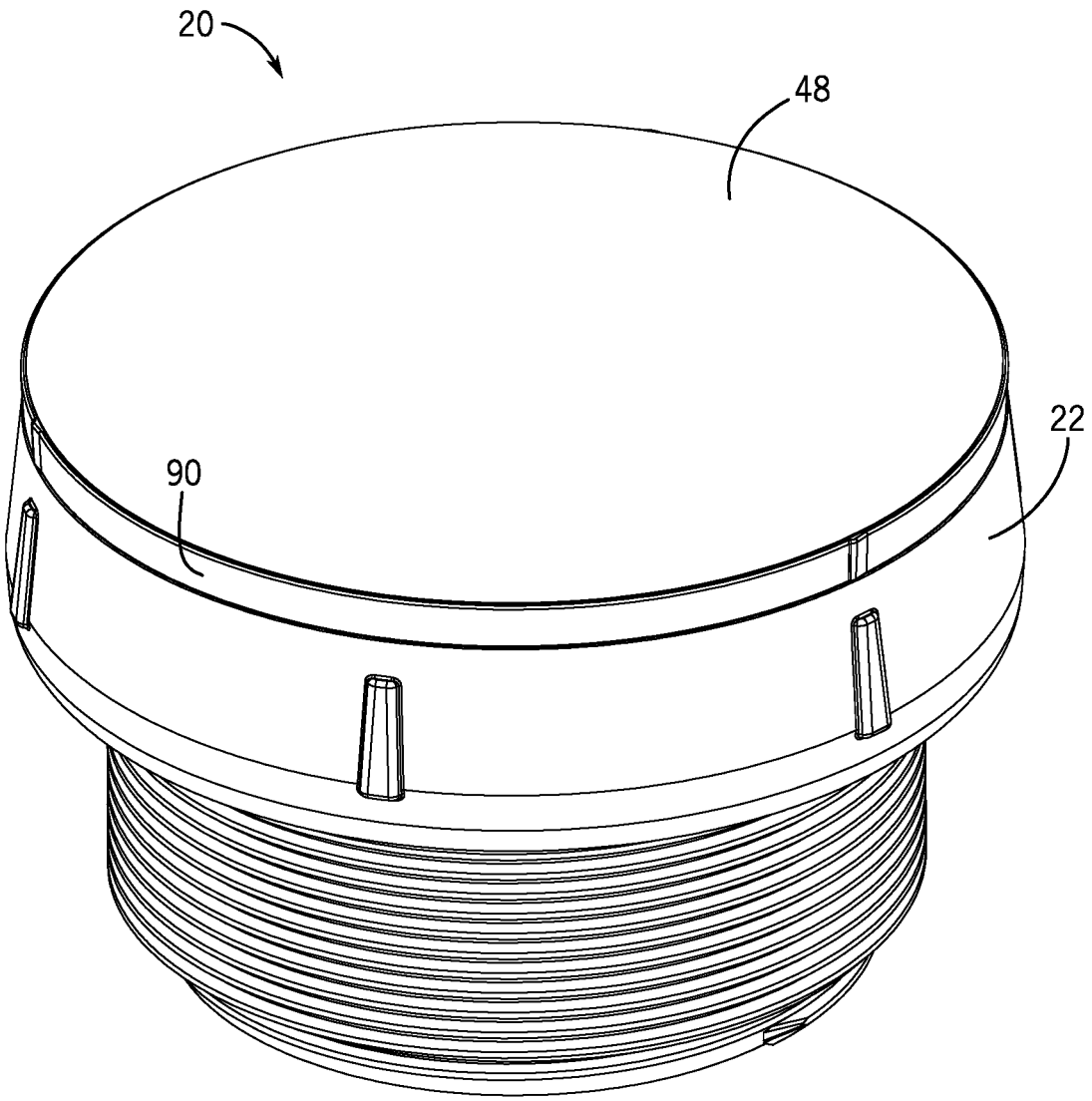
FIG. 1 is a top isometric view of a drain assembly according to embodiments of the disclosure.

Corresponding reference characters indicate corresponding parts throughout the several views. Although the drawings represent embodiments of the present disclosure, the drawings are not necessarily to scale and certain features may be exaggerated in order to better illustrate and explain the embodiments of the present disclosure.

DETAILED DESCRIPTION

For the purposes of promoting an understanding of the principles of the present disclosure, reference will now be made to a number of illustrative embodiments shown in the attached drawings and specific language will be used to describe the same.

FIG. 1 illustrates a drain assembly 20 according to the present disclosure. The drain assembly 20 can be installed into a concrete floor or other structure, and can be placed in fluid communication with a conduit or a drain pipe (not shown) to operate as a floor drain or cleanout assembly, for example. The drain assembly 20 is an example of a fixture that can benefit from the present disclosure. Other fixtures include, for instance, electrical housings and anchor pots. The fixtures can be installed or at least partially surrounded by a variety of materials, such as resin, potting compound, stucco, and plaster, as required to accommodate a particular application. The drain assembly 20 can include threaded or otherwise movable components that allow the drain assembly 20 to be adjusted relative to the conduit or concrete both before and after concrete has been installed into the floor to secure the drain assembly 20. The drain assembly 20 can be formed of polymeric materials or metallic components, for example.

With additional reference to FIGS. 2, 3, 4A, and 4B, the drain assembly 20 components are illustrated. The drain assembly 20 includes a coring sleeve 22 having a stem 24 and a bowl 26 extending outwardly and upwardly away from the stem 24. A drain 28 having a threaded drain stem 30 and a drain head 32 is threadably coupled to interior threads 34 formed in the coring sleeve 22, according to some embodiments. A strainer 36 coupled to a strainer support ring 38 can be coupled to the drain head 32 using fasteners 40, for example. A membrane, such as a protective sticker 42, film, sheet, layer, or other barrier, can be coupled to the strainer 36 and can extend above and across the strainer 36 to prevent debris or concrete from contacting the strainer 36. A cover assembly 44 can be at least partially received within the bowl 26 of the coring sleeve 22 and can extend above and across the drain 28. In one preferred form, the cover assembly includes a peripheral edge that is 0.25 inch or greater above the upper surface of the coring sleeve (e.g., as generally illustrated in FIG. 1). The cover assembly 44 can provide additional protection to the strainer 36 against concrete or other debris that could otherwise damage the drain assembly 20 during the drain assembly installation method 1000, as explained in detail below. Shims 46 can be received within the bowl of the coring sleeve 22 to help position the strainer 36 relative to a finished concrete surface formed around the drain assembly 20. For example, the shims 46 can be placed between the strainer support ring 38 and the drain head 32 to adjust the angular relationship between the strainer 36 and the drain head 32. In one example, an additional membrane, such as a protective sticker 48 adhesively coupled to the cover assembly 44, can extend across the bowl 26 of the coring sleeve 22.

Figure 3:
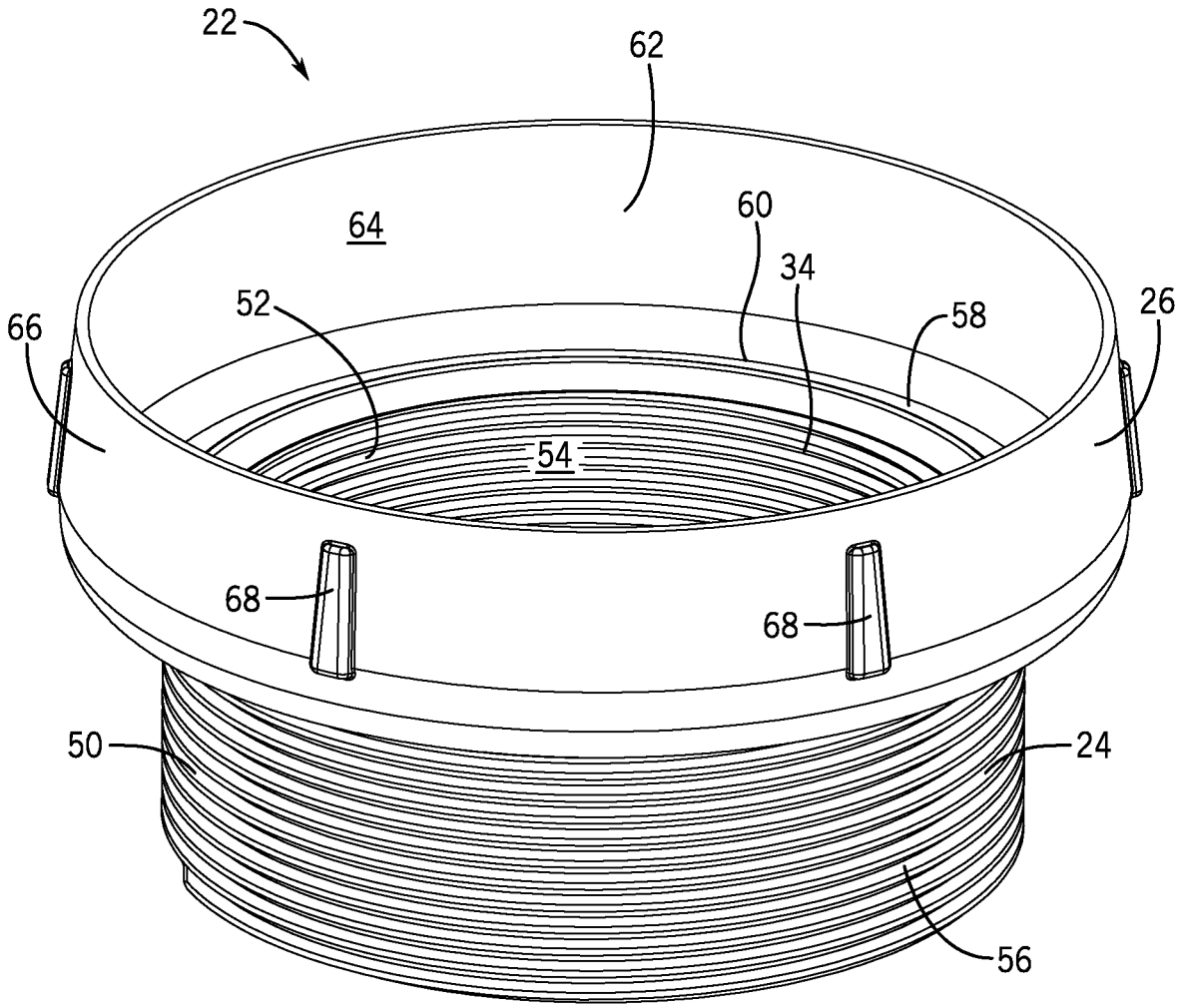
FIG. 3 is a top isometric view of a coring sleeve that is present in the drain assembly of FIG. 1.

With specific reference to FIG. 3, the coring sleeve 22 is shown. As indicated above, the coring sleeve 22 can include a stem 24 and a bowl 26 extending away from the stem 24. The stem 24 has a cylindrical shape defined by an external cylindrical wall 50 and an internal cylindrical wall 52. The internal cylindrical wall 52 defines a bore 54 that can receive the drain 28, for example. In some embodiments, the internal cylindrical wall 52 of the stem 24 includes threads 34 that can threadably receive the drain stem 30, for example. The external cylindrical wall 50 of the stem 24 can also include threads 56, which can threadably and adjustably couple the coring sleeve 22 to a drain body (not shown), an adaptor (not shown), or directly to a drain pipe or conduit (conduit C, shown in FIG. 15B), for example. Using the external threads 56 of the stem 24, the bore 54 can be placed in fluid communication with the drain pipe or conduit C.

Figure 2:
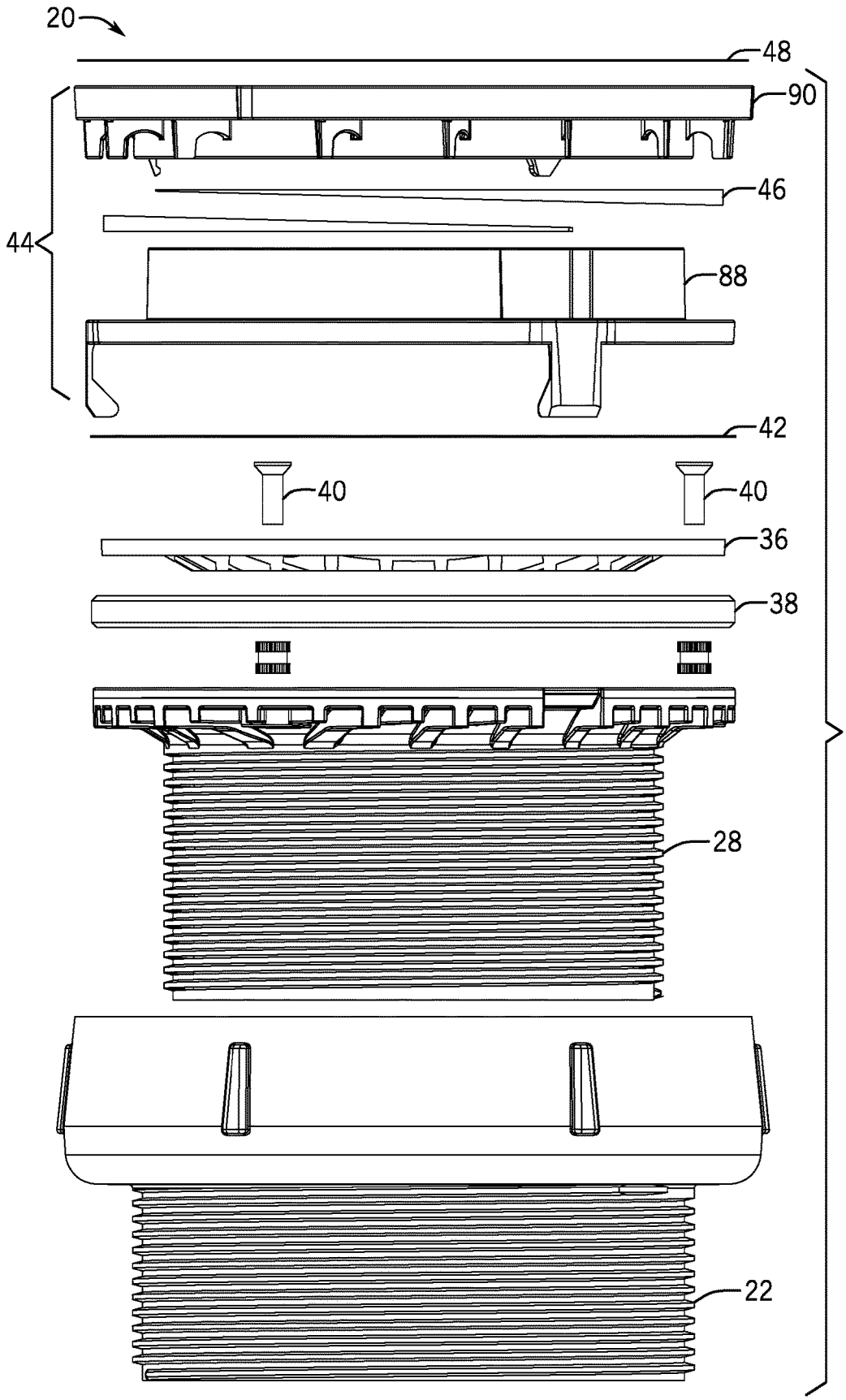
FIG. 2 is an exploded view of the drain assembly of FIG. 1.

The bowl 26 of the coring sleeve 22 is formed above the stem 24, according to some embodiments. In some examples, the bowl 26 is partially formed from an annular base wall 58 extending radially outward from the stem 24 to define a seat 60. A generally vertical upper wall 62 extends away from the base wall 58. The upper wall 62 and the seat 60 together define a bowl cavity 64. As shown in FIG. 2, an outer surface 66 of the upper wall can taper radially inwardly as it extends upwardly away from the base wall 58. Projections 68 can extend away from the outer surface 66 of the upper wall 62 to help concrete bond with and secure the coring sleeve 22 within a poured floor or wall.

Figure 4A:
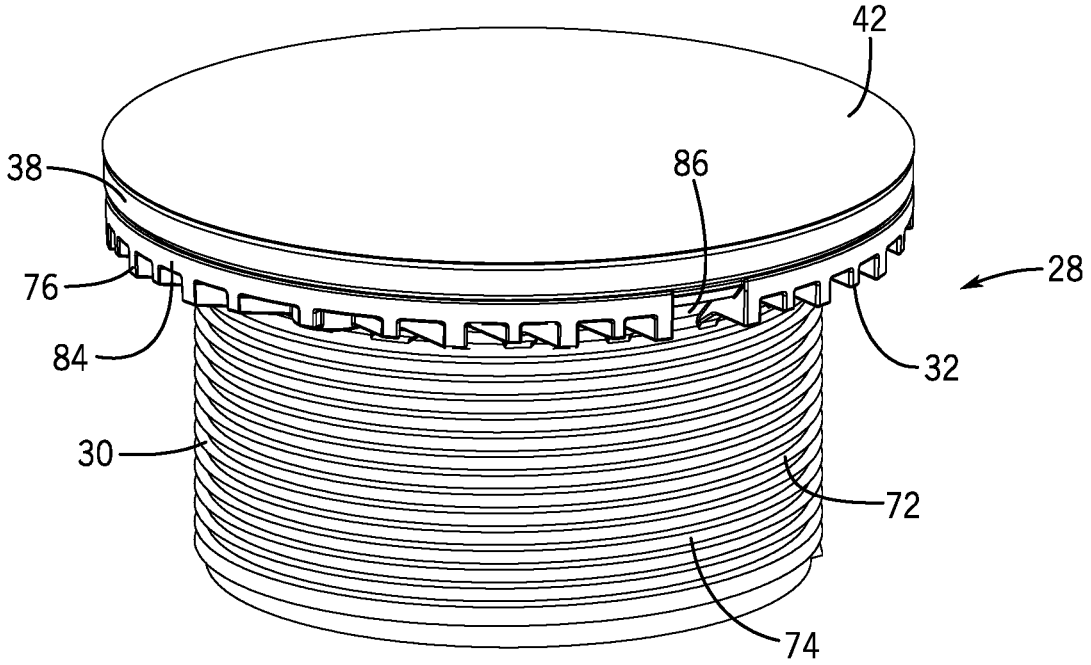
FIG. 4A is a top isometric view of a drain that is present in the drain assembly of FIG. 1.
Figure 4B:
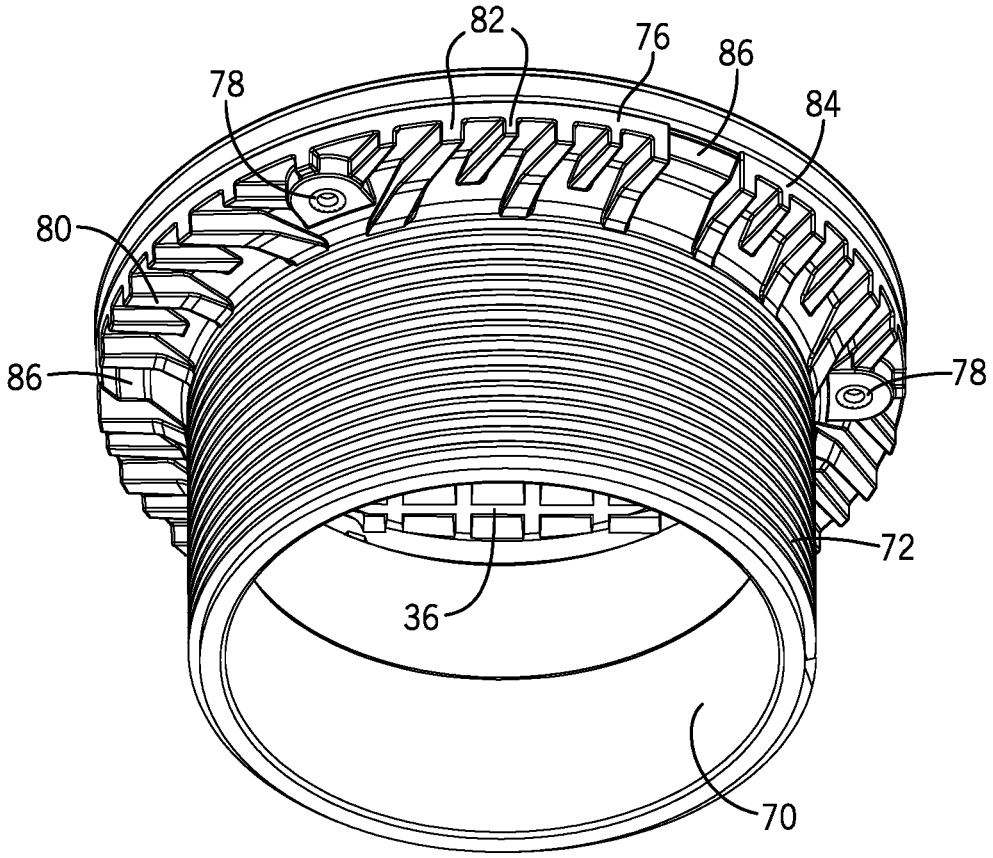
FIG. 4B is a bottom isometric view of the drain of FIG. 4A.

Referring to FIGS. 4A and 4B, the drain 28, of some embodiments, is shown in more detail. Like the coring sleeve 22, the drain 28 includes a cylindrical stem 30. The cylindrical stem 30 can include an inner surface 70 and an outer surface 72 that includes threads 74 configured to couple with the internal threads 34 formed in the coring sleeve 22. The threaded connection between the coring sleeve 22 and the stem 30 of the drain 28 allows the drain 28 to be axially adjustable relative to the coring sleeve 22. The inner surface 70 can be smooth, for example, to minimize surface frictional losses while the drain 28 is handling liquids.

The drain 28 includes a drain head 32 formed at an end portion of the drain stem 30. The drain head 32 extends outwardly away from the drain stem 30 to provide a mounting flange 76. The mounting flange 76 provides a generally flat surface that can receive and secure a strainer support ring 38. A strainer 36 is received within the strainer support ring 38, and can extend across the drain head 32 to cover the stem 30, according to some embodiments. In some embodiments, the strainer 36 and the strainer support ring 38 are each coupled to the drain head 32 using fasteners 40. Threaded mounting holes 78 can be positioned about the mounting flange 76 to removably receive the fasteners 40. In some embodiments, the underside 80 of the mounting flange 76 is reinforced with braces 82 extending between the stem 30 and an outer surface 84 of the mounting flange 76. The spacing between braces 82 on the underside 80 of the mounting flange 76 can be varied. For example, spacing between the braces 82 may be approximately equal throughout the drain head 32, except near the threaded mounting holes 78 and hook ledges 86 spaced about the drain head 32 to receive and secure the cover assembly 44, as explained below. A protective membrane, such as the sticker 42, can also be initially coupled to the strainer support ring 38 and/or the strainer 36 to protect the strainer 36 and drain 28, generally, from concrete or debris that could contact or damage the drain assembly 20 components. The example sticker 42 can be adhesively applied to the strainer support ring 38 and/or strainer 36, and can include a company logo or instructions on how to properly install the drain assembly 20, for example.

Figure 5B:
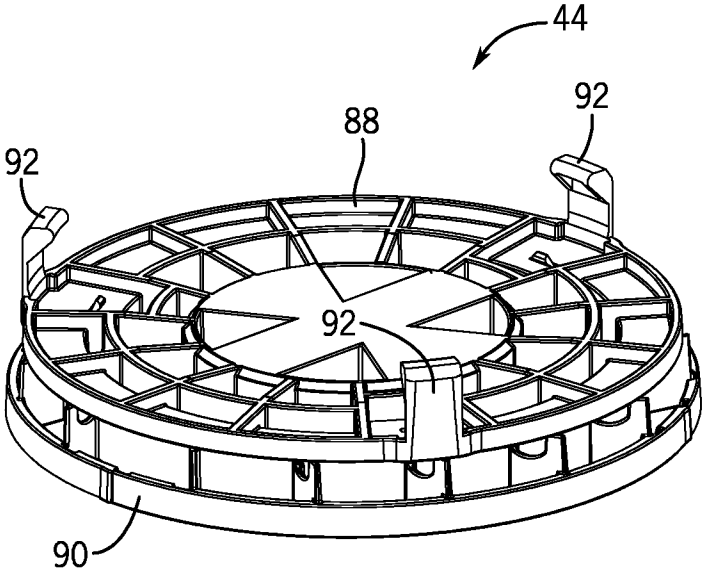
FIG. 5B is a bottom isometric view of the cover assembly of FIG. 5A.
Figure 5A:
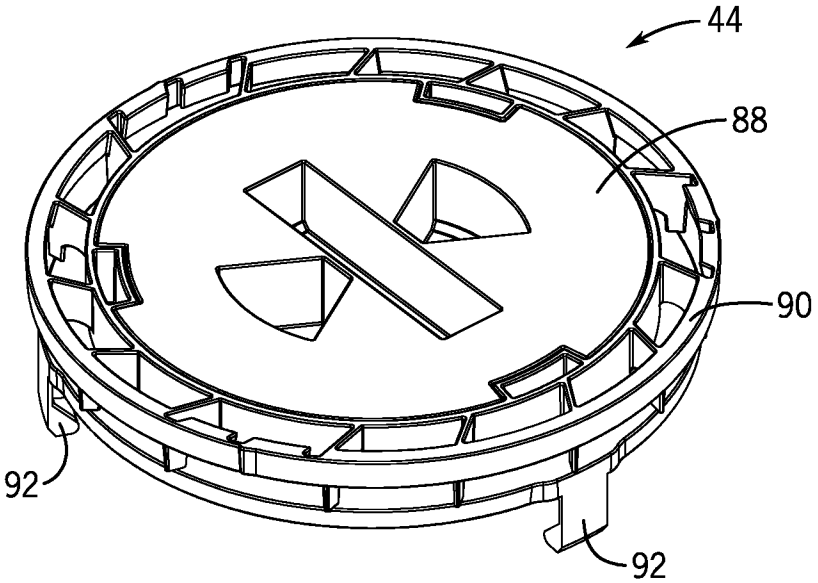
FIG. 5A is a top isometric view of a cover assembly that can be present in the drain assembly of FIG. 1.
Figure 5C:
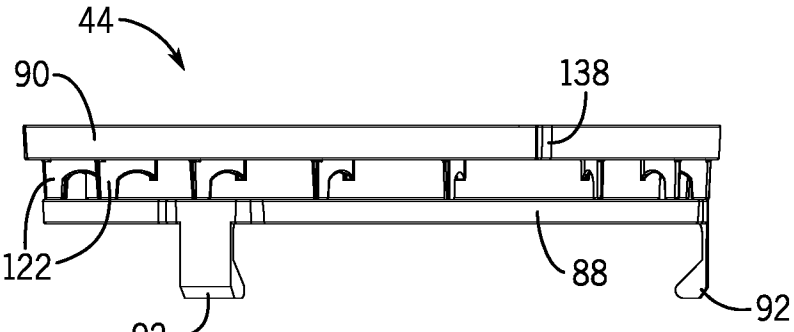
FIG. 5C is a front view of the cover assembly of FIG. 5A.

FIGS. 5A-5C illustrate a cover assembly 44 that can be removably received within the bowl cavity 64 of the coring sleeve 22 to protect the drain 28 from debris during drain assembly 20 installation. The cover assembly 44 can include a cover 88 and a movable ring 90 received around the cover 88. While an example of the movable ring 90 is described herein as being generally collapsible, given the benefit of this disclosure one skilled in the art will appreciate that the movable ring 90 is but one example of a component that can generally move, for instance, collapse, transform, deform, bow, bend, flex, shear, or fracture away from (e.g., tangentially, inwardly, or radially inwardly) a material (e.g., finished concrete) to aid in the removal of the cover assembly. The exemplary collapsibility of the ring 90 is not to be unduly limiting of the various alternative constructions and operations that are within the contemplation of one skilled in the art in view of and consistent with this disclosure The cover assembly 44 can be positioned over the drain 28, and can include hooks 92 that removably attach to the hook ledges 86 formed on the underside 80 of the drain head 32 (shown in FIG. 4B). When the hooks 92 are engaged with the hook ledges 86, the cover assembly 44 and the drain 28 rotate in concert with one another. Accordingly, the cover assembly 44 and the drain 28 can each be installed into the coring sleeve 22 simultaneously to prepare the entirely self-contained drain assembly 20 for shipping and installation. In some embodiments, ring shims 46 can be received between the cover 88 and the movable annular ring 90. The ring shims 46 can be compressed radially inward and partially restrained by ribs 122 (discussed below) that extend from the annular ring 90 toward the adjacent cover 88, such that the ring shims 46 are generally captured between the annular ring 90 and the cover 88.

Figure 6A:
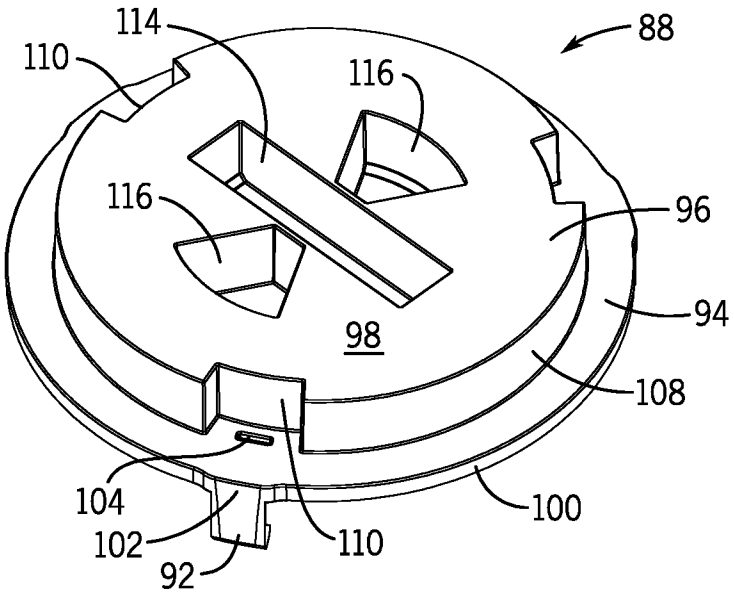
FIG. 6A is a top isometric view of a cover of the cover assembly of FIG. 5A.
Figure 6B:
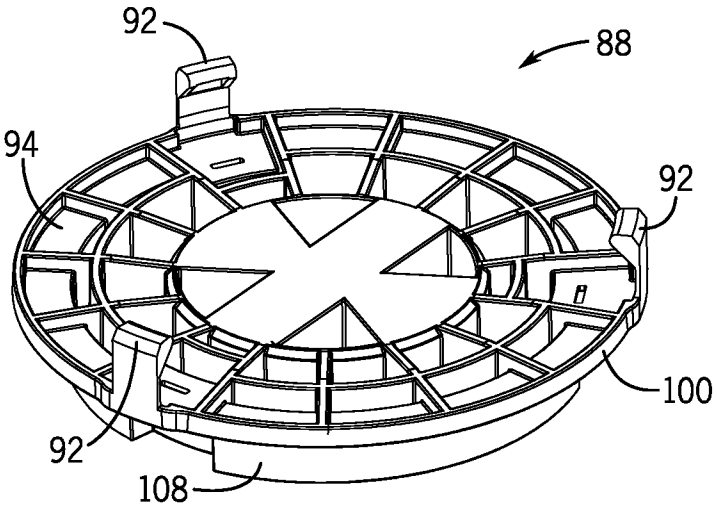
FIG. 6B is a bottom isometric view of the cover of FIG. 6A.
Figure 6C:
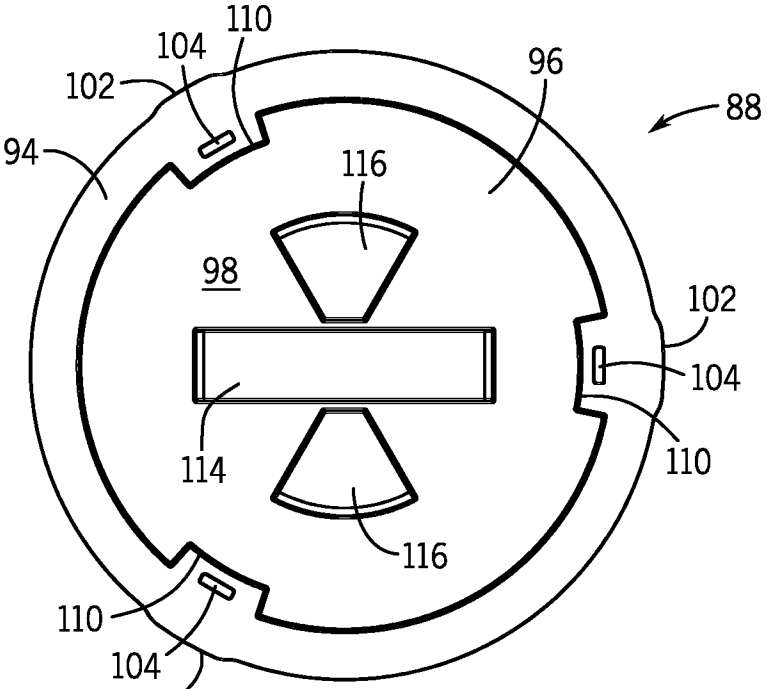
FIG. 6C is a top view of the cover of FIG. 6A.

Looking specifically at FIGS. 6A-6C, the shape of the cover 88 is explained. The cover 88 includes a generally cylindrical outer shape that includes a base section 94 and a raised section 96 extending upwardly away from the base section 94. In some embodiments, the raised section 96 has a generally flat upper surface 98. Hooks 92 can extend downwardly away from the base section 94 to engage the hook ledges 86 of the drain 28, as explained above. The radial outer surface 100 of the base section 94 can include dimples 102 spaced apart from one another and projecting outwardly from the radial outer surface 100, which can help support the hooks 92 that extend away from the base section 94 nearby. In some embodiments, slots 104 can be formed through the base section 94 to receive and secure fingers 106 (see FIG. 7A) of the annular ring 90. The fingers 106 can be snapped into the slots 104, which couples the annular ring 90 to the cover 88 to form the cover assembly 44. The slots 104 can be radially aligned with the dimples 102 and the hooks 92, for example.

The raised section 96 of the cover 88 is formed radially inward from the base section 94 and extends axially away from the base section 94, according to some embodiments. The raised section 96 is defined by a generally cylindrical wall 108, and can include one or more notches 110 formed therein, according to some embodiments. The notches 110 extend radially inward from the cylindrical wall 108 to receive tabs 112 (see FIG. 7A) of the annular ring 90, which can help transmit rotational force from the cover 88 to the annular ring 90.

Rotational force can be imparted on the cover 88 through one or more recesses 114, 116 formed in the raised section 96 of the cover 88. The recesses 114, 116 can be designed to receive tools such as pliers, and can provide an easy clamping location which provides the leverage necessary to rotate the cover assembly 44 and drain 28 relative to the coring sleeve 22. In some embodiments, a rectangular box-shaped recess 114 is approximately centered in the raised section 96 of the cover 88. One or more partially annular recesses 116 can be spaced apart and positioned opposite one another. In some embodiments, the box-shaped recess 114 is formed between two opposing partially annular recesses 116. Optionally, the box-shaped recess 114 or annular recesses 116 can also be used as a storage location, such as for other hardware that may be necessary during the drain assembly installation method 1000. For example, longer screws can be stored within the recesses 114, 116, which can be used to couple the strainer 36 and strainer support ring 38 to the mounting flange 76 of the drain head 32 when shims 46 are installed between the strainer support ring 38 and the mounting flange 76.

An example movable (e.g., collapsible) annular ring 90 according to the disclosure is shown in FIGS. 7A-7D. The annular ring 90 can be generally cylindrical in shape, and can include an inner ring 118 and an outer ring 120 spaced apart from one another and positioned approximately concentrically with one another. Reinforcing ribs 122 can extend between the inner ring 118 and the outer ring 120. In some embodiments, the inner ring 118 is defined by a continuous cylindrical wall 124 defined by a constant or nearly constant radius. It will be appreciated, however, that the inner ring and/or outer ring may be of any compliant geometry without departing from the teachings provided herein. Tabs 112 can extend radially inward from the inner ring 118 of the ring 90, and can be positioned within the notches 110 formed in the cover 88. The tabs 112 can include a partially annular shape, and can each include fingers 106 extending away from a lower surface 126 that can be snap fit into the slots 104 formed in the cover 88.

The ribs 122 extend from the inner ring 118 toward the outer ring 120 to couple the rings 118, 120 to one another. The ribs 122 can extend angularly away from the inner ring 118 toward the outer ring 120, and can have a variety of different shapes and orientations. For example, the ribs 122 can have an arcuate shape having a concave section 128 and a seat 130 formed adjacent the outer ring 120. The seat 130 can extend upward from the concave section 128, and can be positioned to extend approximately level (e.g., along the same plane) to a bottom surface 132 of the inner ring 118.

In some embodiments, the inner ring 118 is defined by a height greater than the outer ring 120.

Figure 7B:
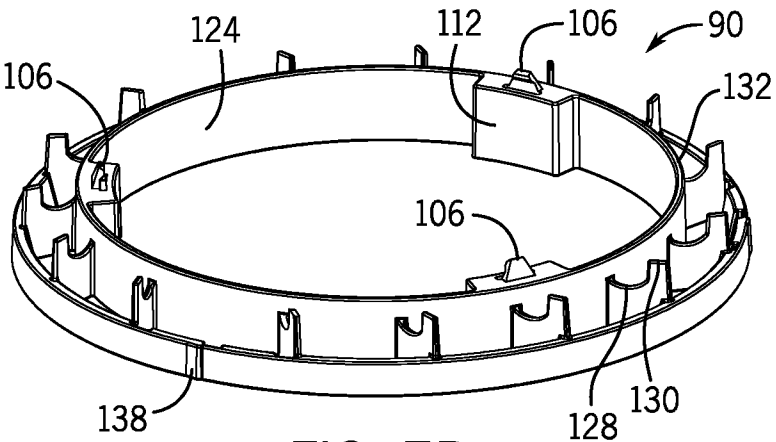
FIG. 7B is a bottom isometric view of the ring of FIG. 7A.
Figure 7D:
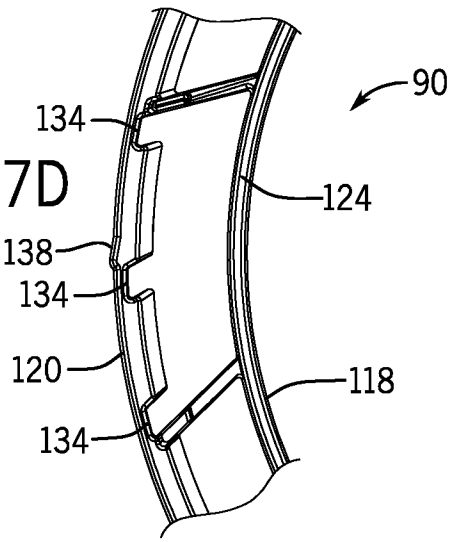
FIG. 7D is a detail view of the ring taken along the dashed circle 7D of FIG. 7C.
Figure 7A:
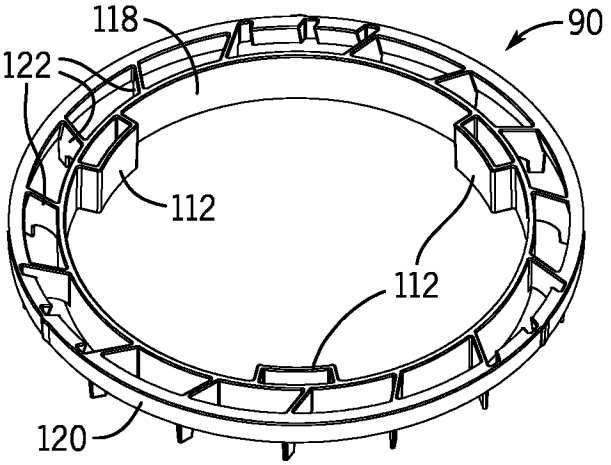
FIG. 7A is a top isometric view of a ring present in the cover assembly of FIG. 5A.
Figure 7C:
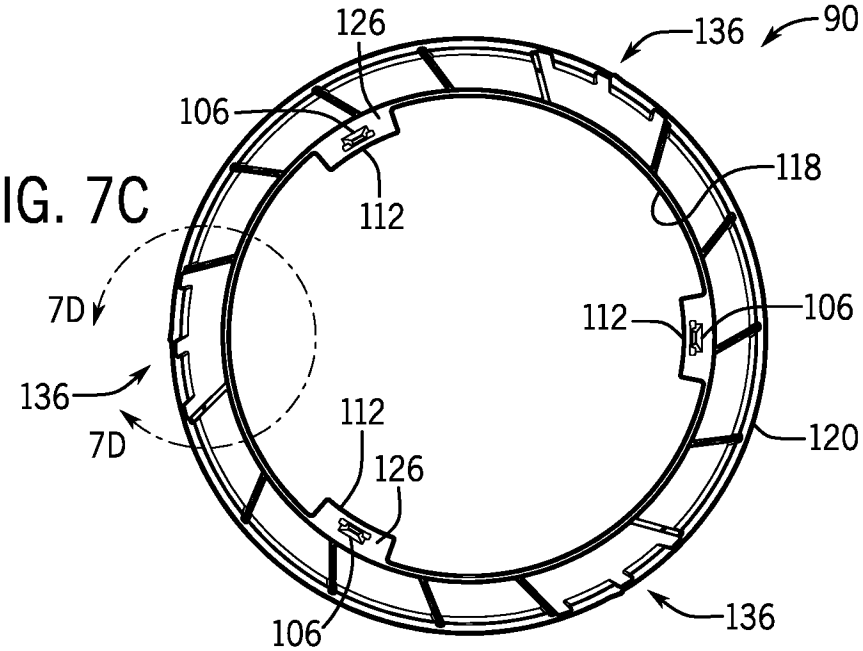
FIG. 7C is a bottom view of the ring of FIG. 7A.

In some embodiments, the outer ring 120 extends concentrically around the inner ring 118. In some embodiments, like the inner ring 118, the outer ring 120 has a generally cylindrical shape. The outer ring 120 includes discontinuities 134, which can help collapse or otherwise move the outer ring 120 when removing the cover assembly 44 from the drain assembly 20. As explained below, the discontinuities 134 in the outer ring 120 may come in a variety of different shapes and orientations. As shown in FIG. 7D, the discontinuities 134 can be notches formed in the outer ring 120, which weaken portions of the structure of the outer ring 120 and define a "crumple zone" 136. A projection 138 can protrude outwardly from the outer ring 120 near the crumple zone 136, which can further help initiate the example collapsing process of the outer ring 120. When the annular ring 120 is rotated (e.g., counterclockwise, to remove the cover assembly 44 from the drain assembly 20) after concrete has been set around the drain assembly 20, the concrete slab imparts a force on the projections 138, according to some embodiments. The force imparted on the projections 138 is transferred to the discontinuous sections of the outer ring 120, which are weakened by the notches (or other type of discontinuity) formed therein. The forces transferred to the outer ring 120 within the crumple zone 136 cause the outer ring 120 to buckle and deform inwardly at the discontinuous, weakened locations formed in the outer ring 120. The outer ring 120 then releases inwardly away from the cured concrete, which allows the entire cover assembly 44 to be removed from the coring sleeve 22.

With reference now to FIGS. 8A-13C, various alternative embodiments of the cover assembly are provided. Similar to the cover assembly 44, each of the cover assemblies 144, 244, 344, 444, 544, 644 include a cover and a movable ring (i.e., an example component that can be configured to, for instance, collapse, transform, deform, bow, bend, flex, shear, or fracture) removably coupled to the cover. The covers include base sections and raised sections, and can be releasably coupled to the drain head 32, for example. The annular ring can include an inner ring and an outer ring positioned concentrically with the inner ring. Ribs extend between the inner ring and the outer ring to couple the inner ring to the outer ring, as well as to provide structural support to the collapsible annular ring. Tabs can extend inwardly away from the inner ring to couple the ring to the cover. Discontinuities can be formed in the outer ring of the example collapsible annular ring. Rectangular box-shaped recesses and partially-annular recesses can be formed within the raised section of the cover.

Figure 8B:
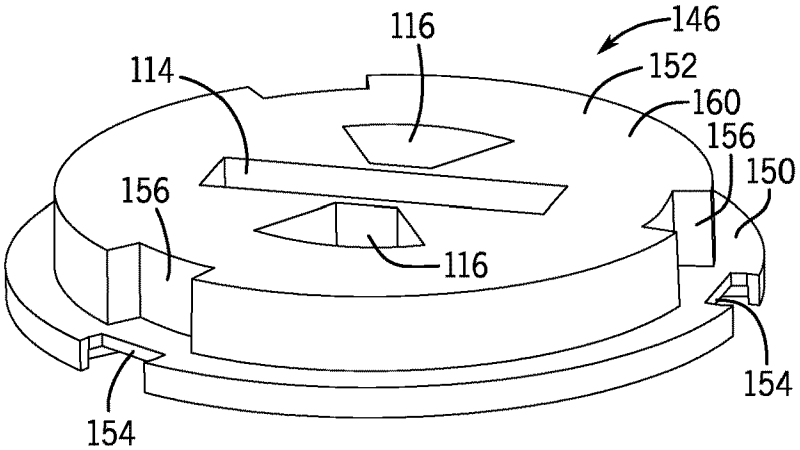
FIG. 8B is a top isometric view of a cover that is present in the cover assembly of FIG. 8A.
Figure 8A:
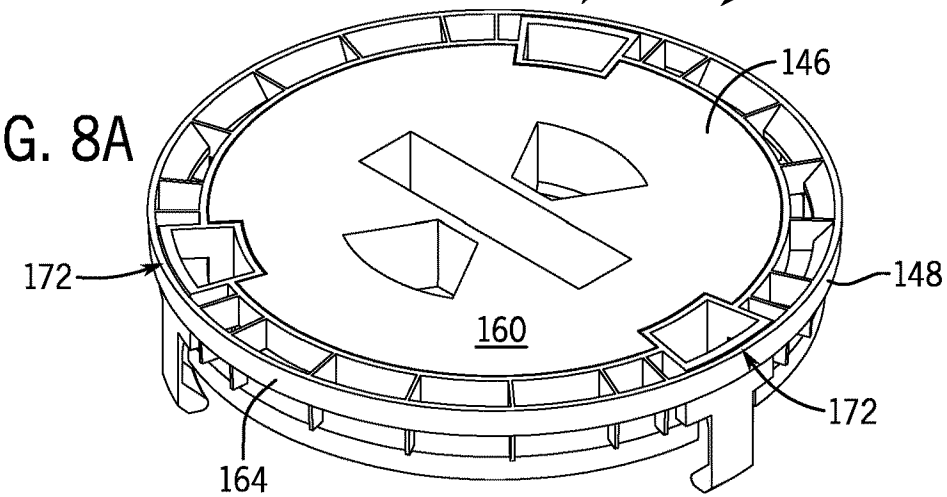
FIG. 8A is a top isometric view of an alternative embodiment of a cover assembly that can be incorporated into the drain assembly of FIG. 1.
Figure 8C:
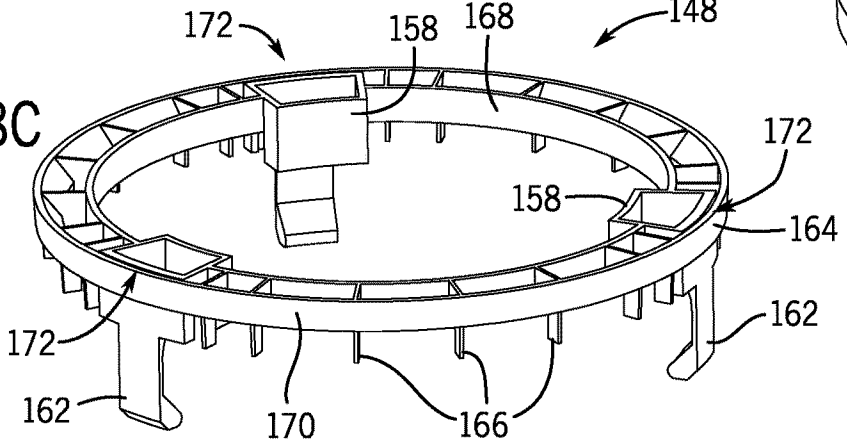
FIG. 8C is a top isometric view of a ring that is present in the cover assembly of FIG. 8A.

Looking specifically at FIGS. 8A-8C, an example cover assembly 144 is shown. The cover assembly 144 includes a cover 146 and an annular ring 148 configured to be movable (e.g., collapsible) and removably coupled to the cover 146. The cover 146 has a base section 150 and a raised section 152, each of which have notches 154, 156 formed therein. The annular ring 148 including tabs 158 can be received around the raised section 152 of the cover 146. Hooks 162 extend away from an outer surface 164 of the annular ring 148 to engage the hook ledges 86 formed on the underside of the drain head 32. Ribs 166 extend generally perpendicularly between an inner ring 168 and an outer ring 170 of the annular ring 148, and can be used to seat the annular ring 148 on the base section 150 of the cover 146. The inner ring 168 and the outer ring 170 are each defined by an approximately equal height. The crumple zone 172 of the outer ring 170 is located radially outward from the tabs 158, where there is an extended segment of the outer ring 170 that is not supported by a rib 166, according to some embodiments. When the cover assembly 144 is rotated, the crumple zone 172 of the outer ring 170 moves (e.g., bows or flexes) inwardly, releasing the annular ring 148 and cover 146 from the surrounding concrete. Although not shown in FIGS. 8A-8C, the outer ring 170 can also include projections similar to projections 138, which extend outwardly away from the outer ring 170 and help to initiate the collapsing process of the crumple zone 172. In addition, the outer surface 164 of the annular ring 148 can be tapered radially inward such that the outer ring 170 has a larger outer diameter at top face relative to the outer diameter at a bottom face (as depicted, for example, in FIGS. 2 and 5C). In one example, the top and bottom diameters differ by about 0.5%, but may differ more or less to accommodate specific application requirements. This frustoconical form factor can further aid upward disengagement and removal of the ring 148.

Figure 9B:
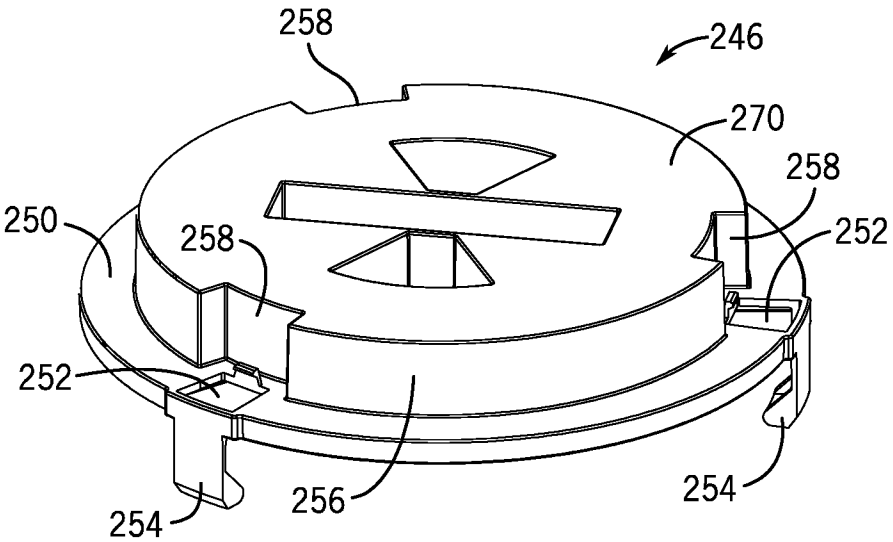
FIG. 9B is a top isometric view of a cover that is present in the cover assembly of FIG. 9A.
Figure 9A:
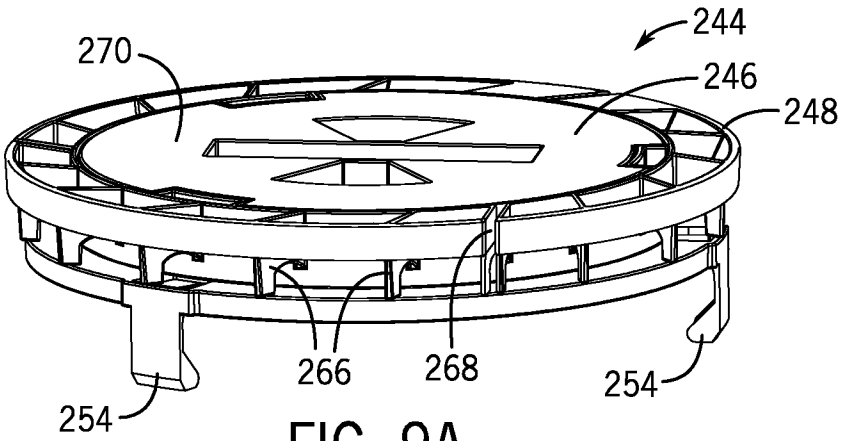
FIG. 9A is a top isometric view of another alternative embodiment of a cover assembly that can be incorporated into the drain assembly of FIG. 1.
Figure 9C:
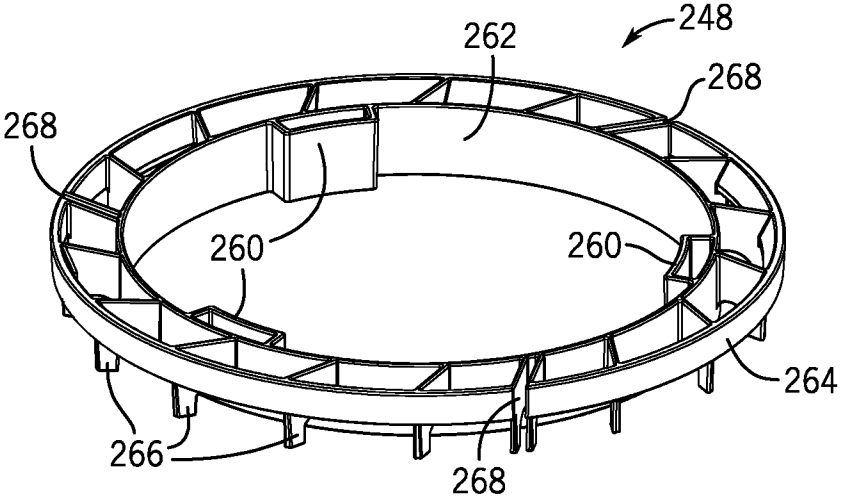
FIG. 9C is a top isometric view of a ring that is present in the cover assembly of FIG. 9A.

With reference now to FIGS. 9A-9C, another example cover assembly 244 that can be present in the drain assembly 20 is shown. The cover assembly 244 includes a cover 246 and a movable component in the form of a ring 248 received around and coupled to the cover 246. The cover 246 includes a flat base section 250 having openings 252 formed therein, along with hooks 254 extending away from the base section 250 to engage the hook ledges 86 on the drain head 32. 5A generally cylindrical raised section 256 extends away from the base section 250 that has notches 258 formed therein to receive tabs 260 extending inwardly away from an inner ring 262 of the annular ring 248. Ribs 266 extend outwardly away from the inner ring 262 to the outer ring 264 positioned concentrically about the inner ring 262. The ribs 266 extend in respective planes that are skewed and nonintersecting with a rotational axis of the cover 246. The outer ring 264 includes discontinuities 268 in the form of gaps. That is, the outer ring 264 is divided into three segments separated by the gap discontinuities 268, which allow the outer ring 264 to move by deforming, such as by collapsing radially inward, during rotation as a result of the rotational drag between the outer ring 264 and an adjacent concrete surface, according to some embodiments. The inner ring 262 has a height greater than the outer ring 264. In some embodiments, labels (not shown) can be placed around the outer ring 264, which can extend across and cover the discontinuities 268 to prevent poured material from entering the cover assembly 244.

Figure 10B:
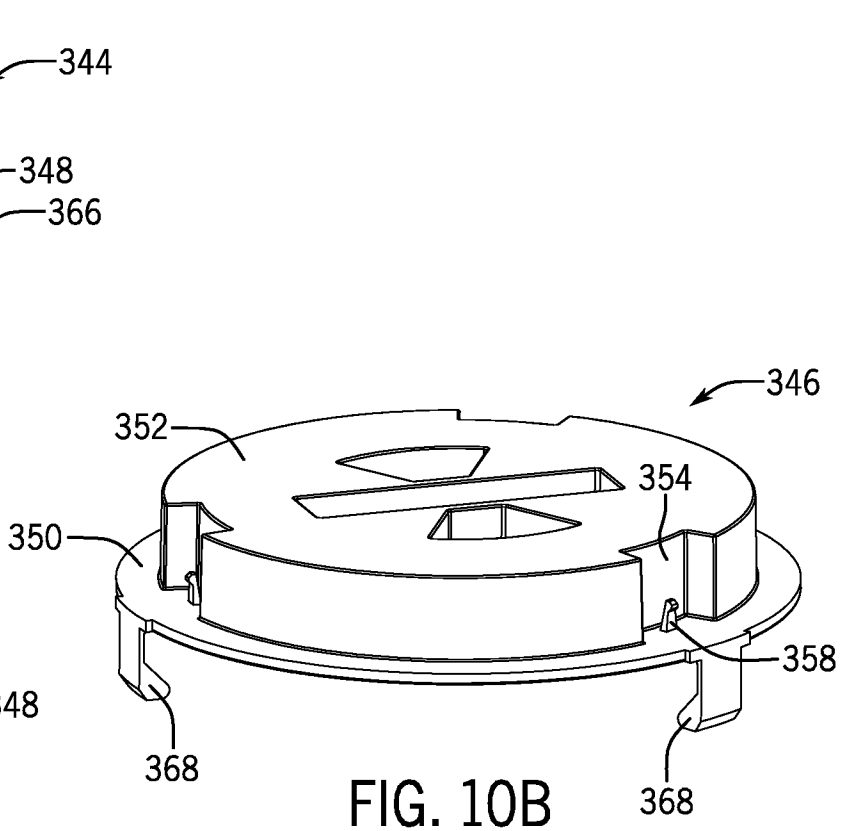
FIG. 10B is a top isometric view of a cover that is present in the cover assembly of FIG. 10A.
Figure 10A:
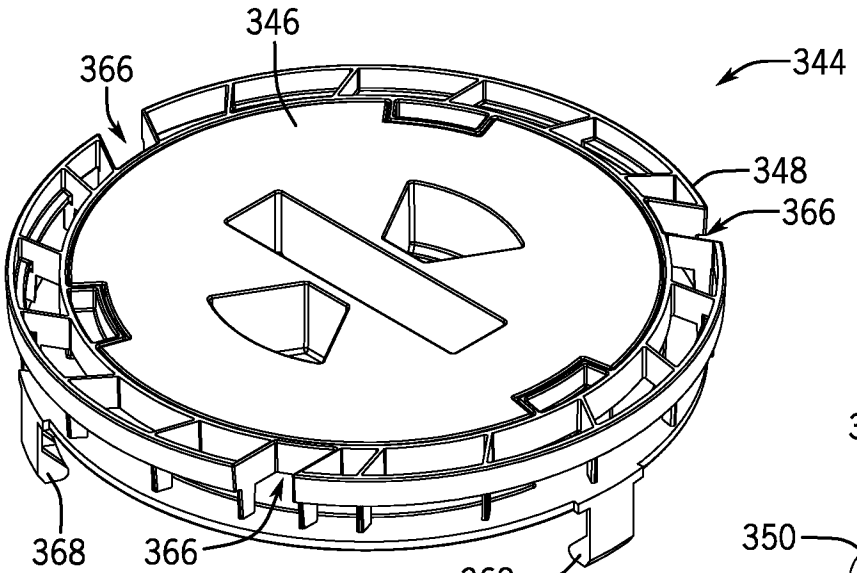
FIG. 10A is a top isometric view of another alternative embodiment of a cover assembly that can be incorporated into the drain assembly of FIG. 1.
Figure 10C:
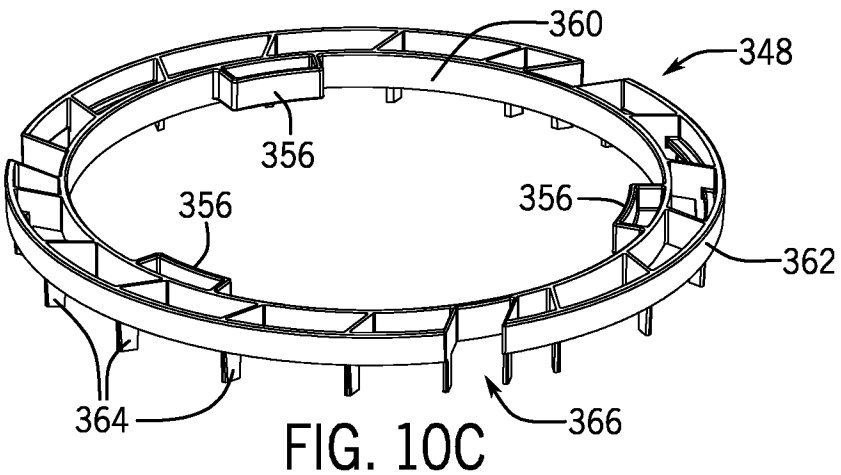
FIG. 10C is a top isometric view of a ring that is present in the cover assembly of FIG. 10A.
Figure 11B:
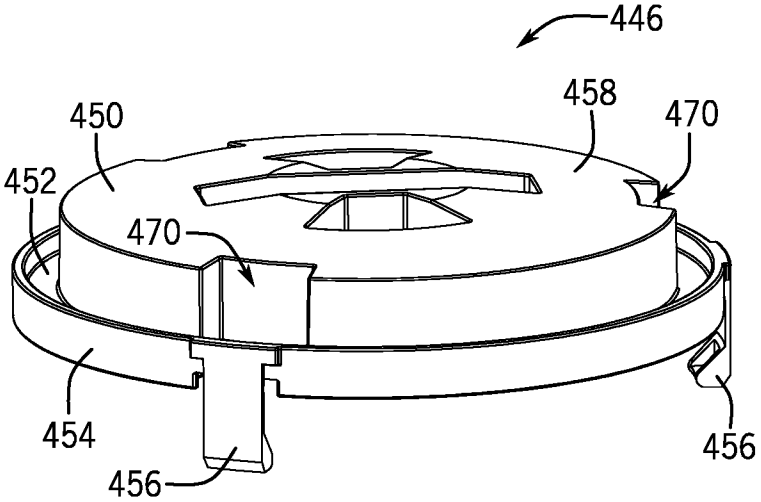
FIG. 11B is a top isometric view of a cover that is present in the cover assembly of FIG. 11A.
Figure 11A:
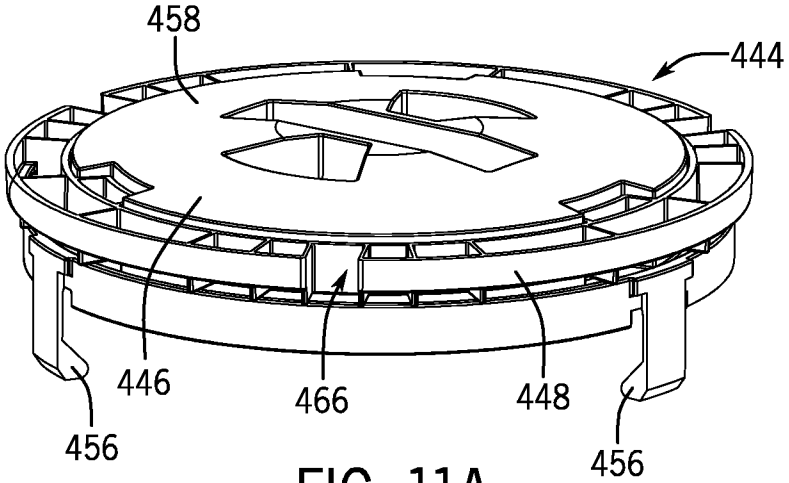
FIG. 11A is a top isometric view of another alternative embodiment of a cover assembly that can be incorporated into the drain assembly of FIG. 1.
Figure 11C:
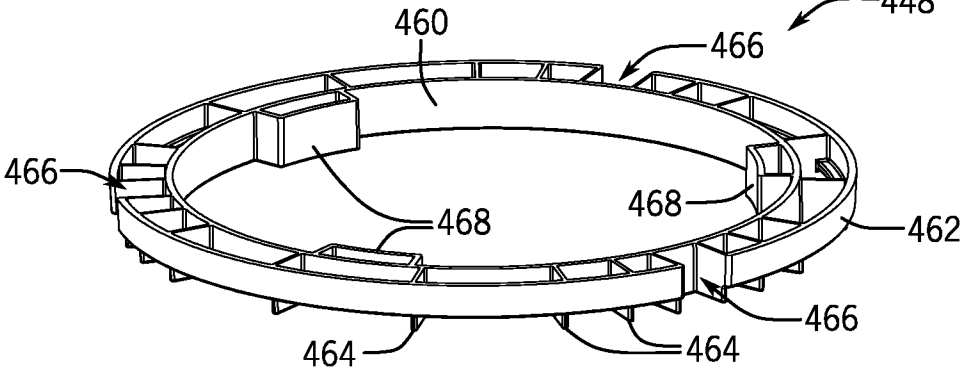
FIG. 11C is a top isometric view of a ring that is present in the cover assembly of FIG. 11A.
Figure 12A:
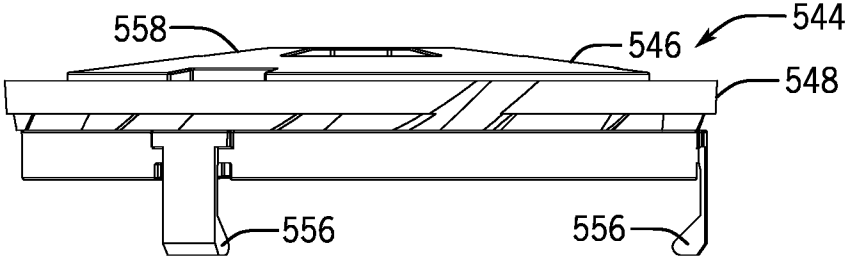
FIG. 12A is a front view of another alternative embodiment of a cover assembly that can be incorporated into the drain assembly of FIG. 1.
Figure 12B:
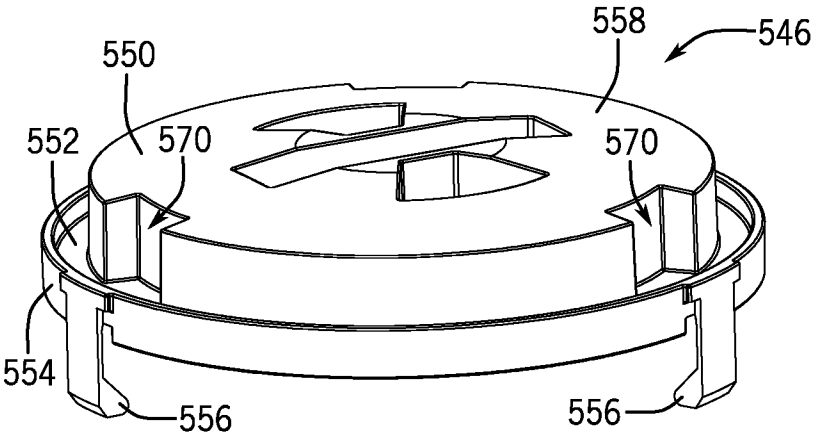
FIG. 12B is a top isometric view of a cover that is present in the cover assembly of FIG. 12A.
Figure 12C:
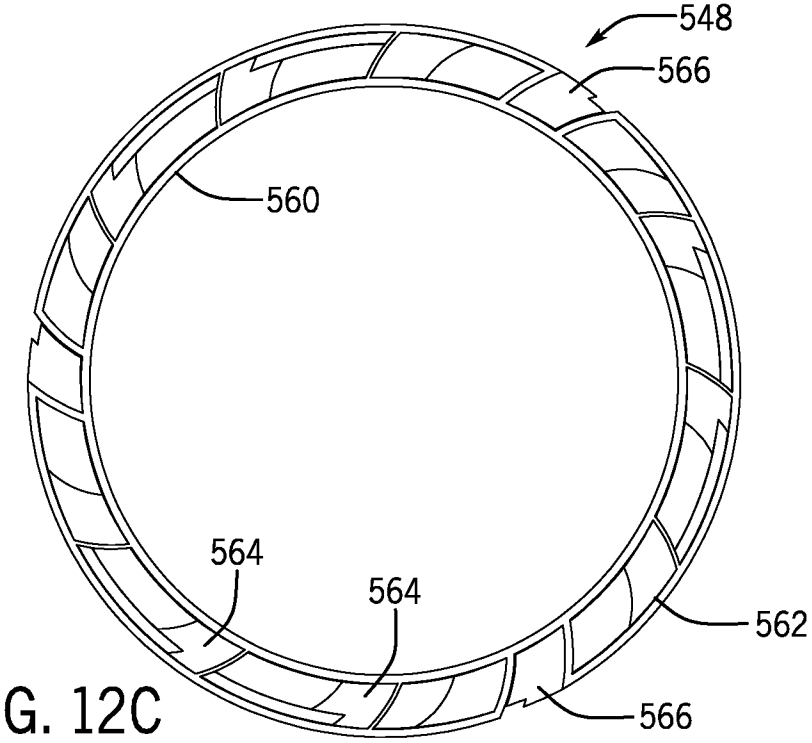
FIG. 12C is a bottom isometric view of a ring that is present in the cover assembly of FIG. 12A.
Figure 13A:
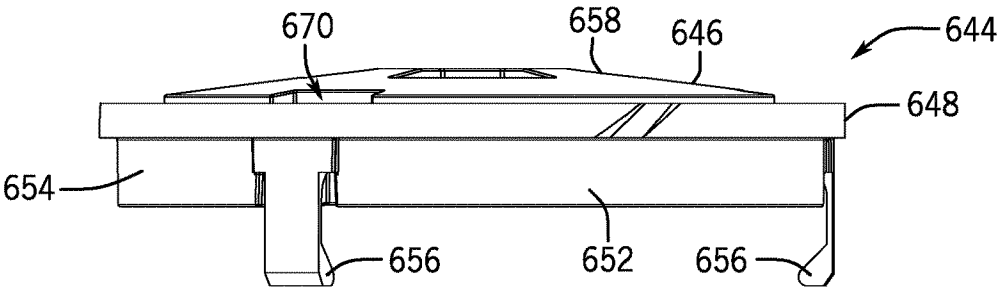
FIG. 13A is a front view of still another alternative embodiment of a cover assembly that can be incorporated into the drain assembly of FIG. 1.
Figure 13B:
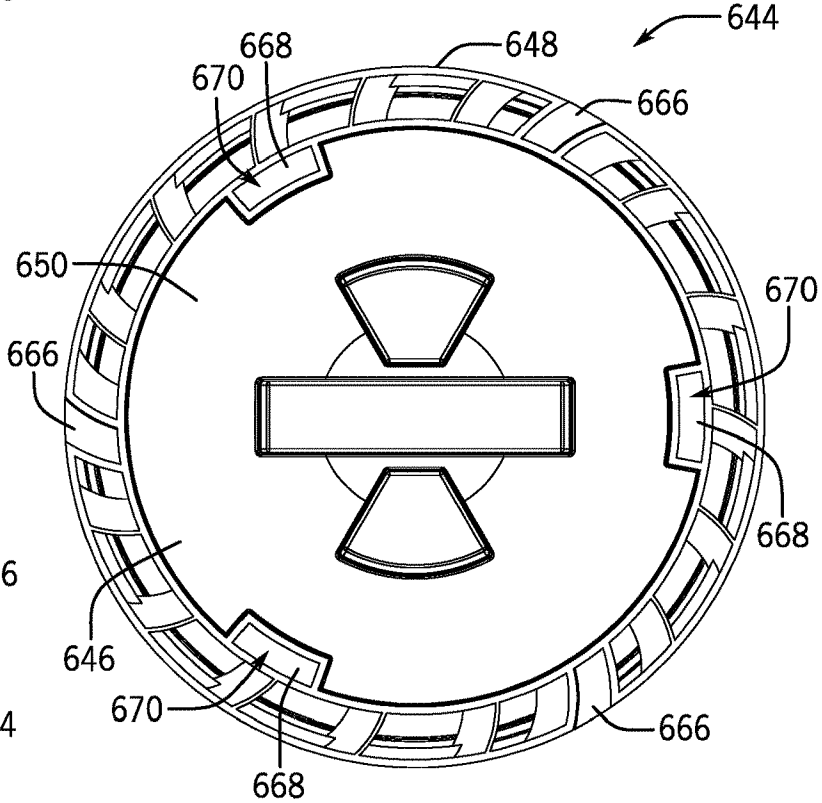
FIG. 13B is a top view of the cover assembly of FIG. 13A.
Figure 13C:
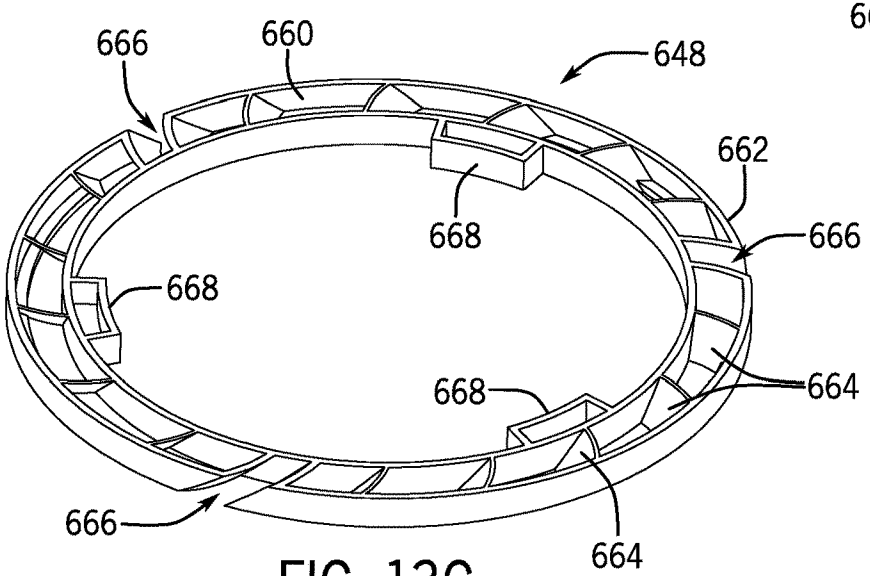
FIG. 13C is a top isometric view of a ring that is present in the cover assembly of FIG. 13A.

Looking now at FIG. 10A-10C, another example cover assembly 344 that can be present in the drain assembly 20 is shown. The cover assembly 344 includes a cover 346 and a movable annular ring 348. The ring 348 (i.e., an example movable component) is configured to move, in this instance to collapse radially inward away from a material (e.g., finished concrete) to aid in the removal of the cover assembly 344. As understood by one skilled in the art given the benefit of this disclosure, the movable component (in this or any other general embodiment) can be configured to, for instance, collapse, transform, deform, bow, bend, flex, shear, or fracture away from (e.g., tangentially, inwardly, or radially inwardly) a material (e.g., finished concrete) to aid in the removal of the cover assembly. The cover 346 includes a base section 350 and a raised section 352 that includes notches 354 formed therein to receive tabs 356 extending inwardly from the annular ring 348. Fingers 358 extend upwardly from the base section 350 within the notches 354 to engage and snap into the tabs 356 of the annular ring 348. Hooks 368 extend downward from the base section 350 to engage the hook ledges 86 of the drain head 32. The annular ring 348 includes an inner ring 360 concentrically positioned with an outer ring 362, which are coupled together by skewed ribs 364. Discontinuities 366 in the form of gaps are formed in the outer ring 362 of the annular ring 348. A variety of structures can be implemented to effect the movement, such as collapsing, transforming, deforming, bowing, bending, flexing, shearing, and/or fracturing. Optionally, labels, stickers, films, sheets, or other coverings can extend across the gaps 366 to prevent concrete or debris from entering the cover assembly 344. When the cover assembly 344 is rotated to remove the cover assembly 344 from the coring sleeve 22, the radial friction between the concrete and the outer ring 362 causes the ribs to buckle inwardly and loosens the outer ring 362 from the surrounding concrete, according to some embodiments.

FIGS. 11A-11C, 12A-12C, and 13A-13C demonstrate still other example embodiments of cover assemblies 444, 544, 644 that can be present in the drain assembly 20. Each cover assembly 444, 544, 644 includes a cover 446, 546, 646 and a movable component in the form of a ring 448, 548, 648 (e.g., a collapsible annular ring) received around a raised section 450, 550, 650 of the cover 446, 546, 646. Again, as understood by one skilled in the art given the benefit of this disclosure, the movable component can be configured to, for instance, collapse, transform, deform, bow, bend, flex, shear, or fracture away from (e.g., tangentially, inwardly, or radially inwardly) a material (e.g., finished concrete) to aid in the removal of the cover assembly. The cover 446, 546, 646 has a base section 452, 552, 652 having an outer lip 454, 554, 654 extending circumferentially around the base section 452, 552, 652 of the cover 446, 546, 646. Hooks 456, 556, 656 extend downwardly away from the base section 452, 552, 652 to engage the hook ledges 86 of the drain head 32. The raised section 450, 550, 650 of the cover 446, 546, 646 includes a convex surface 458, 558, 658 having a radius of curvature. As shown, for instance, in FIGS. 11A, 12A, and 13A, the cover 444, 544, 644 can define an arcuate dome shape that extends upwardly away from the annular ring 448, 548, 648. The curvature of the dome may be uniform, non-uniform, continuous, and/or include discontinuous geometry (e.g., flat spots). The height or relative protrusion of the dome can vary from relatively minimal (i.e., nearly planar) to a bulge defining half or more of the overall height of the cover (as viewed in profile). The example collapsible annular ring 448, 548, 648 includes an inner ring 460, 560, 660 and an outer ring 462, 562, 662 positioned concentrically around the inner ring 460, 560, 660 and coupled to the inner ring by ribs 464, 564, 664 at various orientations relative to the inner ring 460, 560, 660 and the outer ring 462, 562, 662. Discontinuities 466, 566, 666 in the form of gaps are formed in the outer ring 462, 562, 662, which can help to, for example, collapse, deform, and transform the outer ring 462, 562, 662 as described above. The ring 448, 548, 648 can be tailored for application-specific requirements such that a desired relative torque between the inner and outer rings results in a reduction in the overall diameter or form factor of the ring 448, 548, 648. Tabs 468, 668 can extend inwardly away from the inner ring 460, 560, 660 to engage notches 470, 570, 670 formed in the raised section 450, 550, 650 of the cover 446, 546, 646. Optionally, the inner ring 560 can omit tabs, and can rotate freely relative to the cover 546. Instead of rotating the cover 546 to remove the cover assembly 544 from the drain assembly 20, the cover 546 can be lifted vertically away from the coring sleeve 22. The friction between the outer ring 562 and the concrete causes the outer ring 562 to move (e.g., deform axially and radially) while being lifted, which releases the outer ring 562 from the concrete and allows for removal of the entire cover assembly 544.

Figure 14:
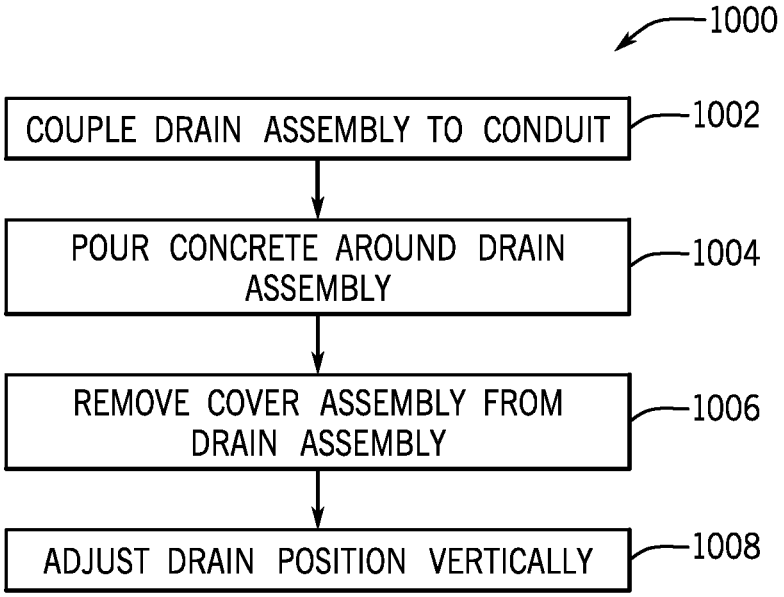
FIG. 14 is a process diagram describing a method for installing the drain assembly of FIG. 1.
Figure 15A:
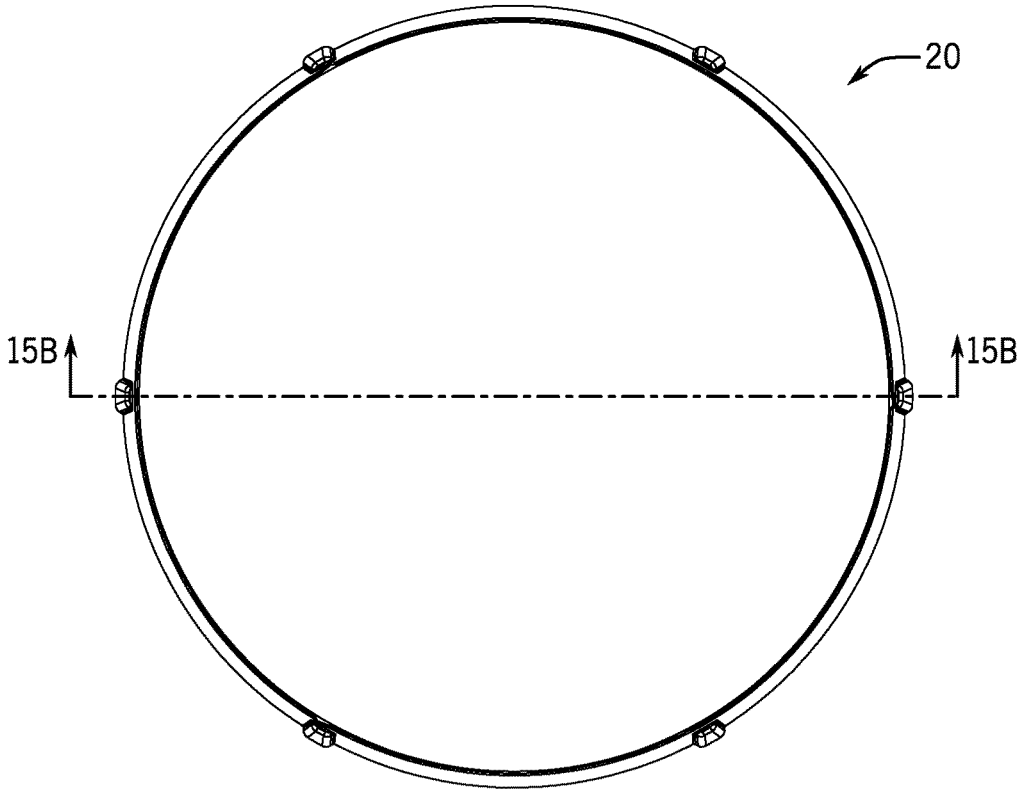
FIG. 15A is a top view of the drain assembly of FIG. 1 installed into a concrete slab.
Figure 15B:
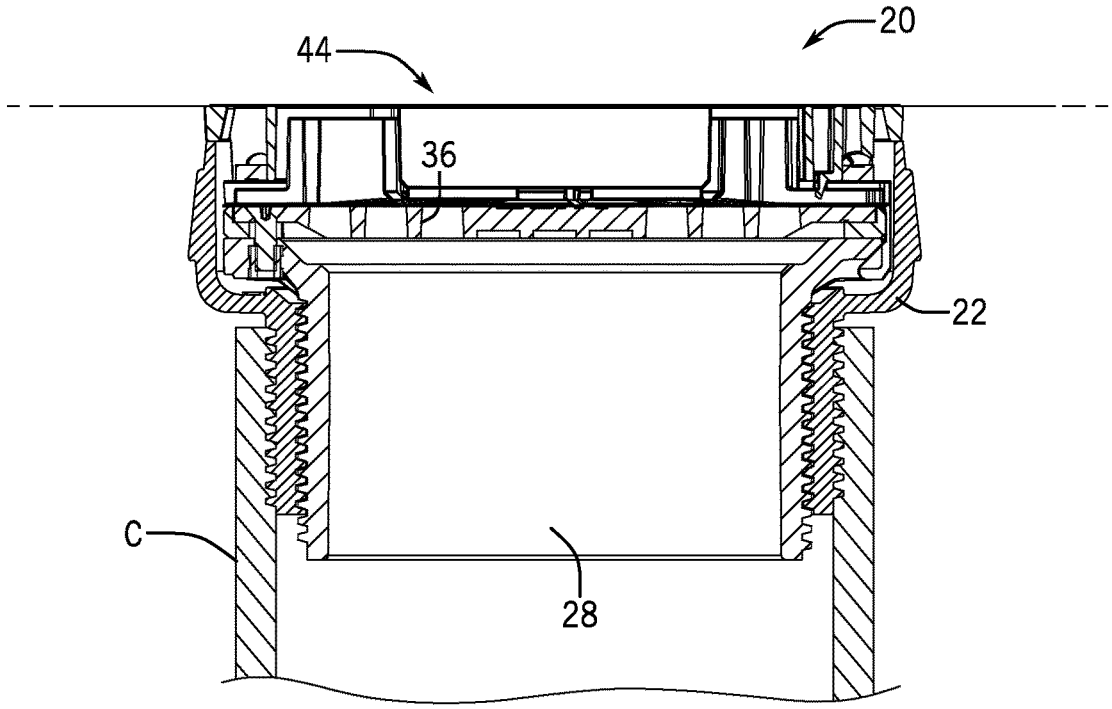
FIG. 15B is a cross-sectional view of the drain assembly of FIG. 15A, taken along line 15B-15B.

Turning now to FIG. 14, a method 1000 of installing the drain assembly 20, 700 into, for instance, a concrete floor or wall is detailed. At block 1002, the drain assembly 20 is coupled to a conduit C, as shown in FIGS. 15A-B. The drain assembly 20 can be coupled to the conduit C in a variety of ways, including through the use of an adaptor (not shown) or a drain body (not shown). The coring sleeve 22 of the drain assembly 20 can be threaded into or otherwise coupled to the conduit C to place the internal bore 54 of the coring sleeve 22 into fluid communication with the conduit C. Due to the positioning of the components within the coring sleeve 22, positioning the coring sleeve 22 in fluid communication with the conduit C also places the drain 28 in fluid communication with the conduit C. The external threads 56 on the coring sleeve stem 24 allow the coring sleeve 22 to be adjusted axially relative to the conduit C to a position where a top surface 98 of the cover assembly 44 is approximately level with an intended finished height of the poured concrete surface, according to some embodiments.

At block 1004, concrete is poured around the drain assembly 20 to secure the drain assembly 20 within the concrete. Concrete can be poured and finished to form a surface approximately level with the cover assembly 44, as shown in FIG. 15B. The concrete can be allowed to harden around the drain assembly 20, where it may shrink slightly while securing the coring sleeve 22 within the concrete slab.

Figure 16:
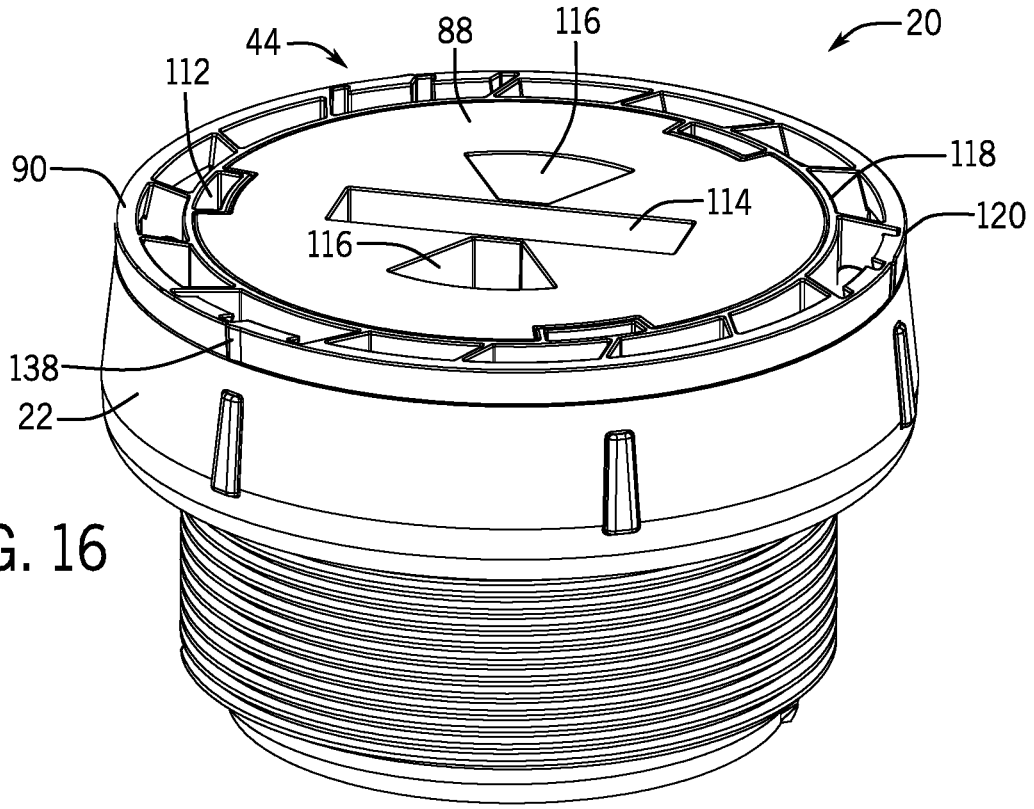
FIG. 16 is a top isometric view of the drain assembly of FIG. 1 with a protective membrane, such as a sticker, removed.

Once the concrete has been set, the cover assembly 44 can be removed from the drain assembly 20 at block 1006. To remove the cover assembly 44, the example membrane in the form of the protective sticker 48 can first be removed. To remove the protective sticker 48 from the cover assembly 44, the sticker 48 can be punctured using pliers or other suitable puncturing tools. The recesses 114, 116 formed within the raised section 96 of the cover 88 provide unsupported regions of the sticker 48 that can be easily punctured. Once the sticker 48 has been punctured, it can be readily peeled off to expose the top surfaces of the cover 88 and the collapsible annular ring 90, as shown in FIG. 16.

Pliers or other suitable gripping tools can then be inserted into one or more of the recesses 114, 116 to securely grip and rotate the cover 88. The rotational force imparted on the cover 88 is translated to the collapsible annular ring 90 through the tabs 112 which are securely received within the notches 110 of the cover assembly 44, according to some embodiments. The rotational force translated to the tabs 112 causes the inner ring 118 to rotate, which forces the projections 138 of the outer ring 120 into contact with the surrounding hardened concrete. The concrete resists the rotation of the outer ring 120, and imparts a force onto the projections 138, which in turn causes the example discontinuities 134 in the outer ring 120 to move (e.g., buckle) within the crumple zone 136 and effectively collapse (e.g., deform or transform) inwardly. The reduced diameter of the outer ring 120 caused by the buckled regions breaks the outer ring 120 free from the surrounding concrete, and allows the cover assembly 44 to rotate freely relative to the coring sleeve 22 and the surrounding concrete.

Figure 17:
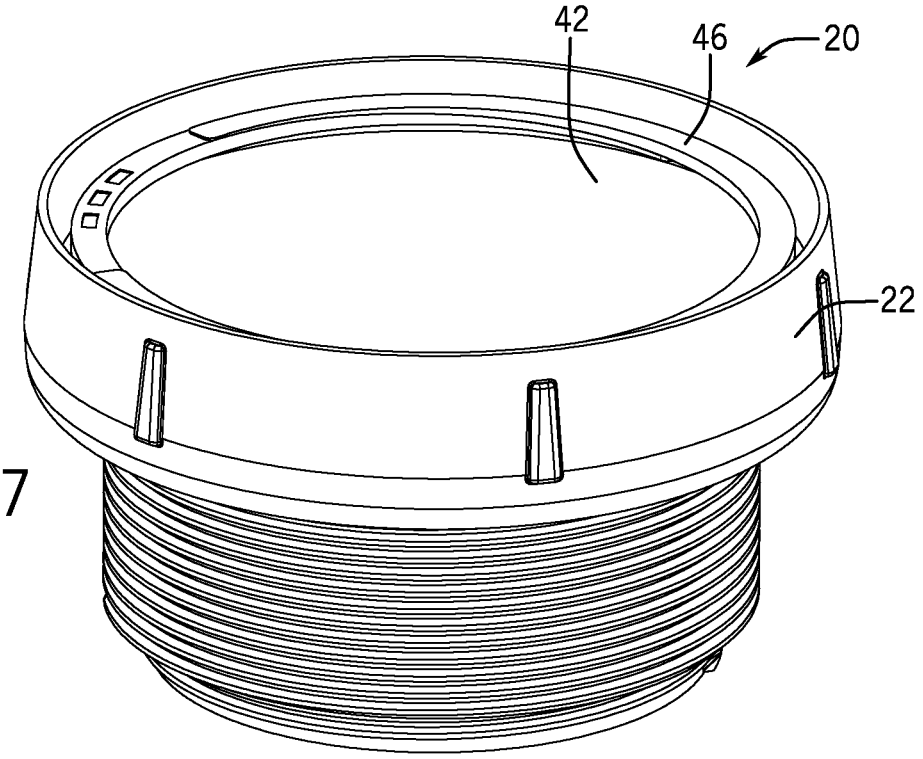
FIG. 17 is a top isometric view of the drain assembly of FIG. 1 with the cover assembly removed.
Figure 18:
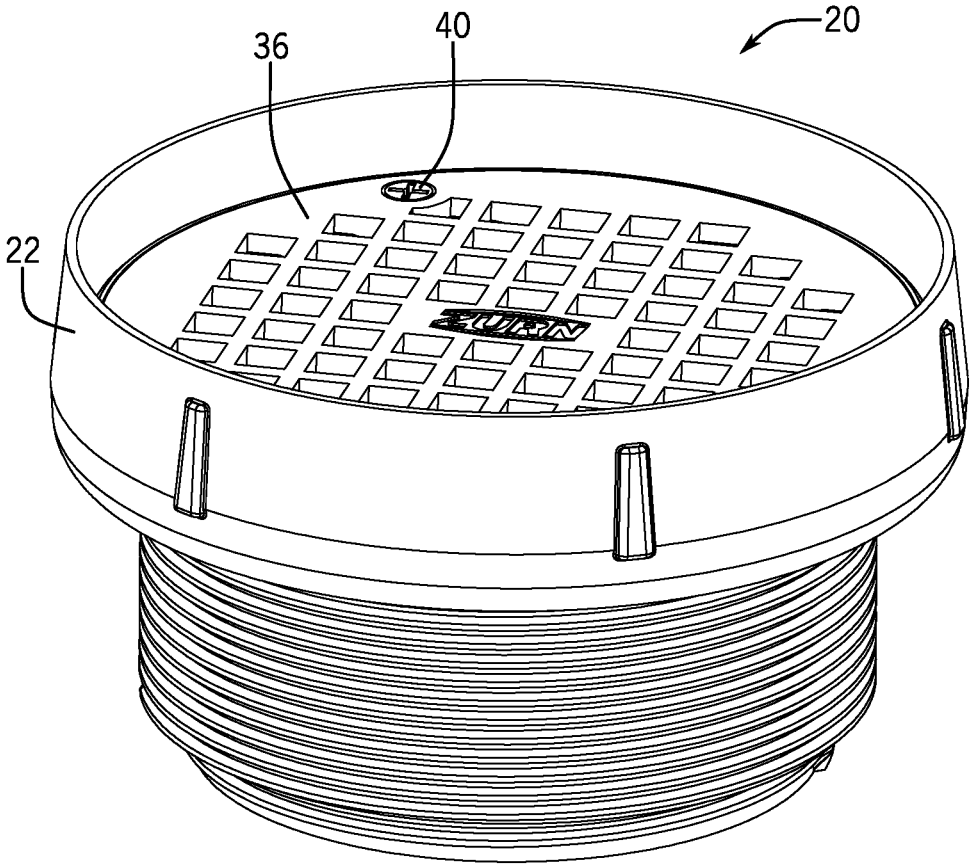
FIG. 18 is a top isometric view of the drain assembly of FIG. 1 with shims and a second protective membrane removed.
Figure 19:
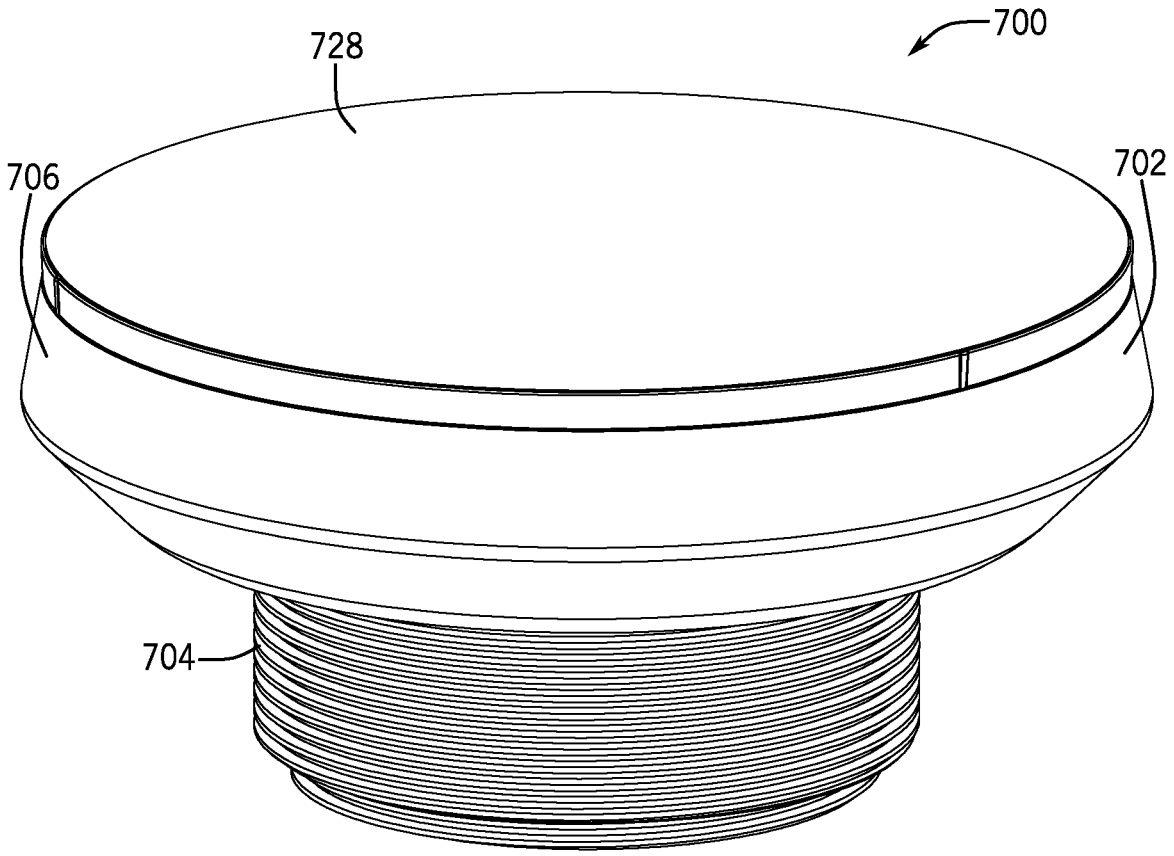
FIG. 19 is a top isometric view of another drain assembly according to embodiments of the disclosure.
Figure 20:
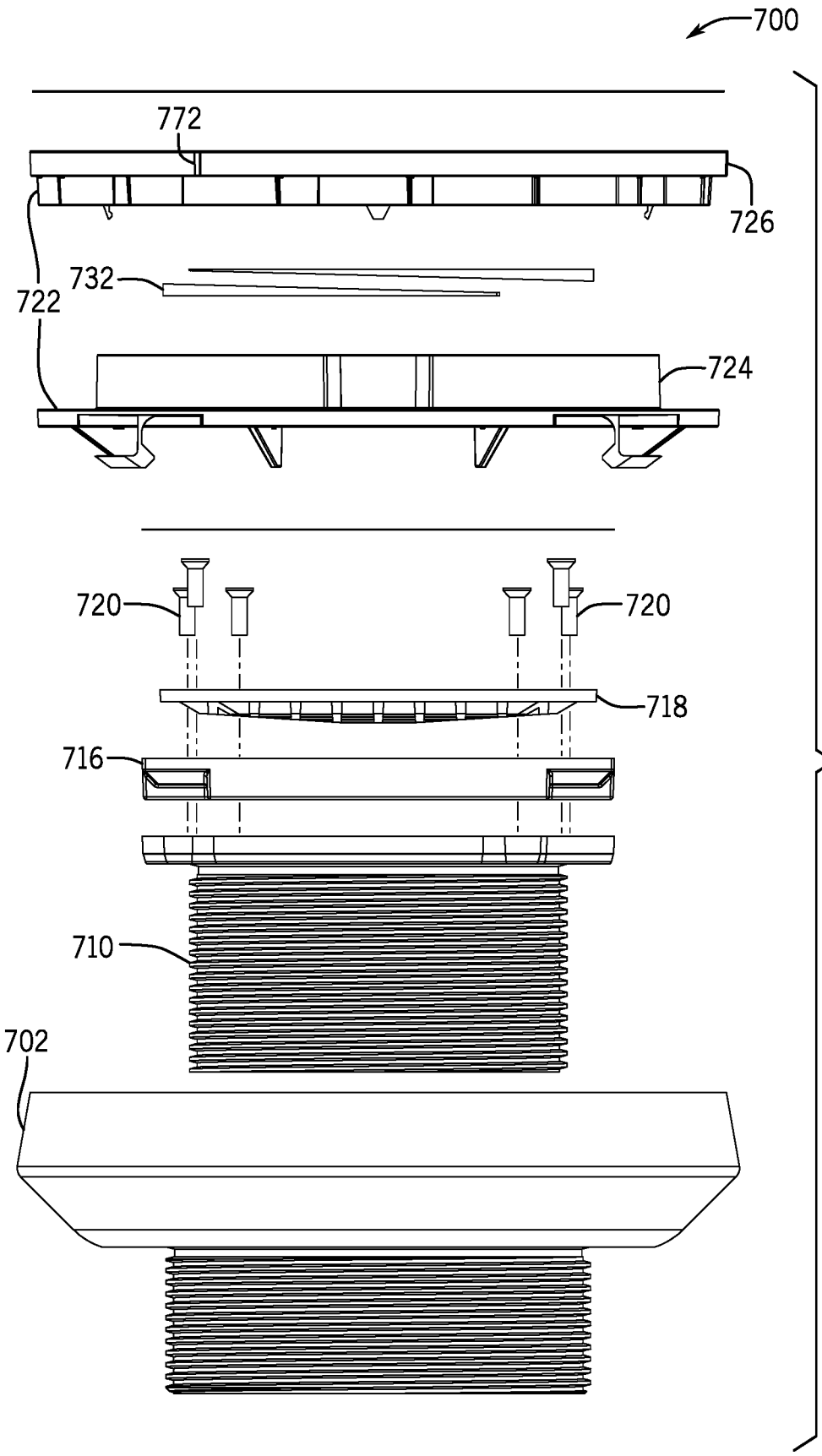
FIG. 20 is an exploded view of the drain assembly of FIG. 19.

The hooks 92 extending downwardly from the cover assembly 44 are coupled to the hook ledges 86 below the drain head 32, which cause the drain 28 to rotate in concert with the cover assembly 44. The cover assembly 44 can be rotated counterclockwise until the drain head 32 is positioned above the bowl 26 of the coring sleeve 22, where the cover assembly 44 can be removed from the drain head 32, according to some embodiments. The hooks 92 can be bent outward to release from the hook ledges 86, which uncouples the cover assembly 44 from the drain 28. In some embodiments, one or more ring shims 46 are received below the cover assembly 44, and are exposed when the cover assembly 44 is removed from the drain head 32, as shown in FIG. 17. The protective sticker 42 extending across the strainer 36 can then be removed, as shown in FIG. 18. Once the protective sticker 42 is removed, the strainer 36 is exposed, and places the finished concrete floor surface in fluid communication with the conduit C through the drain assembly 20, according to some embodiments.

Finally, the drain 28 position can be adjusted at block 1008. The drain 28 can be threadably adjusted within the coring sleeve 22 upward until the strainer 36 is positioned approximately level with the finished concrete surface nearby. If angular adjustment is needed, ring shims 46 can be positioned beneath the drain head 32 to adjust an angle of the drain head 32 relative to the coring sleeve 22, according to some embodiments.

Referring now to FIGS. 19-27C, another example drain assembly 700 is shown. Like the drain assembly 20, the drain assembly 700 includes a coring sleeve 702 having a stem 704 and a bowl 706 that can be placed into fluid communication with a conduit and/or installed into a poured surface. The bowl 706 of the coring sleeve 702 can be formed of flat, radially outward tapering, and/or radially inward tapering walls that collectively define a bowl cavity 708. A drain 710 can be adjustably received (e.g., threadably received) within the stem 704 and bowl cavity 708 of the coring sleeve 702. The drain 710 includes a drain head 712 and a threaded stem 714 that can be coupled to the stem 704 of the coring sleeve 702. A strainer support 716 and a strainer 718 can be removably coupled to the drain head 712 using fasteners 720, for example. A cover assembly 722 including a cover 724 and a movable component in the form of an example collapsible annular ring 726 can also be at least partially received within the bowl cavity 708, and can extend across the bowl 706 to protect the drain 710 positioned beneath. As understood by one skilled in the art given the benefit of this disclosure, the movable component (in this or any other general embodiment) can be configured to, for instance, collapse, transform, deform, bow, bend, flex, shear, or fracture away from (e.g., tangentially, inwardly, or radially inwardly) a material (e.g., finished concrete) to aid in the removal of the cover assembly 722. The cover assembly 722 can be removably coupled to the strainer support 716. Protective membranes 728, 730 (e.g., stickers, films, sheets, layers, barriers) can be coupled to and extend across the strainer 718 and the annular ring 726, respectively, to provide additional protection from debris during drain assembly 700 installation. Shims 732 can be received within the cover assembly 722, as explained in more detail below.

Figure 21:
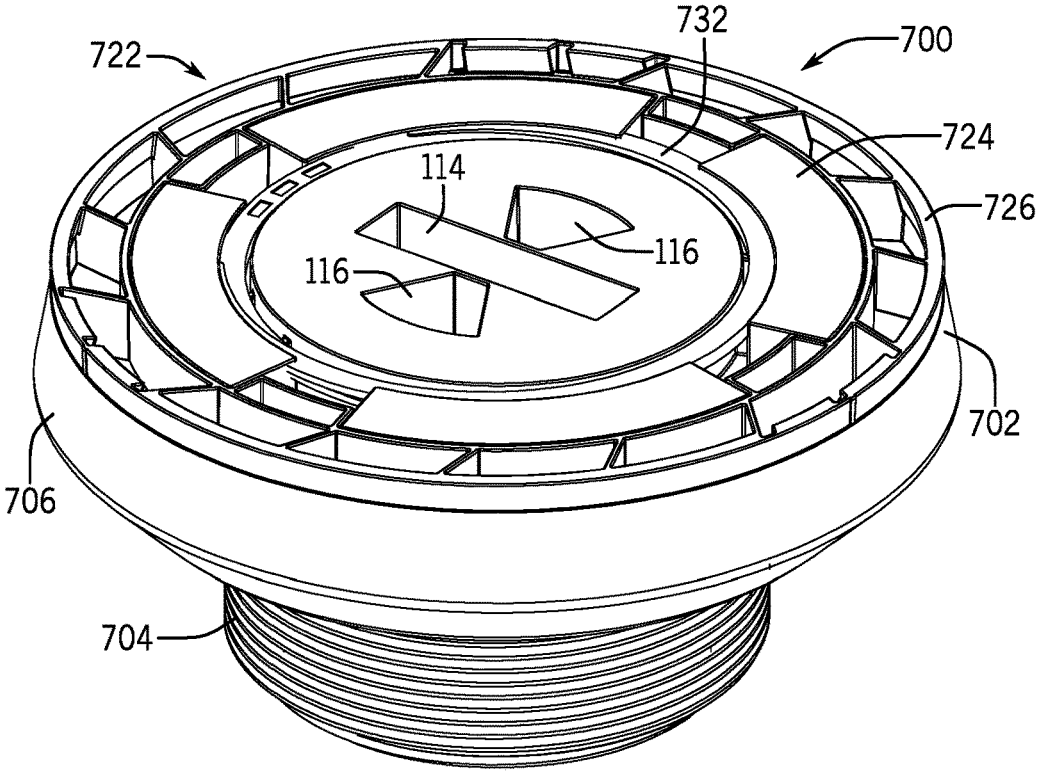
FIG. 21 is a top isometric view of the drain assembly of FIG. 19 with a top protective membrane removed.
Figure 22:
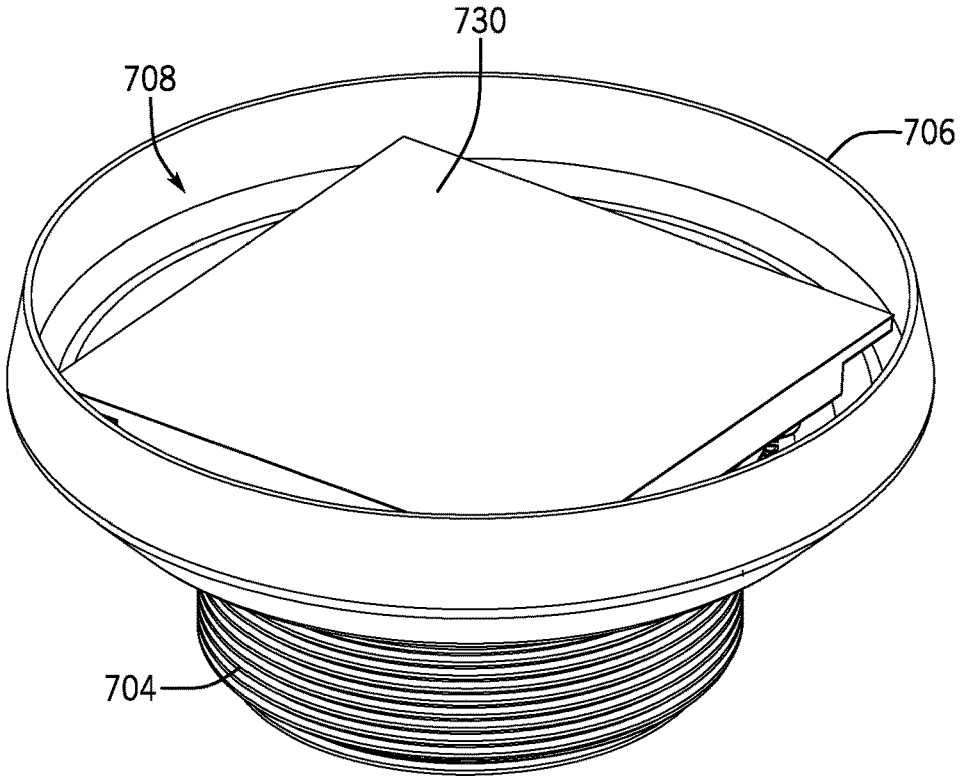
FIG. 22 is a top isometric view of the drain assembly of FIG. 19 with its cover assembly removed.
Figure 23:
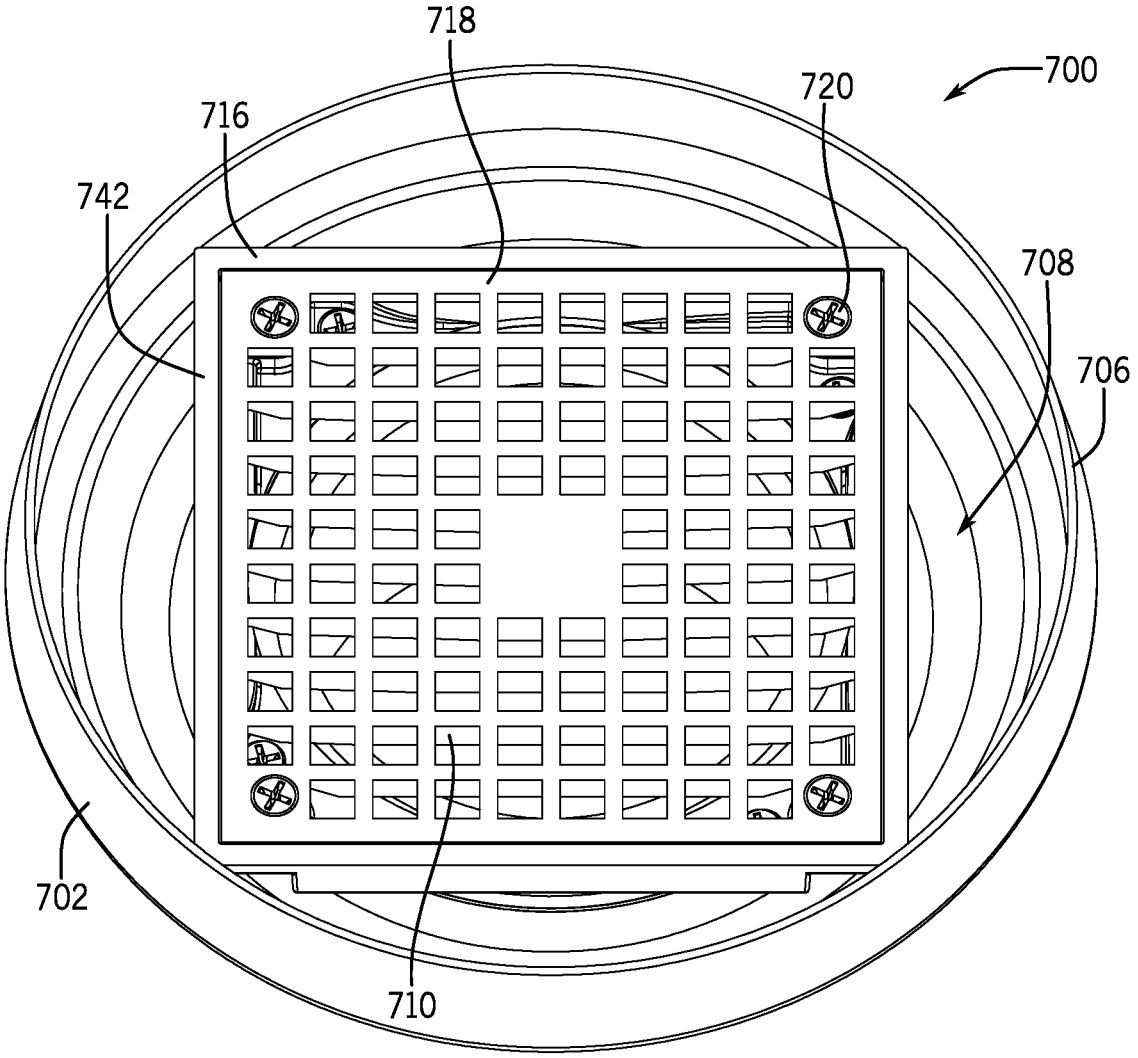
FIG. 23 is a top isometric view of the drain assembly of FIG. 19 with a second protective membrane removed.

The drain assembly 700 can also be installed using the method 1000 described above. Once the coring sleeve 702 has been set at a desired height and the concrete cured, the top protective membrane 728 can be removed from the cover assembly 722. Pliers or other tools can be used to puncture the protective membrane 728, which then can be peeled away from the cover assembly 722 to expose the cover assembly 722, as shown in FIG. 21. Again using pliers or another tool, the cover assembly can be rotated relative to the set concrete, which causes the example collapsible annular ring 726 to buckle inwardly and release from the concrete. Once the annular ring 726 has released from the concrete, the cover assembly 722 can be removed from the drain assembly 700, exposing the protective membrane 730 positioned atop the strainer 718, as shown in FIG. 22. The protective membrane 730 can then be peeled off or otherwise removed from the strainer 718 to expose the strainer 718 and place the drain 710 and underlying conduit in fluid communication with the external environment, as shown in FIG. 23.

Figure 24:
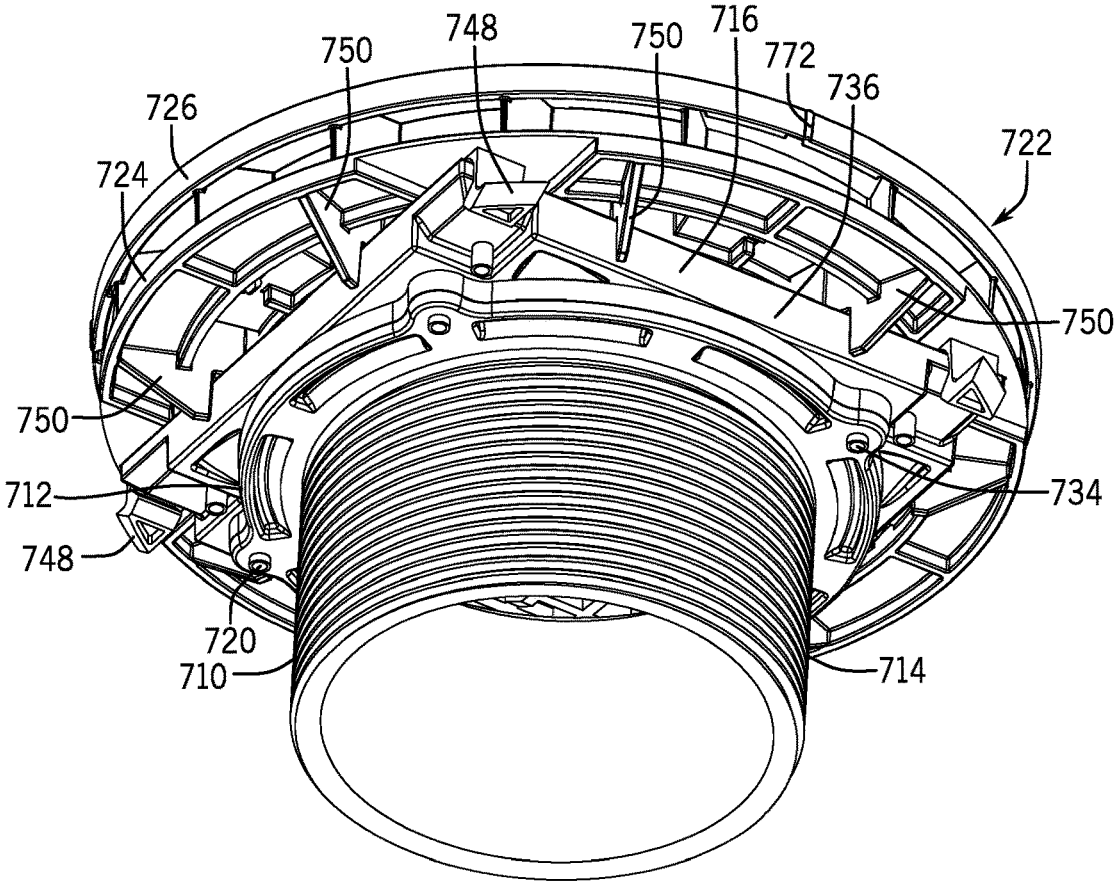
FIG. 24 is a bottom isometric view of the drain, strainer, and cover assembly of the drain assembly of FIG. 19.
Figure 25:
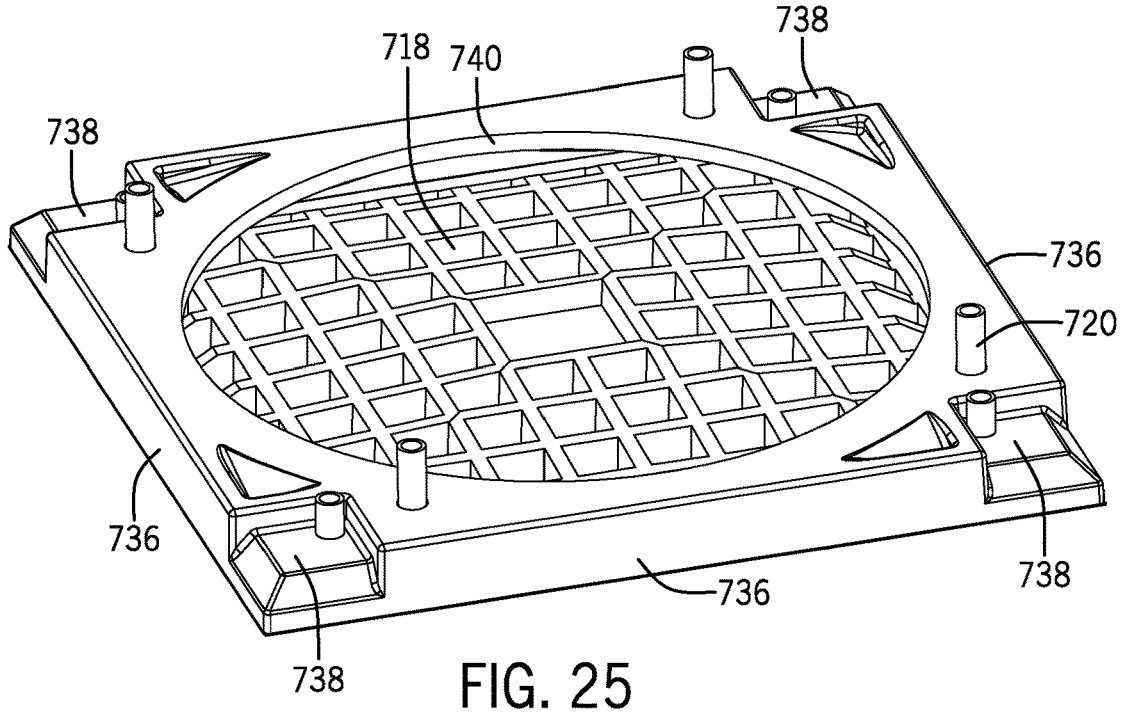
FIG. 25 is a bottom isometric view of the strainer present in the drain assembly of FIG. 19.
Figure 27B:
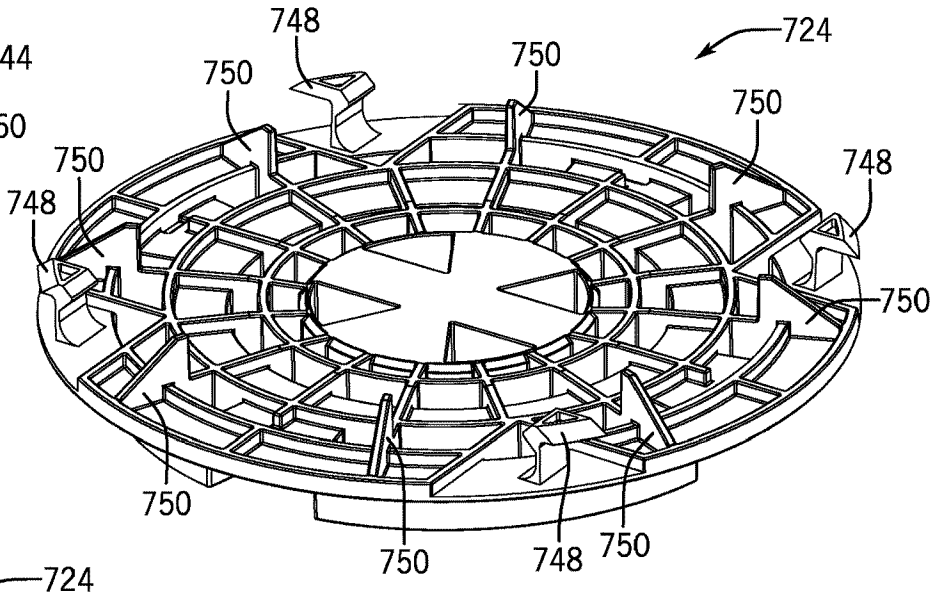
FIG. 27B is a bottom isometric view of the cover of FIG. 27A.
Figure 27A:
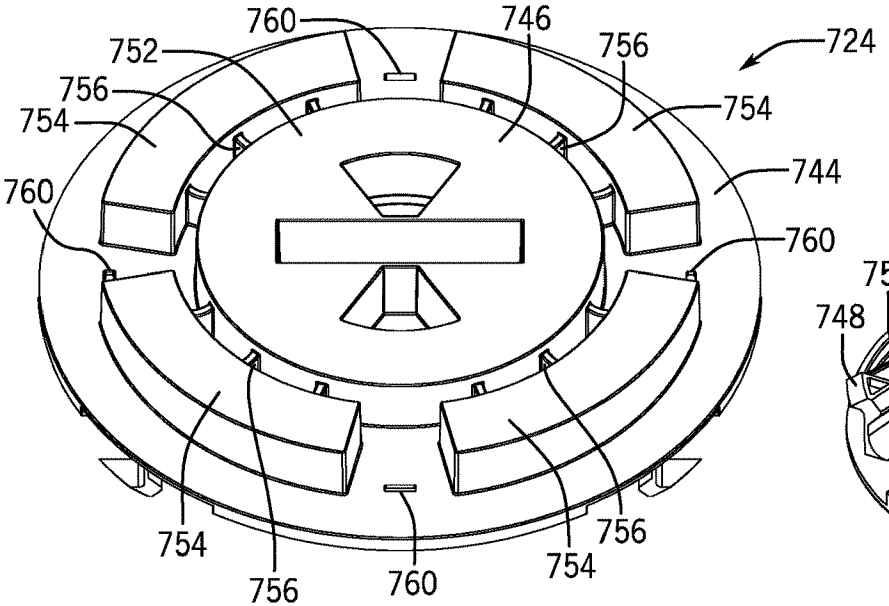
FIG. 27A is a top isometric view of a cover present in the cover assembly of FIG. 26A.
Figure 27C:
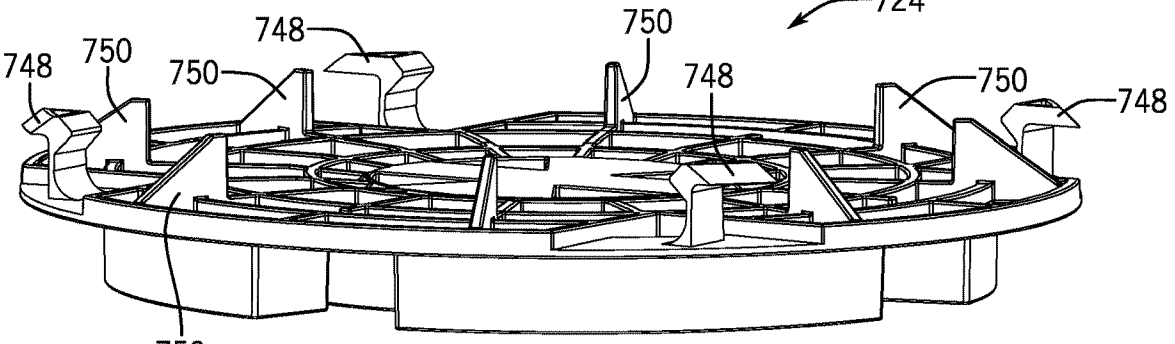
FIG. 27C is a second bottom isometric view of the cover of FIG. 27A.
Figure 28:
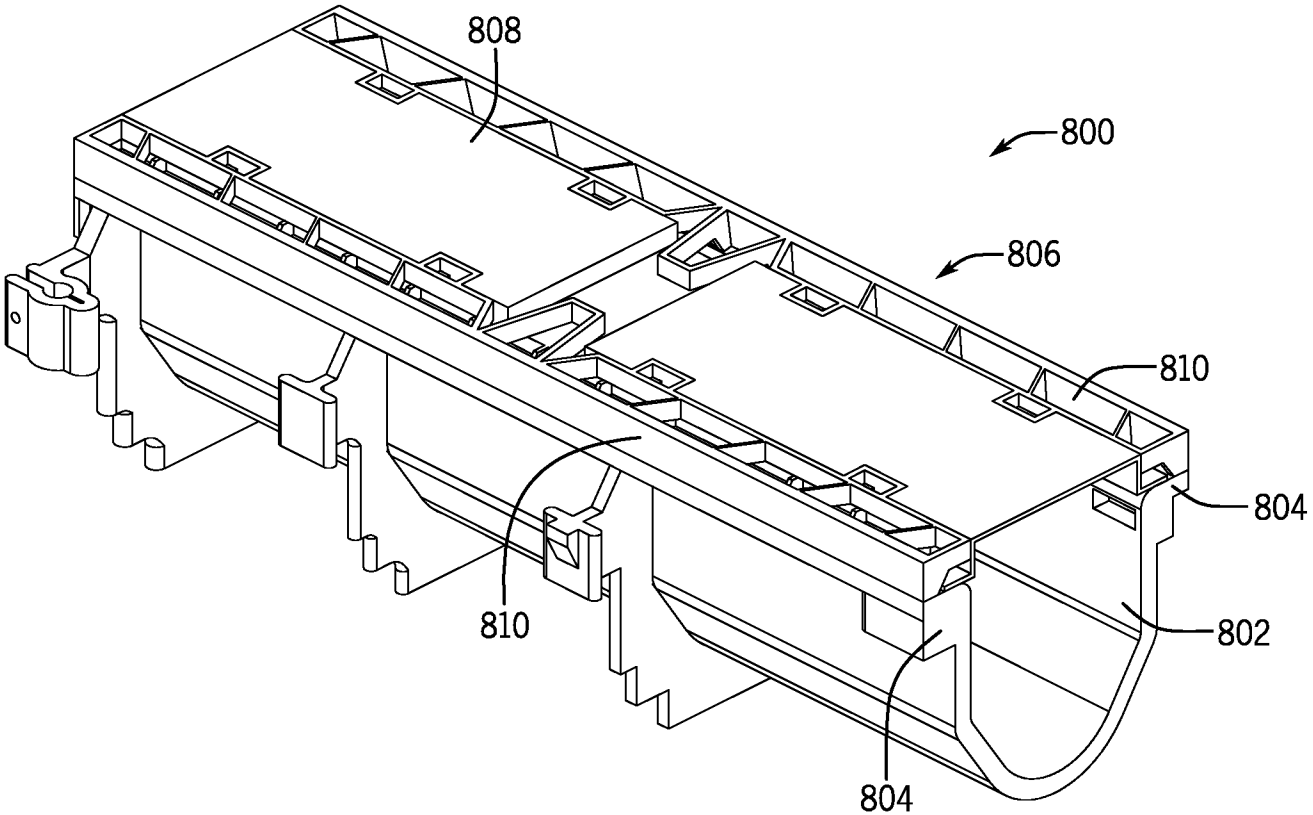
FIG. 28 is a top isometric view of a linear drain assembly.
Figure 29B:
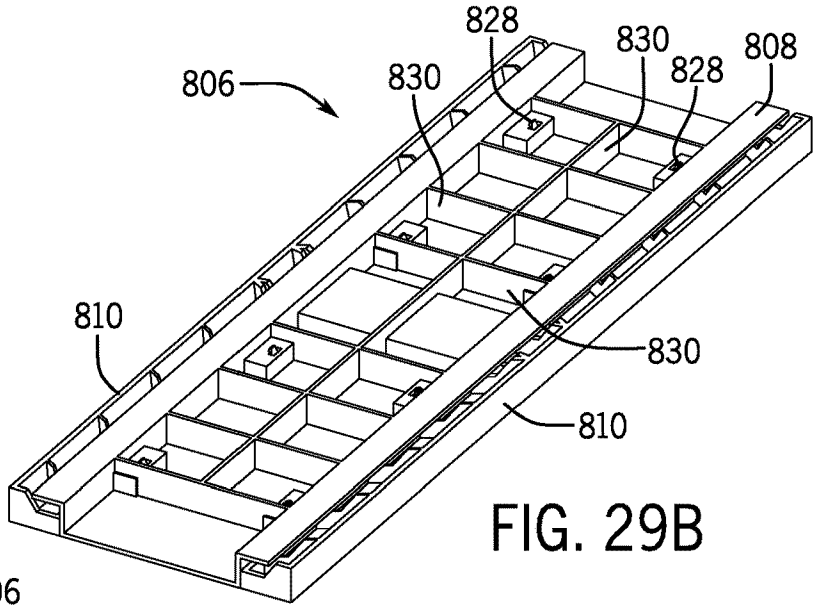
FIG. 29B is a bottom isometric view of the cover assembly of FIG. 29A.
Figure 29A:
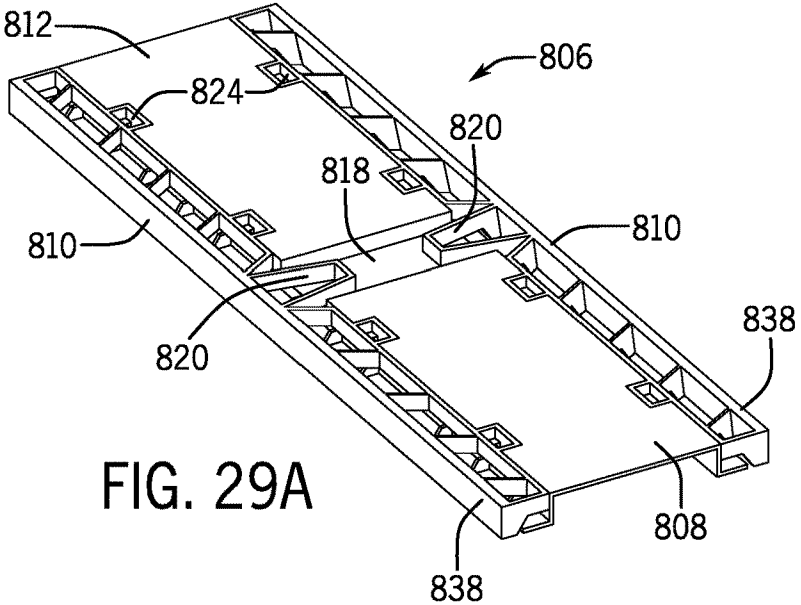
FIG. 29A is a top isometric view of a cover assembly that can be coupled to the linear drain assembly of FIG. 28.
Figure 29C:
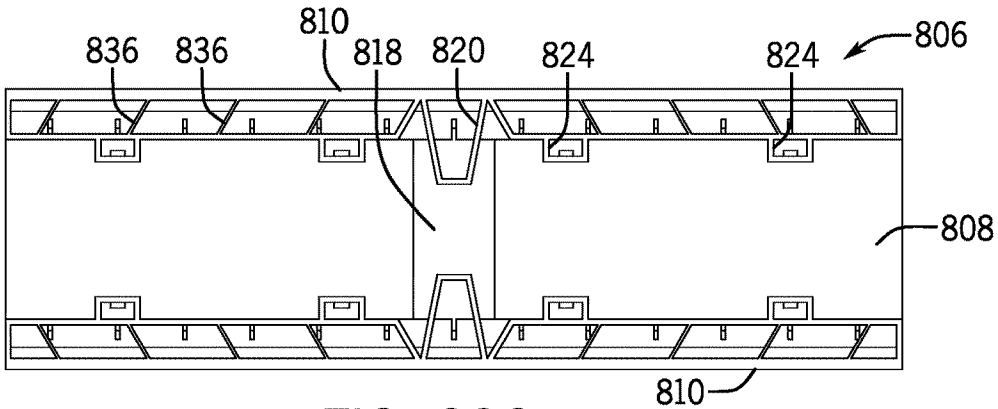
FIG. 29C is a top view of the cover assembly of FIG. 29A.

With reference specifically to FIGS. 24 and 25, the drain 710 and strainer support 716 are shown in further detail. The drain 710 includes a threaded stem 714 that can be axially adjustable within the coring sleeve stem 704. The drain head 712 extends away from the drain stem 714 to provide a flat, mounting surface to receive the strainer support 716. The strainer support 716 can sit flat upon the drain head 712, and can be removably coupled to the drain head 712 by passing fasteners 720 through the strainer support 716 and into holes 734 formed in the drain head 712. In some examples, the fasteners 720 and the holes 734 are threaded. In other embodiments, the fasteners 720 can be dowel pins that are sized to form an interference fit with the holes 734, which couple the components to one another.

The strainer support 716 can have a generally rectangular perimeter (e.g., square) defined by rectangular walls 736. One or more sunken surfaces can be formed about the outer perimeter of the strainer support 716 to define hook ledges 738. In some examples, a hook ledge 738 is formed at each corner of the strainer support 716. A generally circular channel 740 can extend through the strainer support 716, which can be aligned concentrically above the drain stem 714 and drain head 712. The strainer 718 can then be coupled to the strainer support 716 using fasteners 720 (e.g., screws or dowel pins). In some embodiments, a raised lip 742 (shown in FIG. 23) is used to help position the strainer 718 within the strainer support 716.

Referring now specifically to FIGS. 26A-27C, the cover assembly 722 is shown in additional detail. The cover assembly 722 includes a cover 724 and another example ring 726 received around and removably coupled to the cover 724, and shares many common features with the cover assemblies 44, 144, 244, 344, 444, 544, 644 described above. The cover 724 includes a generally cylindrical shape and has a base section 744 and a raised section 746 extending away from the base section 744. One or more hooks 748 extend downwardly away from the base section 744, where they can engage and releasably couple to the hook ledges 738 formed in the strainer support 716. One or more positioning arms 750 can extend downward from the base section 744 as well. The positioning arms 750 can be oriented to engage the rectangular walls 736 of the strainer support 716 (as shown in FIG. 24), and can be used to translate rotational force imparted on the cover assembly 722 to the strainer support 716 and drain 710 below. Accordingly, when the cover assembly 722 is rotated, the drain 710 rotates within the coring sleeve 702, which adjusts the vertical position of the strainer 718 relative to the coring sleeve 702, according to some embodiments.

The raised section 746 of the cover 724 can include several segments. Similar to the covers 88, 146, 246, 346, 446, 546, 646 described above, the raised section 746 can have a generally cylindrical shape having recesses 114, 116 formed therein. A central segment 752 has a generally cylindrical shape, and is surrounded by a plurality of partially annular segments 754 spaced apart from and concentrically positioned about the central segment 752. In some examples, braces 756 extend between the central segment 752 and the partially annular segments 754 to provide support for one or more shims 732 that can be used to later position the strainer 718, for example. The partially annular segments 754 can be spaced apart from one another, such that a tab 758 formed on the collapsible annular ring 726 can be received between two partially annular segments 754. The partially annular segments 754 can translate rotational force from the cover 724 through to the ring 726 through engagement between the tabs 758 and the partially annular segments 754. Slots 760 can be formed through the base section 744 to receive fingers 762 that removably couple the annular ring 726 to the cover 724.

The movable component in the form of an example ring 726 can have many of the same features described above with references to the other cover assemblies 44, 144, 244, 344, 444, 544, 644 and is again configured to generally be a collapsible annual ring. The example collapsible annular ring 726 can include a continuous inner ring 764 and an outer ring 766 positioned concentrically about the inner ring 764. Ribs 768 extend between and couple the rings 764, 766 to one another. Tabs 758 extend radially inward from the inner ring 764, and can be positioned between partially annular segments 754 formed in the cover 724. Fingers 762 extend downwardly away from the tabs 758 to snap into place within the slots 760 formed through the base section 744 of the cover 724. The outer ring 766 includes discontinuities 770 in the form of slots, as discussed above with reference to the collapsible annular ring 90. In some embodiments, projections 772 extend outwardly away from the outer ring 766 to help deform or collapse the crumple zone in the collapsible annular ring 726 that is created by the discontinuities 770 formed in the outer ring 766, as explained above.

Using the fully self-contained drain assemblies 20, 700 described above, a floor drain or cleanout can be quickly and easily installed (i.e., placed into fluid communication with a conduit) into a concrete floor or wall. Although the cover assembly has been described as having an example annular ring assembly and a generally cylindrical structure, the concept of movable cover assemblies can be applied to linear drains and other floor or wall fixtures as well. Multicomponent cover assemblies having a cover part and a movable part can be designed to operate in a manner similar to the cover assemblies described above. Again, as understood by one skilled in the art given the benefit of this disclosure, the movable component can be configured to, for instance, collapse, transform, deform, bow, bend, flex, shear, or fracture away from (e.g., tangentially, inwardly, or radially inwardly) a material (e.g., finished concrete) to aid in the removal of the cover assembly. For instance, the movable component can be configured to include crumple zones that are generally weakened and can move inwardly, for instance, by deforming, bowing, bending, flexing, shearing, and/or fracturing when they are subjected to forces caused by moving the component relative to poured concrete. Using such structures, post-pour fixture adjustability that may not otherwise exist is preserved. Similar covers can also be useful in the installation of fire stops and nearly any other fixture type into concrete walls and floors.

Referring now to FIGS. 28-31B, a linear drain assembly 800 according to the disclosure is provided. The linear drain assembly 800 can be a trench drain having a channel-shaped body 802, for example. Mounting flanges 804 can be formed atop the body 802, which can receive a cover assembly 806. The cover assembly 806 can include a cover 808 and a movable component—such as structures 810—that can be removably received on the cover 808 and the body 802 to help protect the channel-shaped body 802 from concrete and other debris during installation of the drain assembly 800 into a concrete surface, for example.

Looking specifically at FIGS. 29A-31B, the structure of the cover assembly 806 and the interplay between the cover 808 and the movable component in the form of example collapsible structures 810 is shown. The cover 808 includes a generally flat, rectangular upper surface 812. Legs 814 extend downwardly (e.g., approximately perpendicularly) away from the upper surface 812 toward mounting feet 816. The mounting feet 816 can extend away from the legs 814 approximately parallel to the upper surface 812, for example. Braces 817 can extend between the mounting feet 816 and the legs 814 to support the mounting feet 816 when the cover assembly 806 is removed from the body 802 after the surrounding floor has been set.

Figure 30A:
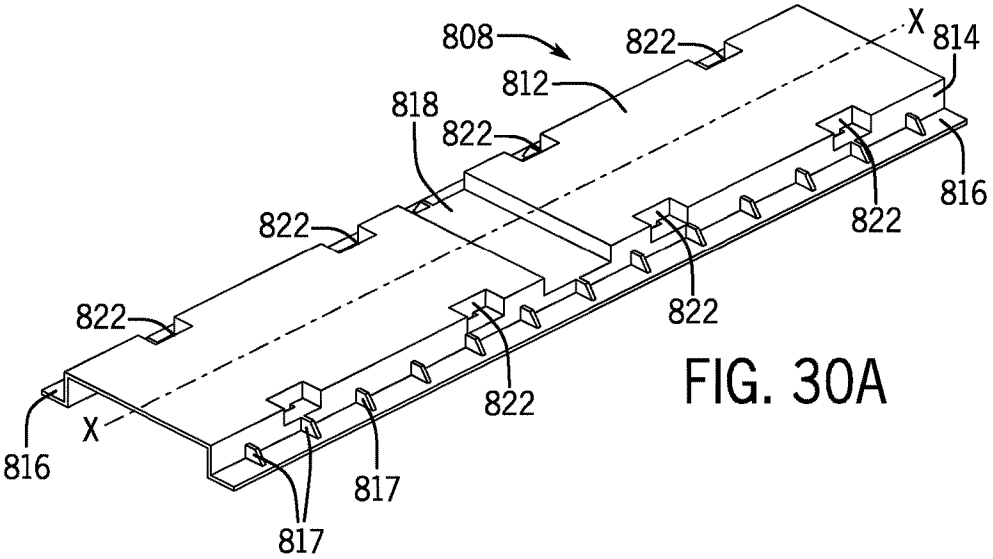
FIG. 30A is a top isometric view of a cover that is present in the cover assembly of FIG. 29A.
Figure 30C:
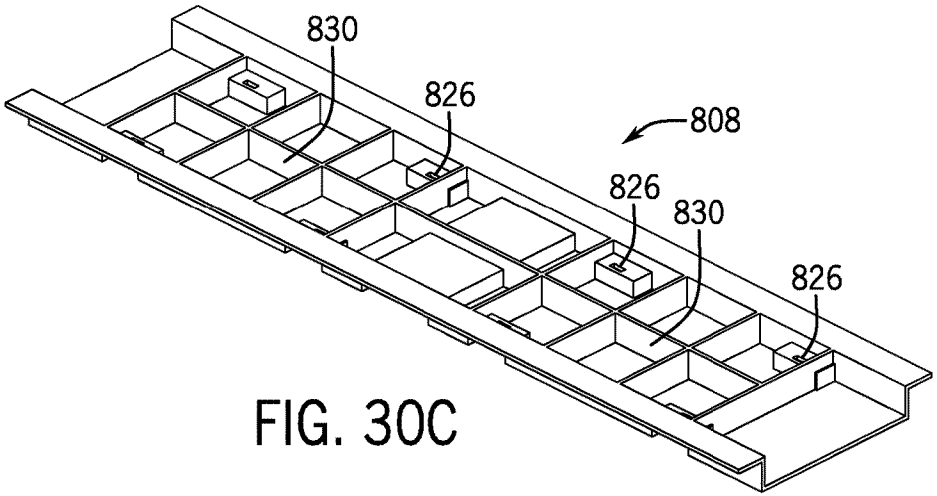
FIG. 30C is a bottom isometric view of the cover of FIG. 30A.
Figure 30B:
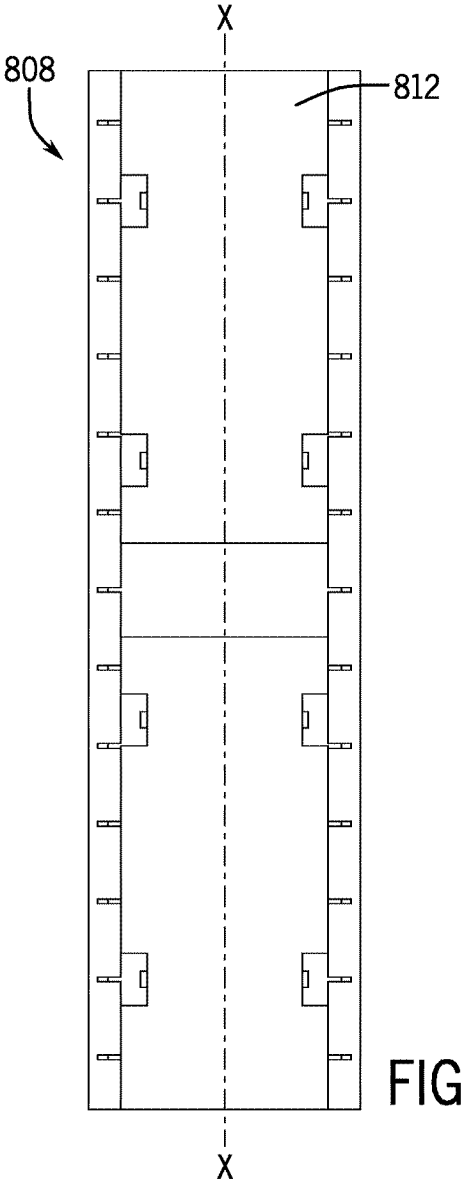
FIG. 30B is a top view of the cover of FIG. 30A.

In some embodiments, a channel 818 is formed through the upper surface 812 and extends generally perpendicular to a longitudinal axis X-X of the cover 808 (shown as a dash-dot-dash line in FIGS. 30A and 30B). When the collapsible structures 810 are coupled to the cover 808, a lifting arm 820 of the collapsible structure 810 can extend inwardly into the channel 818. Box-shaped notches 822 can be formed through the upper surface 812 as well, which can receive tabs 824 formed in and extending inwardly away from the collapsible structure 810. The box-shaped notches 822 can include slots 826 that can receive fingers 828 formed on the tabs 824 of the collapsible structure 810. As shown in FIG. 30C, the underside of the cover 808 can include a plurality of reinforcing walls 830 extending beneath the upper surface 812.

Figure 31A:
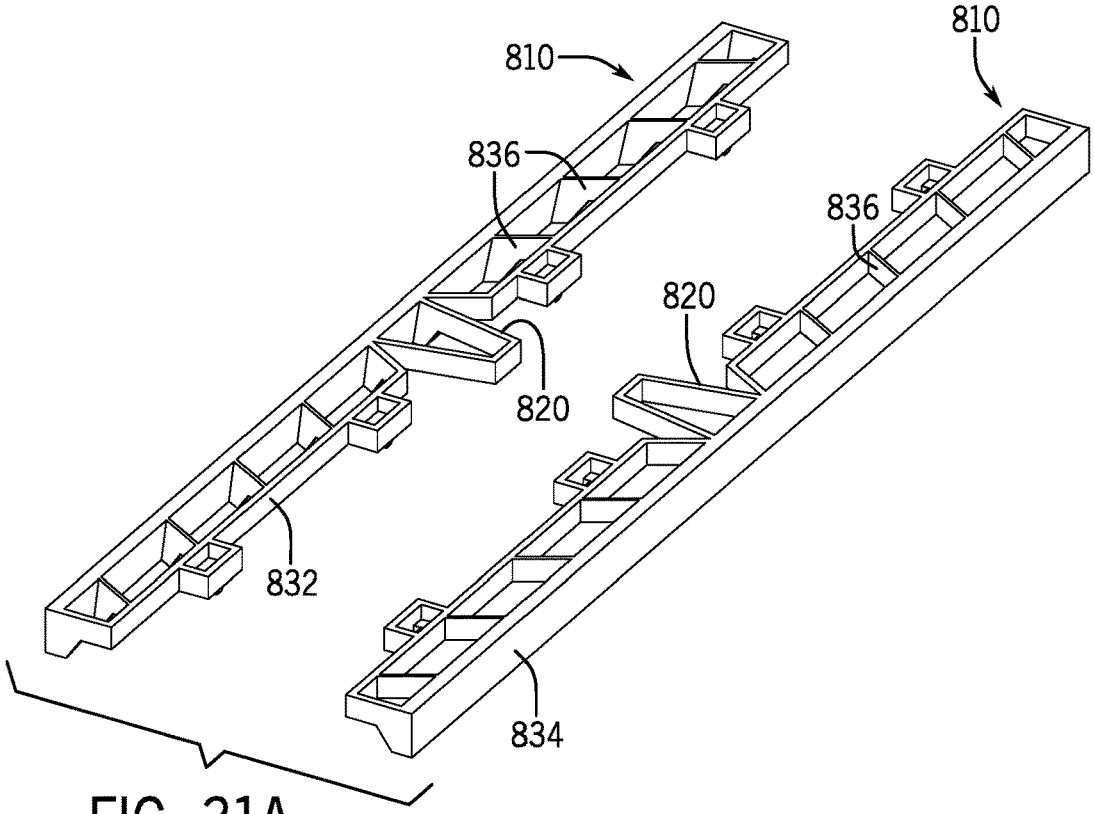
FIG. 31A is a top isometric view of movable component that can be present in the cover assembly of FIG. 29A.
Figure 31B:
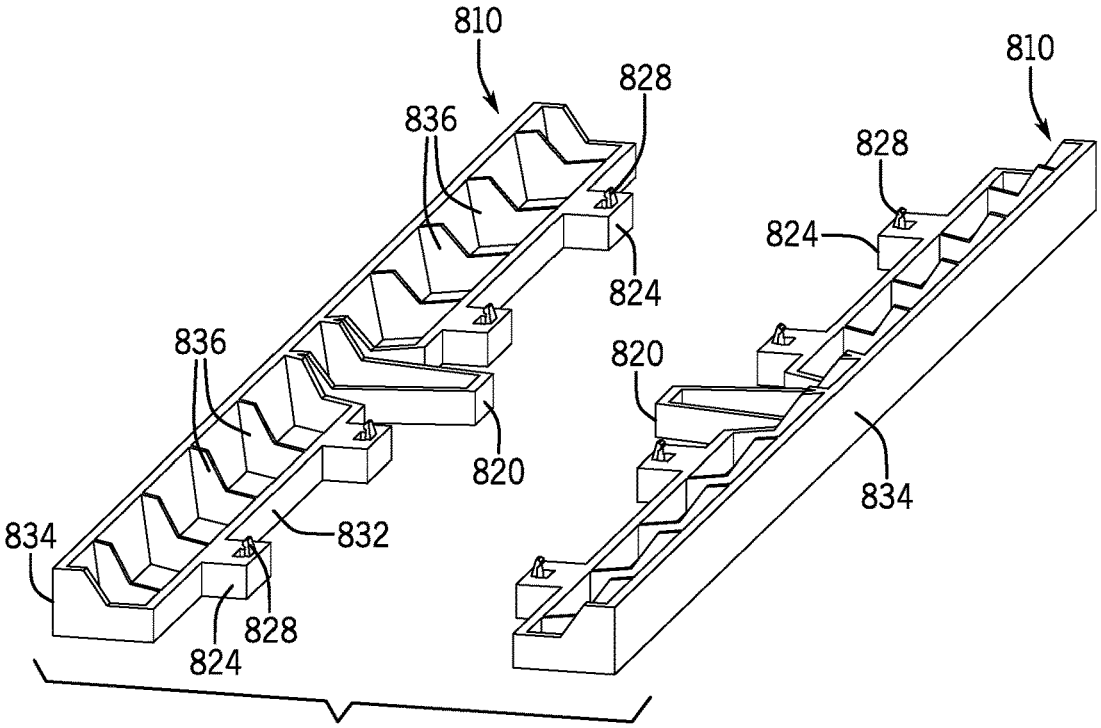
FIG. 31B is a bottom isometric view of the movable component of FIG. 31A.

Looking specifically at FIGS. 31A and 31B, the example collapsible structures 810 are shown. The collapsible structures 810 can include an inner wall 832 and an outer wall 834 separated by and coupled to ribs 836. The ribs 836 can have a generally L-shape, for example, as the outer wall 834 may be defined by a height that is larger than a height of the inner wall 832. In some embodiments, the ribs 836 angle outwardly away from the lifting arm 20 as the ribs extend from the outer wall 834 to the inner wall 832. Tabs 824 extend away from the inner wall 832, and can have a rectangular box-like shape. The tabs 824 can each include a finger 828 extending away from the tab 824, which can be snap-fit into the slots 826 formed in the cover 808. A lifting arm 820 can extend inwardly away from the outer wall 834 beyond the inner wall 832.

During installation of the linear drain assembly 800, the body 802 of the drain can be positioned at its desired, finished location. The cover assembly 806 can be placed upon the mounting flanges 804, so that the cover assembly 806 extends across the drain body 802. The mounting feet 816 can rest upon the mounting flanges 804. The outer wall 834 of the collapsible structure 810 extends outwardly beyond the mounting feet 816 of the cover 808. The lifting arms 820 of the collapsible structures 810 extend inwardly into the channel 818, and the tabs 824 extend into and are coupled to the notches 822 of the cover 808 by the fingers 828 snapped into the slots 826. The upper surface 812 of the cover 808 can extend approximately coplanar with upper surfaces 838 of the collapsible structures 810.

Once positioned properly, concrete, asphalt, or other materials can be poured around the drain assembly 800 to secure it into place. Once the poured material has become less compliant around the drain assembly 800, the cover assembly 806 can be removed. The lifting arms 820 can be squeezed toward one another in the channel 818 using pliers or an adjustable wrench, for example. Pulling the lifting arms 820 inward causes the outer wall 834 to buckle inwardly away from the poured and hardened material adjacent the outer wall 834, which loosens the collapsible structures 810 from the hardened material. With the collapsible structures 810 free from the hardened material, the cover assembly 806 can be lifted off of the mounting flanges 804 entirely, to expose the drain body 802 below.

Figure 32:
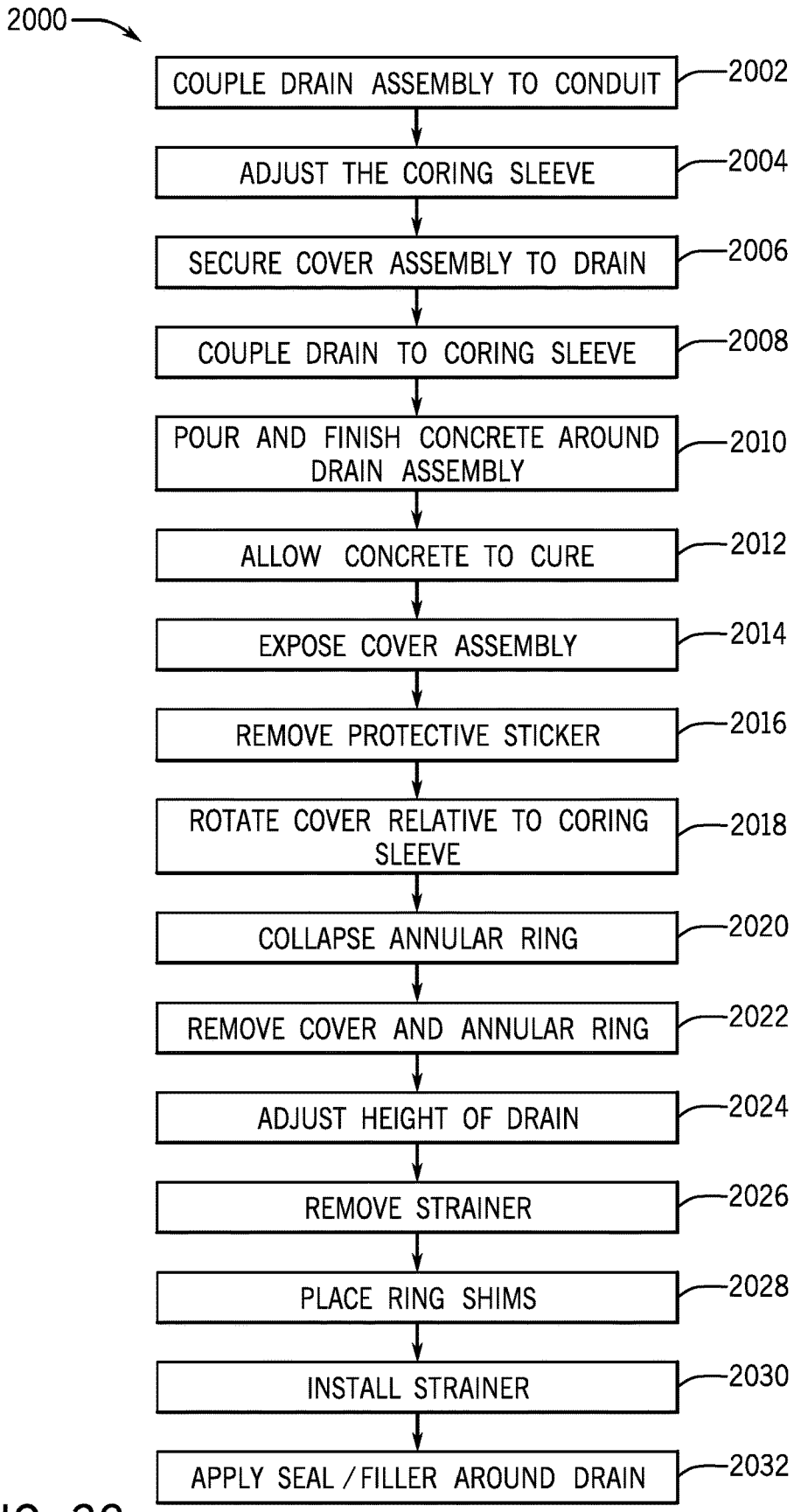
FIG. 32 is a process diagram describing another method for installing the drain assembly of FIG. 1.
Figure 33:
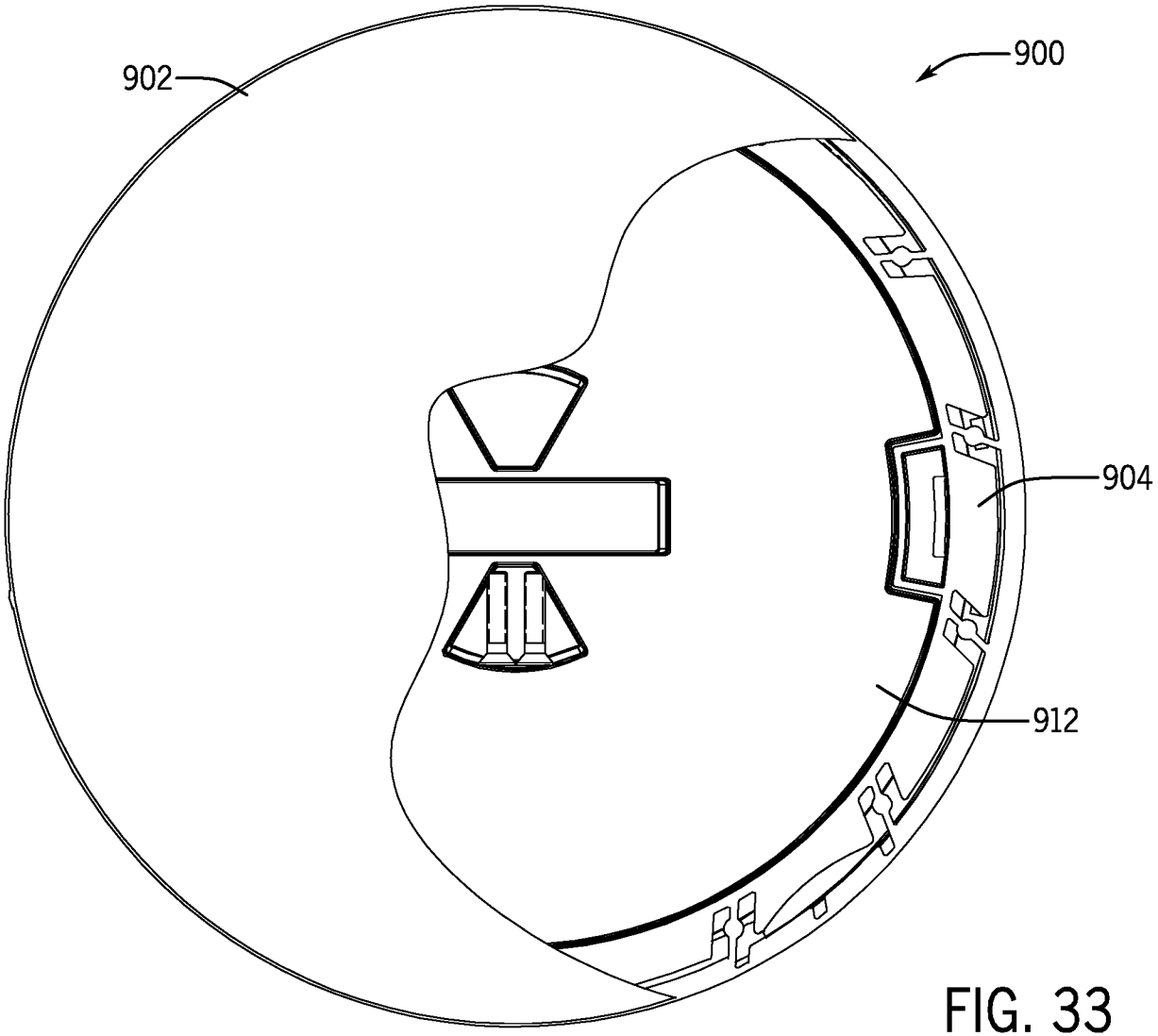
FIG. 33 is a top plan view of another cover assembly according to embodiments of the disclosure.

Turning now to FIG. 32, an alternative method 2000 of installing the example drain assembly 20 into, for instance, a concrete floor is described. At block 2002, the drain assembly 20 is coupled to a conduit C, as shown in FIG. 15B. The drain assembly 20 can be coupled to the conduit C in a variety of ways, including through the use of an adaptor (not shown) or a drain body (not shown). The coring sleeve 22 of the drain assembly 20 can be threaded into or otherwise coupled to the conduit C (e.g., welded) to place the internal bore 54 of the coring sleeve 22 into fluid communication with the conduit C.

At block 2004, the coring sleeve 22 is adjusted axially relative to the conduit C. For example, the external threads 56 on the coring sleeve stem 24 allow the coring sleeve 22 to be adjusted axially relative to the conduit C to a desired position relative to an intended finished height of the poured concrete surface.

At block 2006, the cover assembly 44 can be secured to the drain 28 via engagement between the hook ledges 86 spaced about the drain head 32 and the hooks 92 on the cover 88.

At block 2008, the drain 28 and associated cover assembly 44 are coupled to the coring sleeve 22, such as by threaded engagement between the threaded drain stem 30 and the interior threads 34 of the coring sleeve.

At block 2010, concrete is poured and finished around the drain assembly 20 to secure the drain assembly 20 within the concrete. Concrete can be poured and finished to form a surface approximately level with the cover assembly 44, as shown in FIG. 15B.

At block 2012, the concrete is allowed to cure.

At block 2014, after the concrete has hardened, the cover assembly 44 can be exposed by removing any concrete that has hardened over the cover 88.

At block 2016, the protective sticker is removed to expose the cover assembly 44.

At block 2018, the cover 88 is rotated relative to the secured coring sleeve 22. For example, a torque is applied to the cover 88 at recesses 114, 116 formed within the raised section 96 of the cover 88.

At block 2020, the example annular ring 90 optionally rotates with the cover 88 and moves by collapsing/deforming radially inward to establish a space between the collapsible annular ring 90 and the adjacent concrete material.

At block 2022, the cover 88 and the collapsible annular ring 90 are removed from the drain 28 by spacing the drain 28 from the coring sleeve 22 a sufficient amount to allow the hooks 92 on the cover 88 to flex away from the hook ledges 86 about the drain head 32.

At block 2024, the drain 28 is rotated relative to the coring sleeve 22 to adjust a height of the drain 28 to a position near the finished surface, which may be the concrete surface or an additional flooring material (e.g., tile) placed on the concrete.

At block 2026, the strainer 36 can be optionally removed from the drain 28.

At block 2028, the ring shims 46 can be placed beneath the strainer 36 to adjust the plane of the strainer 36 into alignment with the finished surface.

At block 2030, the strainer 36, if removed, is reinstalled to the drain 28.

At block 2032, a seal or filler can be injected around the drain 28 to establish a seal between the drain 28 and the finished concrete surface and between the threaded drain stem 30 and the interior threads 34 of the coring sleeve.

Referring now to FIGS. 33-41, another example cover assembly 900 is shown, including a top protective membrane 902, an annular ring 904, one or more shims 906, and/or the cover 908 and shares many features described in regards to any of the cover assemblies 44, 144, 244, 344, 444, 544, 644, 722, 806 described herein. The cover 908 may be of a generally cylindrical shape and has a base section 910 and a raised section 912 extending away from the base section 910. One or more hooks 914 extend downwardly away from the base section 910. The one or more hooks 914 can engage and releasably couple to the hook ledges 86 formed on the underside 80 of the drain head 32 (shown in FIG. 4B). The example movable component comprises a collapsible annular ring 904 that may be disposed around a central segment 916 of the cover 908. However, as understood by one skilled in the art given the benefit of this disclosure, the movable component (in this or any other general embodiment) can be configured to, for instance, collapse, transform, deform, bow, bend, flex, shear, or fracture away from (e.g., tangentially, inwardly, or radially inwardly) a material (e.g., finished concrete) to aid in the removal of the cover assembly. The annular ring 904 can have many of the same features described above with references to the other cover assemblies 44, 144, 244, 344, 444, 544, 644, 722, 806. The shims 906 may have a chamfered profile and define one or more voids 918 therein. As discussed, the shims 906 can be positioned to adjust the relative orientation of components during installation.

Figure 34:
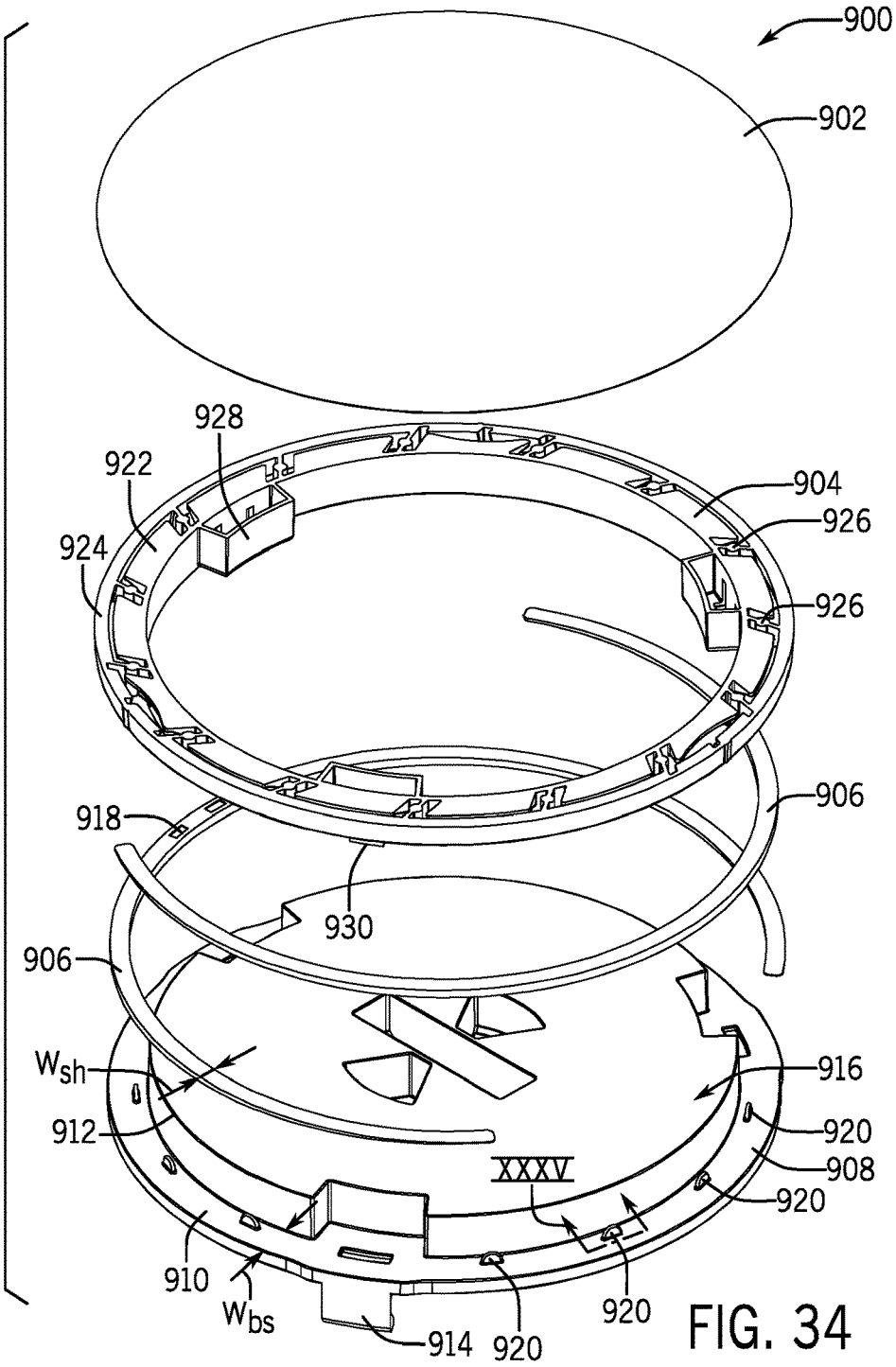
FIG. 34 is an exploded isometric view of the cover assembly of FIG. 33.
Figure 35:
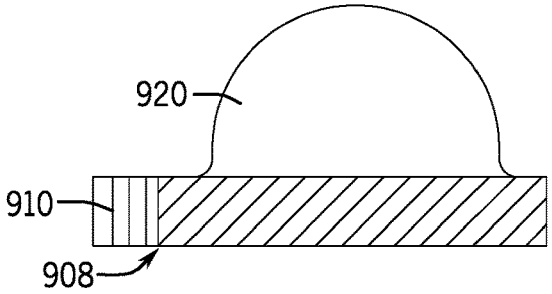
FIG. 35 is a cross-sectional view of a protrusion extending from a cover of the cover assembly taken along the line XXXV-XXXV of FIG. 34.

With reference to FIGS. 34 and 35, in some examples, the cover 908 may include a plurality of protrusions 920 extending upwardly from the base section 910 of the cover 908. The protrusions 920 may be configured in a semi-circular shape, as exemplarily illustrated in FIG. 35. In the assembled position, the protrusions 920 may be disposed between the shims 906 and the raised central segment 916 of the cover 908, and may assist in maintaining the shims 906 in a predefined location. Accordingly, a width wbs of the base section 910 of the cover 908 is greater than a width Wsh of the shims 906 in some instances. In some examples, the protrusions 920 may be integrally formed with the cover 908 or later attached thereto. Moreover, the cover 908 may have any number of protrusions 920 (e.g., one or more) without departing from the scope of the present disclosure.

Referring to FIGS. 34-41, the example collapsible annular ring 904 can include a continuous inner ring 922 and an outer ring 924 positioned concentrically about the inner ring 922. Ribs 926 extend between and couple the rings 922, 924 to one another. Tabs 928 extend radially inward from the inner ring 922. Fingers 930 extend downwardly away from the tabs 928 to snap into place within the slots formed through the base section 910 of the cover 908.

Referring to FIGS. 36-39, the ribs 926 extending between the inner ring 922 and the outer ring 924 may define a pair of peripheral portions 932, 934 separated by an intermediate portion 936. In some examples, the intermediate portion 936 may have a width that is larger than a width of at least one of the peripheral portions 932, 934. However, it will be appreciated that the peripheral portions 932, 934 may have a width that is equal to or larger than the intermediate portion 936 without departing from the scope of the present disclosure. Moreover, in some instances, some of the ribs 926 may incorporate an intermediate portion 936 that is varied in width and/or geometry while other ribs 926 may have a consistent width and/or geometry without departing from the teachings provided herein. In one form, the intermediate portion 936 is sized to facilitate manufacturing, such as providing a surface suitable for engagement by ejector pins when a molding process is implemented.

As provided herein, the outer ring 924 may define one or more discontinuities 938, as discussed above with reference to the ring 90. In some implementations, various portions of the annular ring 904 define three discontinuities 938*a*, 938*b* between a pair of the ribs 926. In such instances, the first and second discontinuities 938*a* may be disposed proximately to the respective first and second ribs 926. A third discontinuity 938*b* may be defined between the first and second discontinuities along the outer ring 924. In some examples, each of the discontinuities 938*a*, 938*b* may be oriented in a common direction or offset from one another.

Figure 36:
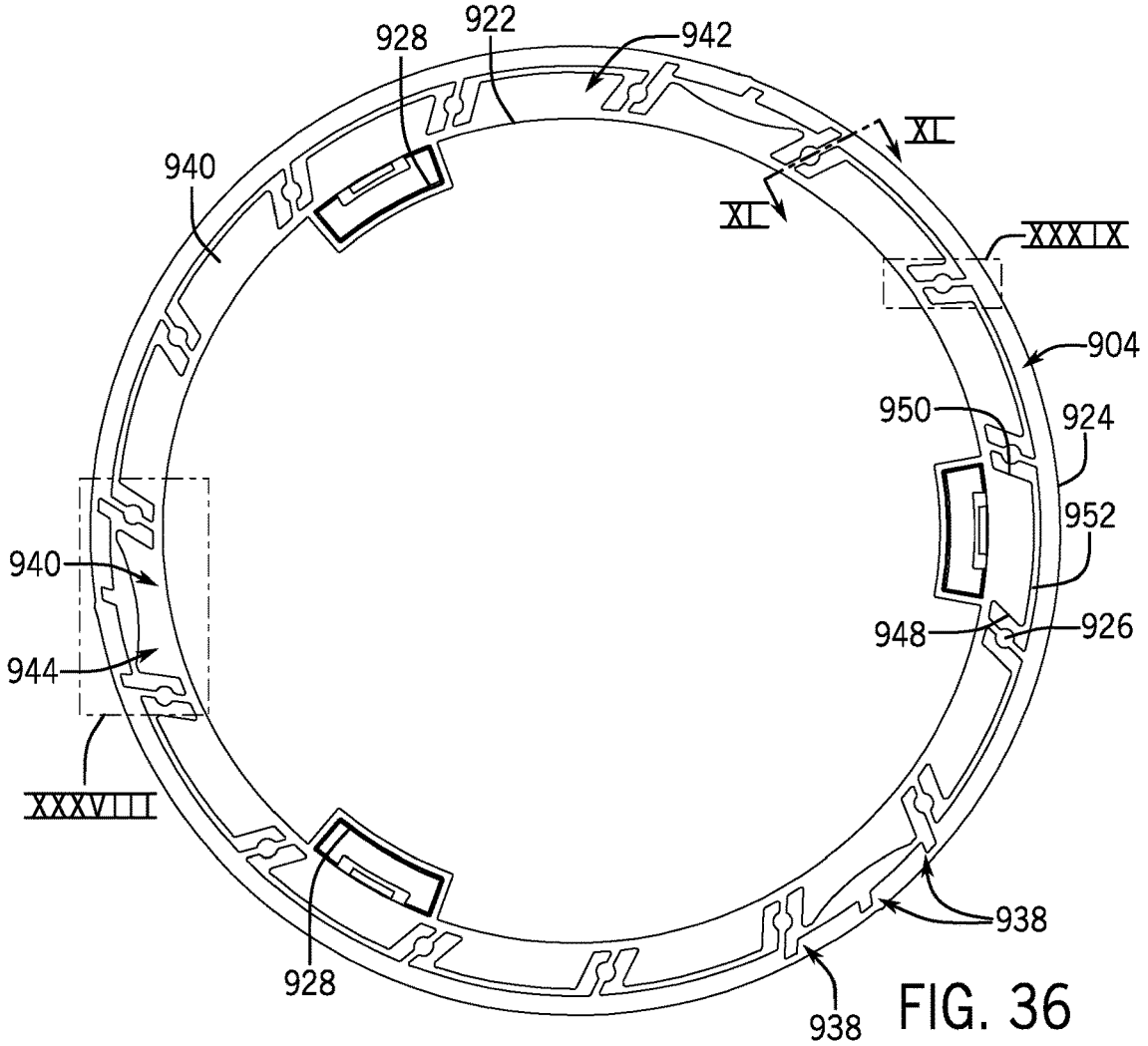
FIG. 36 is a top plan view of a ring that is present in the cover assembly of FIG. 33.
Figure 37:
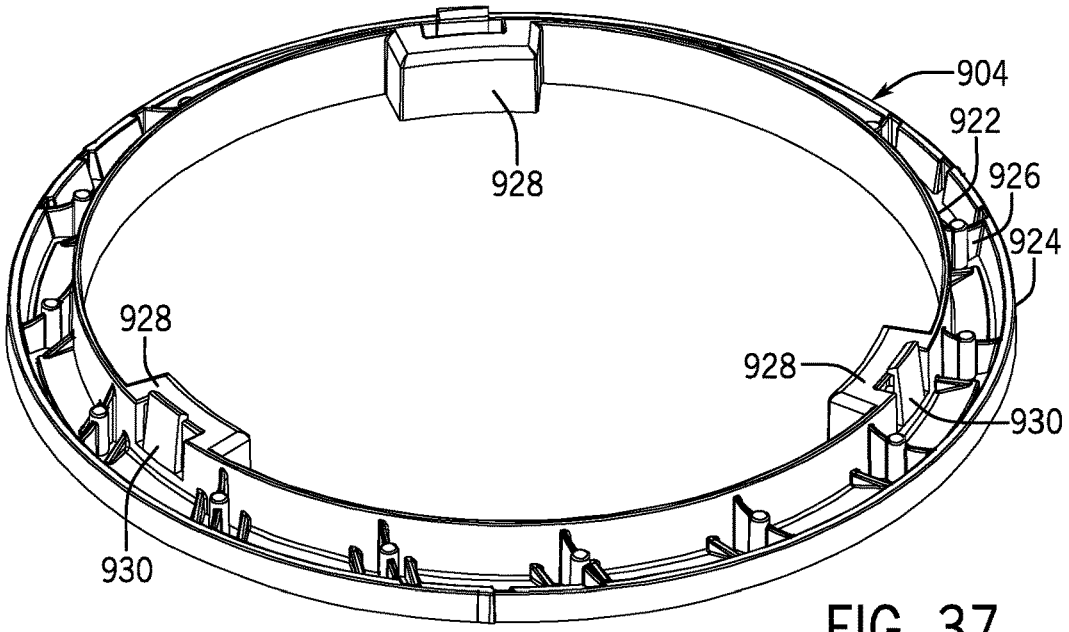
FIG. 37 is a bottom isometric view of a ring that is present in the cover assembly of FIG. 33.
Figure 38:
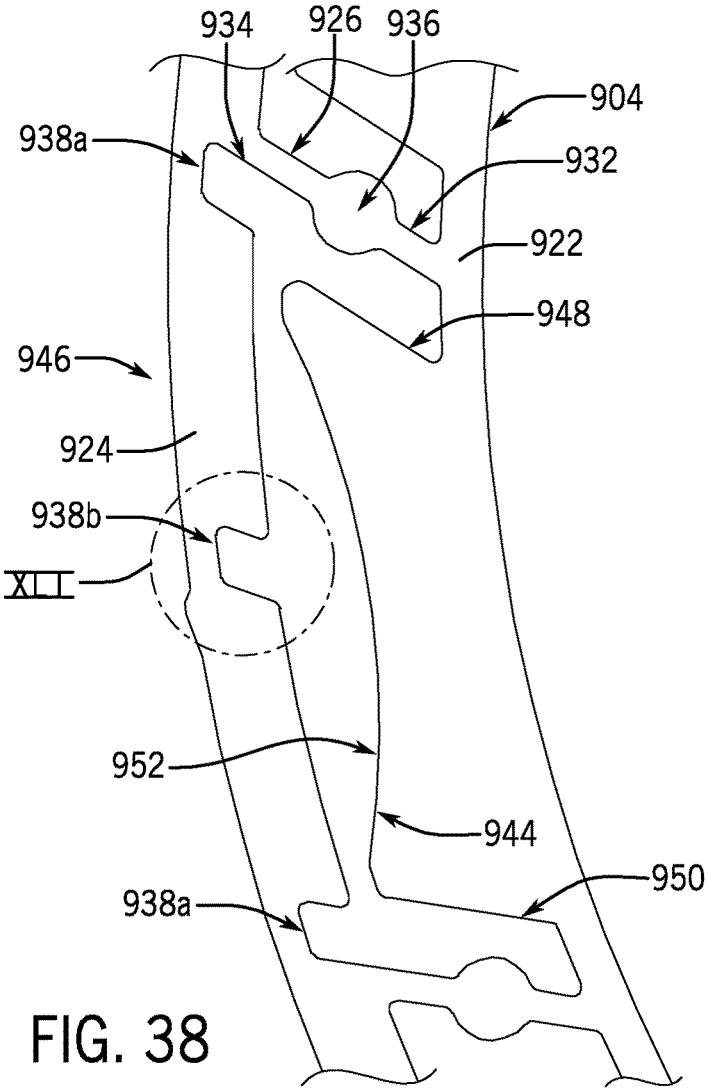
FIG. 38 is an enhanced view of area XXXVIII of FIG. 36 illustrating an exemplarily crumple zone of the ring according to some embodiments.
Figure 39:
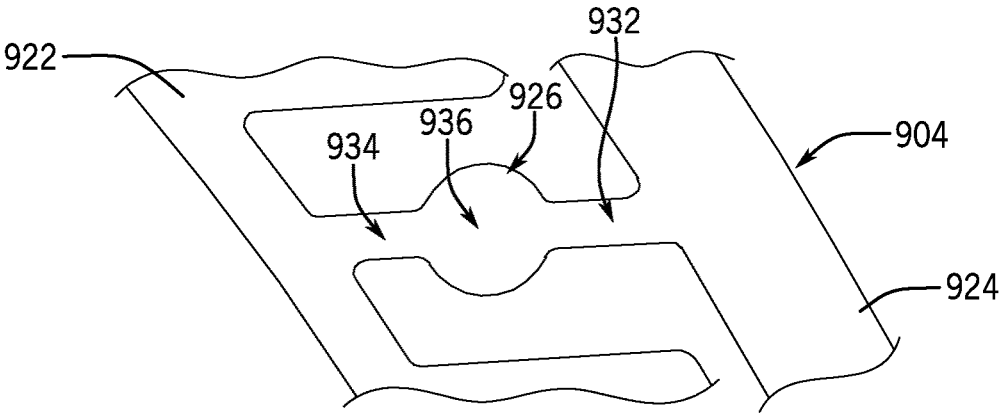
FIG. 39 is an enhanced view of area XXXIX of FIG. 36 illustrating an exemplarily rib positioned between an inner and an outer ring of the ring according to some embodiments.

With further reference to FIGS. 36-38, in some examples, support flanges 940 may be disposed about the perimeter of the inner ring 922 and may project in a manner of a cantilever from the inner ring 922 between two adjacently positioned ribs 926. A first set 942 of support flanges 940 may be disposed externally from the crumple zones 946 while a second set 944 of support flanges 940 may be disposed within the crumple zones 946. It will be appreciated, however, that the annular ring 904 may include any number (e.g., one or more) support flanges 940 and/or sets 942, 944 of support flanges 940 without departing from the teachings provided herein. Each of the first and second sets 942, 944 of support flanges 940 may extend from the inner ring 922 between respective pairs of ribs 926 and may be supported by the inner ring 922. In some instances, opposing sides 948, 950 of the first and second sets 942, 944 of support flanges 940 may extend radially outward of respective intermediate portions 936 of the ribs 926 disposed proximately to each of the opposing sides 948, 950. In some instances, an end portion 952 of the support flanges 940 may couple with each of the opposing sides 948, 950 and extend there between. In some examples, the end portion 952 of the first set 942 of support flanges 940 may define an arcuate surface that is oriented in a first direction while the second set 944 of support flanges 940 may define an arcuate surface that is oriented in an opposing or different direction. For example, the end portion 952 of the first set 942 of flanges 940 may be concentric with the outer ring 924 while the end portion 952 of the second set 944 of flanges 940 may have an axis that is disposed outwardly of the outer ring 924.

As provided herein, the top protective membrane 902 may be adhered, or otherwise coupled, with the cover assembly 900. The top protective membrane 902 can be removed from the cover assembly 900 through any fashion, including through the use of pliers or other tools that can be used to puncture the protective membrane 902, which then can be peeled away from the cover assembly 900 to expose the cover assembly 900. In some instances, the top protective membrane 902 may extend over at least a portion of the outer ring 924. Accordingly, in some cases, the top protective membrane 902 may be disposed over and possibly adhered to one or more of the support flanges 940, which may assist in preventing premature puncturing and/or degradation of the top protective membrane 902.

Figure 40:
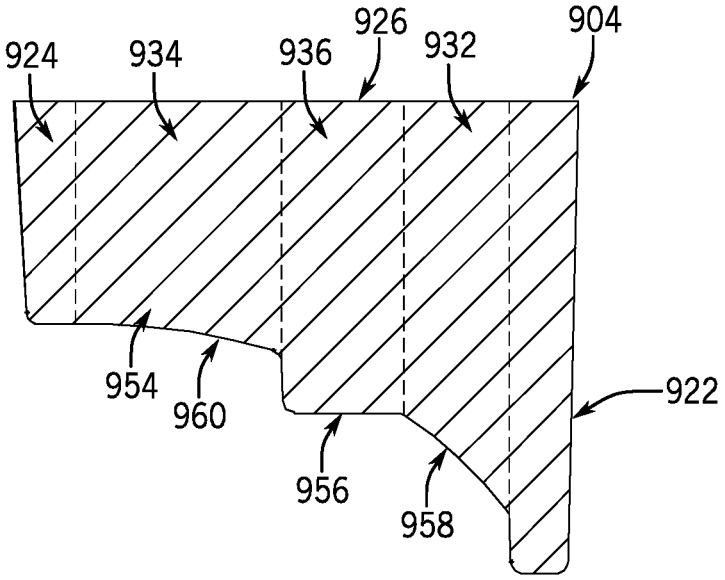
FIG. 40 is a cross-sectional view of the rib extending taken along the line XL-XL of FIG. 36.

Referring to FIG. 40, in some instances, the ribs 926 are defined by a body 954 that extends between the inner ring 922 and the outer ring 924. As provided herein, the body 954 may be integrally formed with the inner and/or outer rings 922, 924 and defines the peripheral and intermediate portions 932, 934, 936. In some instances, a notch 956 may be defined by the intermediate portion 936 of the body 954 and vertically aligned with the intermediate portion 936 of the ribs 926 while the peripheral portions 932, 934 may define and be vertically aligned with arcuate bottom surfaces 958, 960. In some instances, the annular ring 904 may be formed through a molding process. After forming of the annular ring 904 within a mold, an ejector pin may contact the intermediate portion 936 to assist in removing the collapsible annular ring 904 from the mold.

Figure 41:
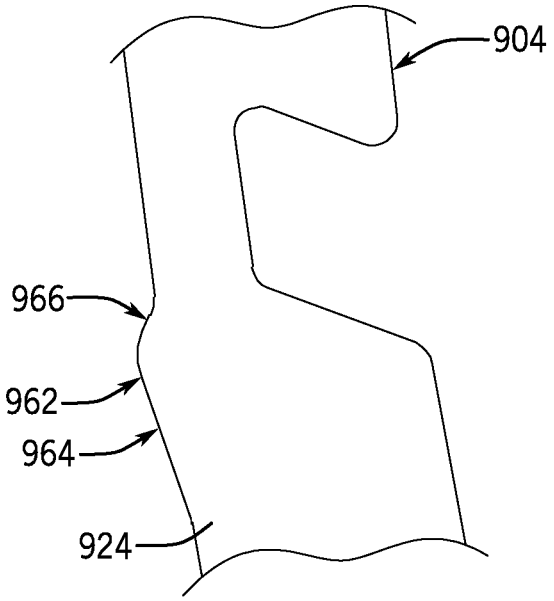
FIG. 41 is an enhanced view of area XLI of FIG. 38 illustrating an exemplarily projection extending radially outward from the outer ring according to some embodiments.
Figure 42:
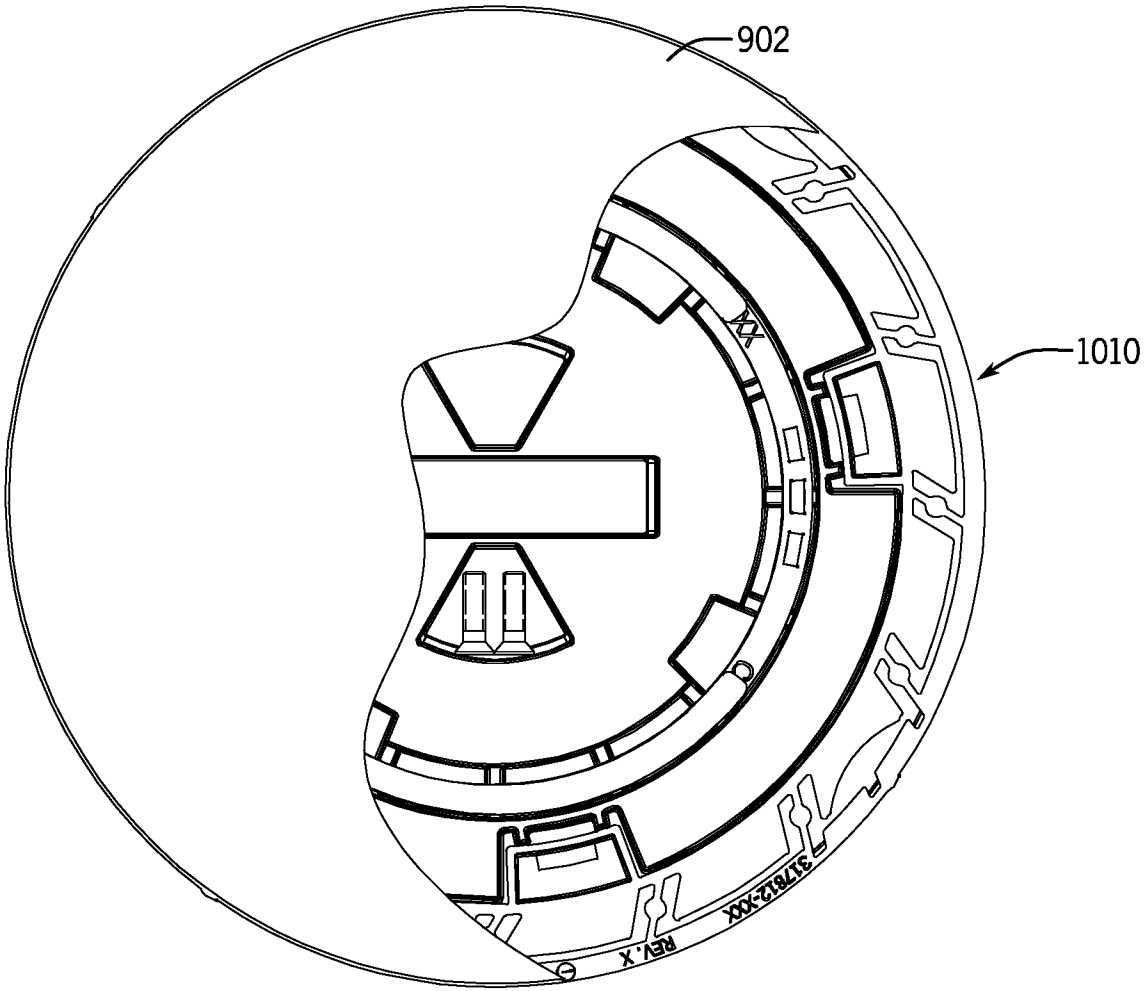
FIG. 42 is a top plan view of another cover assembly according to embodiments of the disclosure.

Referring to FIG. 41, as provided herein, projections 962 can extend radially outward from the outer ring 924 to assist in the collapsing of the crumple zone 946. As illustrated, the projections 962 may be offset from the discontinuities 938*a*, 938*b* about the perimeter of the outer ring 924. In some examples, the projections 962 may have a leading edge 964 having a first length and a trailing edge 966 having a second, differing length. It will be appreciated, however, that the two edges may be of the same length without departing from the teachings provided herein.

With specific reference to FIGS. 38 and 41, the example movable component, in the form of the ring 904, may define a variety of form factors consistent with the principles herein to, for example, enhance operation of the movable component as it is disengaged from an adjacent material. For instance, as viewed from the top, the example crumple zone discontinuities 938*a*, 398*b* may extend more than half the nominal radial thickness B of the outer ring 924, which in an example embodiment results in approximately 0.064 inch [1.61 mm] of material in the radial direction. The crumple zone form factor may also vary given application-specific requirements, such as the material properties of the ring 904 benefiting from more or less material being present at the discontinuity and/or the applied torque parameters for a particular configuration. In one example, the nominal radial thickness B of the outer ring 924 is approximately three times the thickness of the outer ring 924 at the discontinuity 938*a*, 938*b*. In general, the peak nominal radial thickness C of the projection 962 may be preferably less than the nominal radial thickness A of the ring 904, and may be equal to or less than the nominal radial thickness B of the outer ring 924. Moreover, the nominal radial thickness B of the outer ring 924 may be preferably about one-third or less than the nominal radial thickness A of the ring 904. In one example, the peak nominal radial thickness C of the projection 962 may be about 0.015 inch [0.38 mm] with the leading edge 964 angled at approximately ten degrees from a generally tangent line near the radially inner base of the projection 962. The projection 962 may be preferably configured to minimize the undesirable impacts (e.g., chips, cracks, scuffs, etc.) to the adjacent material (e.g., concrete) during operation of the movable component, while allowing a sufficient force to be imparted to move (e.g., collapse, transform, deform, bow, bend, flex, shear, or fracture) the component way from (e.g., tangentially, inwardly, or radially inwardly) the adjacent material. In one example, the projection may be sized to interact with adjacent concrete to impart a sufficient reactive force during rotation of the example annular ring to move an outer ring toward a central rotational axis of the ring and cover. For instance, the outer ring may include a crumple zone including a discontinuity configured to permit the outer ring to deform toward the central axis. Again, given the benefit of this disclosure, one skilled in the art will appreciate the various alternatives that are within the contemplated scope.

Referring now to FIGS. 42-51, the cover assembly 1010 is shown in additional detail. The cover assembly 1010 includes a cover 1012 and a movable component in the form of an example collapsible annular ring 1014 received around and removably coupled to the cover 1012, and shares any of the features with the cover assemblies 44, 144, 244, 344, 444, 544, 644, 722, 806, 900 described above. The cover 1012 may include a generally cylindrical shape and has a base section 1016 and a raised section 1018 extending away from the base section 1016. One or more hooks 1020 extend downwardly away from the base section 1016, where they can engage and releasably couple to the hook ledges 738 formed in the strainer support 716 (FIGS. 24 and 25).

As shown in FIG. 24, one or more positioning arms 750 can extend downward from the base section 1016 as well. The positioning arms 750 can be oriented to engage the rectangular walls 736 of the strainer support 716 (as shown in FIG. 24), and can be used to translate rotational force imparted on the cover assembly 1010 to the strainer support 716 and drain 710. Accordingly, when the cover assembly 1010 is rotated, the drain 710 rotates within the coring sleeve 702, which adjusts the vertical position of the strainer 718 relative to the coring sleeve 702.

The raised section 1018 of the cover 1012 can include several segments 1022, 1024. Similar to the covers 88, 146, 246, 346, 446, 546, 646, 722, 806, 908 described above, the raised section 1018 can have a generally cylindrical shape having recesses 114, 116 formed therein. A central segment 1022 can have a generally cylindrical shape, and can be surrounded by a plurality of partially annular segments 1024 spaced apart from and concentrically positioned about the central segment 1022. In some examples, braces 1026 extend between the central segment 1022 and the partially annular segments 1024. The partially annular segments 1024 can be spaced apart from one another, such that a tab 1028 formed on the collapsible annular ring 1014 can be received between two partially annular segments 1024. The partially annular segments 1024 can translate rotational force from the cover 1012 to the collapsible annular ring 1014 through engagement between the tabs 1028 and the partially annular segments 1024.

Figure 43:
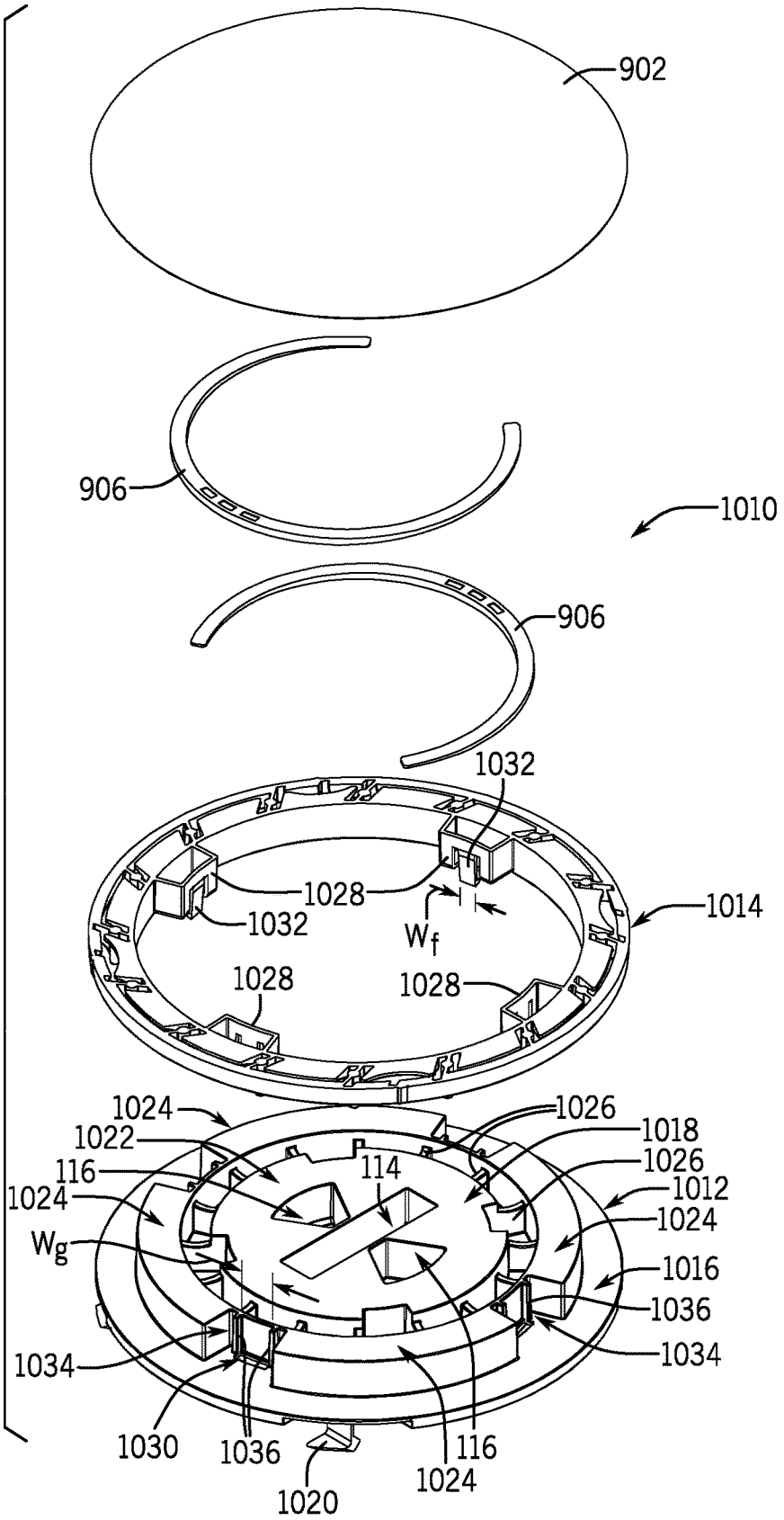
FIG. 43 is an exploded isometric view of the cover assembly of FIG. 42.
Figure 44:
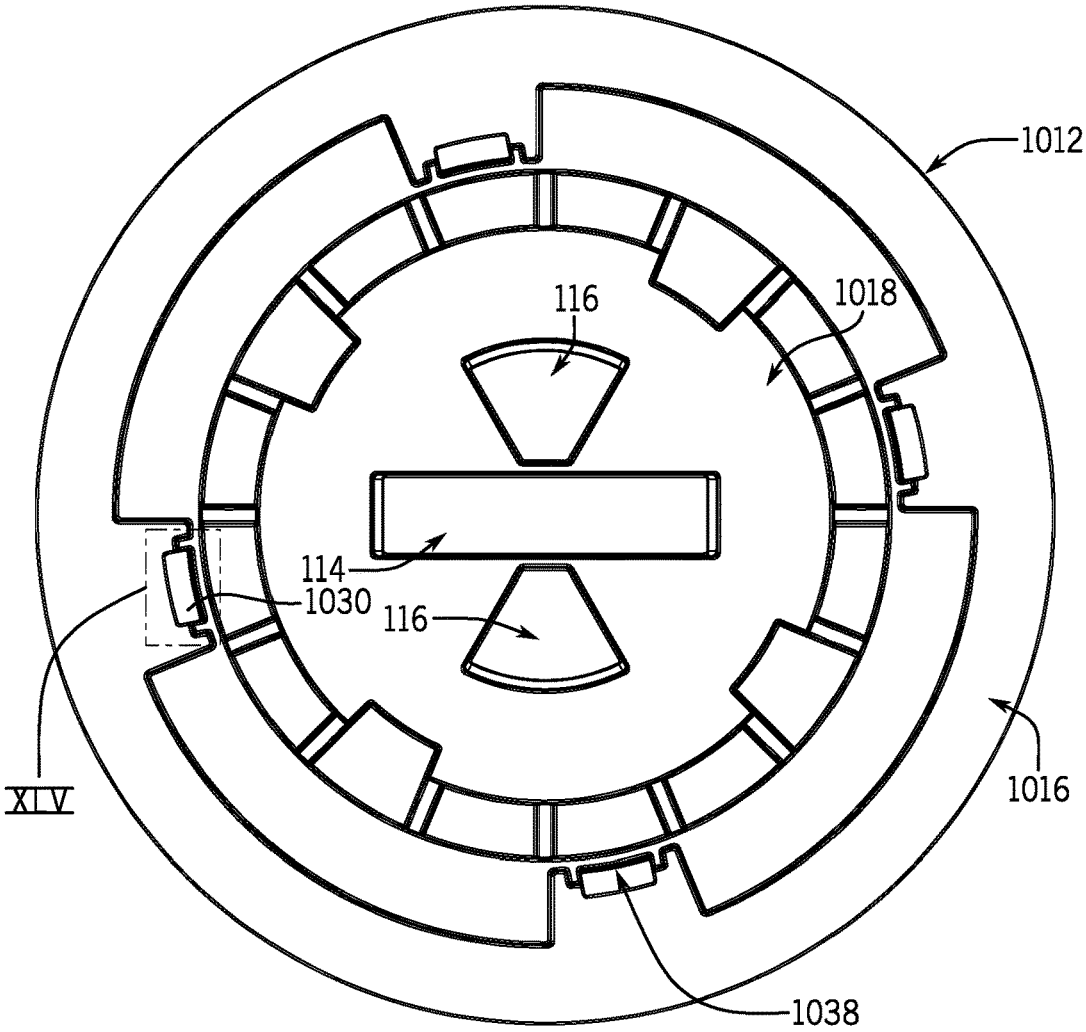
FIG. 44 is a top plan view of the cover of the cover assembly, according to some embodiments.
Figure 45:
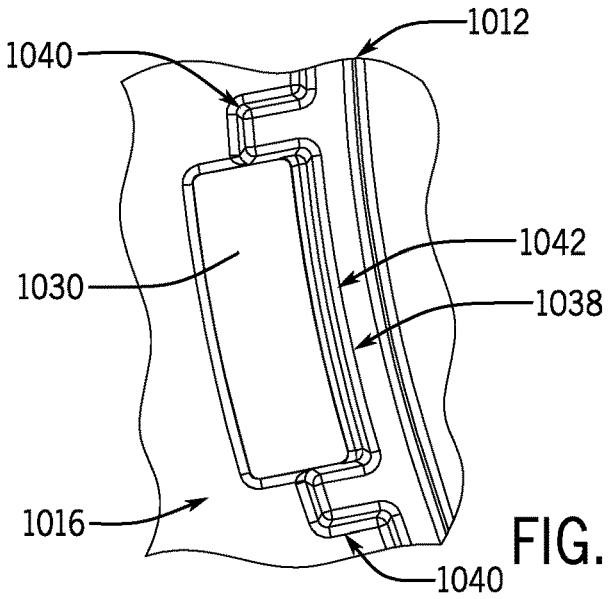
FIG. 45 is an enhanced view of area XLV of FIG. 44.
Figure 46:
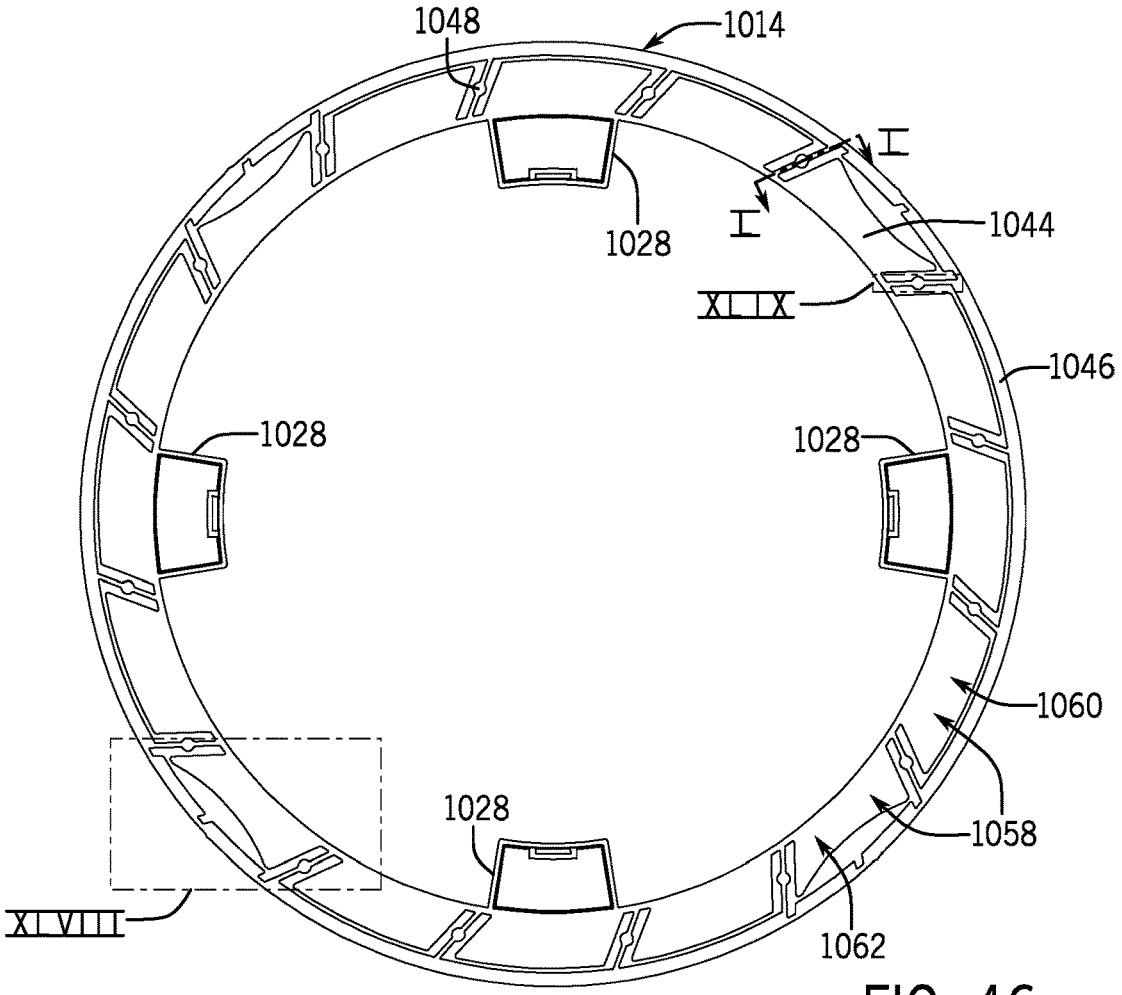
FIG. 46 is a top plan view of a ring that is present in the cover assembly of FIG. 42.

Referring to FIGS. 43 and 44, slots 1030 can be formed through the base section 1016 to receive fingers 1032 that removably couple the collapsible annular ring 1014 to the cover 1012. In some instances, the central segment 1022 of the cover 1012 may include locators 1034 that can interact with the fingers 1032 to align the fingers 1032 with the slots 1030 prior to insertion through the slots 1030. The locators 1034 may be configured as a pair of guides 1036 disposed outward from end portions of the slot 1030. The fingers 1032 may have a width wf that is less than a width wg between each set of guides 1036. Each finger 1032 may be disposed between the pair of guides 1036 to assist in directing the finger 1032 toward the slot 1030. It will be appreciated that the locators 1034 and the fingers 1032 may have any practicable geometry without departing from the scope of the present disclosure.

With further reference to FIG. 44, in some examples, a support structure 1038 can have respective side portions 1040 disposed partially along two opposing sides of the slot 1030 and an intermediate portion 1042 that couples with the two side portions 1040 on opposing end portions thereof. The support structure 1038 may be integrally formed with the cover 1012 and/or the locators 1034 and assist in maintaining the fingers 1032 within the slots 1030 when torque is placed on the cover 1012. In some examples, the cover 1012 may include the support structure 1038 without the locators 1034 without departing from the teachings provided herein.

Referring to FIGS. 46-50, the collapsible annular ring 1014 can have any of the same features described above with references to the other cover assemblies 44, 144, 244, 344, 444, 544, 644, 722, 806, 900. The collapsible annular ring 1014 can include a continuous inner ring 1044 and an outer ring 1046 positioned concentrically about the inner ring 1044. Ribs 1048 extend between and couple the rings 1044, 1046 to one another. Tabs 1028 extend radially inward from the inner ring 1044, and can be positioned between partially annular segments 1024 formed in the cover 1012. Fingers 1032 extend downwardly away from the tabs 1028 to snap into place within the slots 1030 formed through the base section 1016 of the cover 1012. In some instances, the tabs 1028 may also interact with the locators 1034 (FIG. 43), which may assist in alignment of the cover 1012 and the annular ring 1014.

Figure 47:
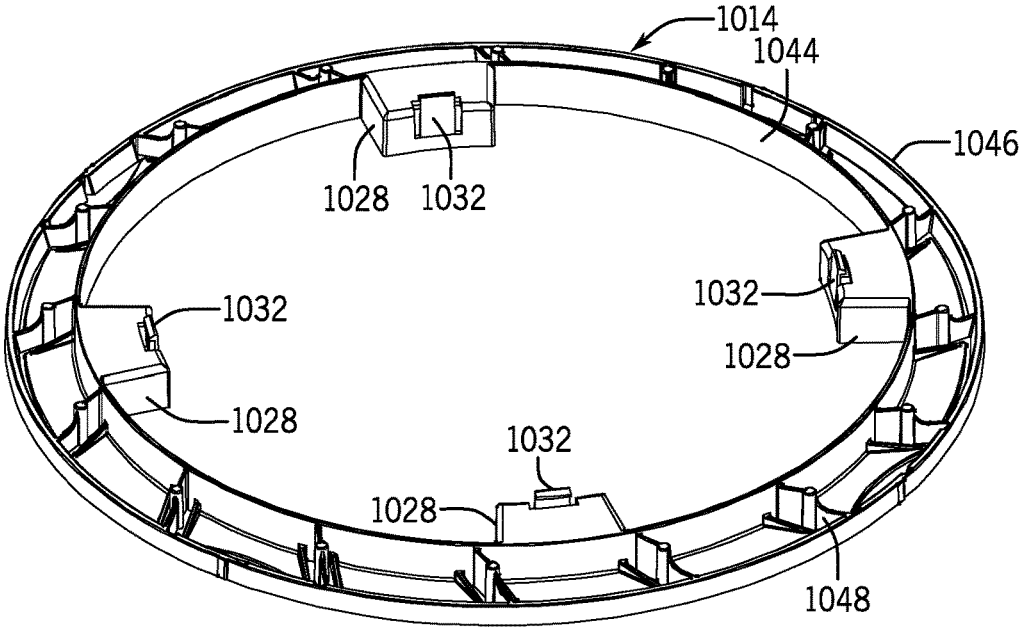
FIG. 47 is a bottom isometric view of a ring that is present in the cover assembly of FIG. 42.
Figure 48:
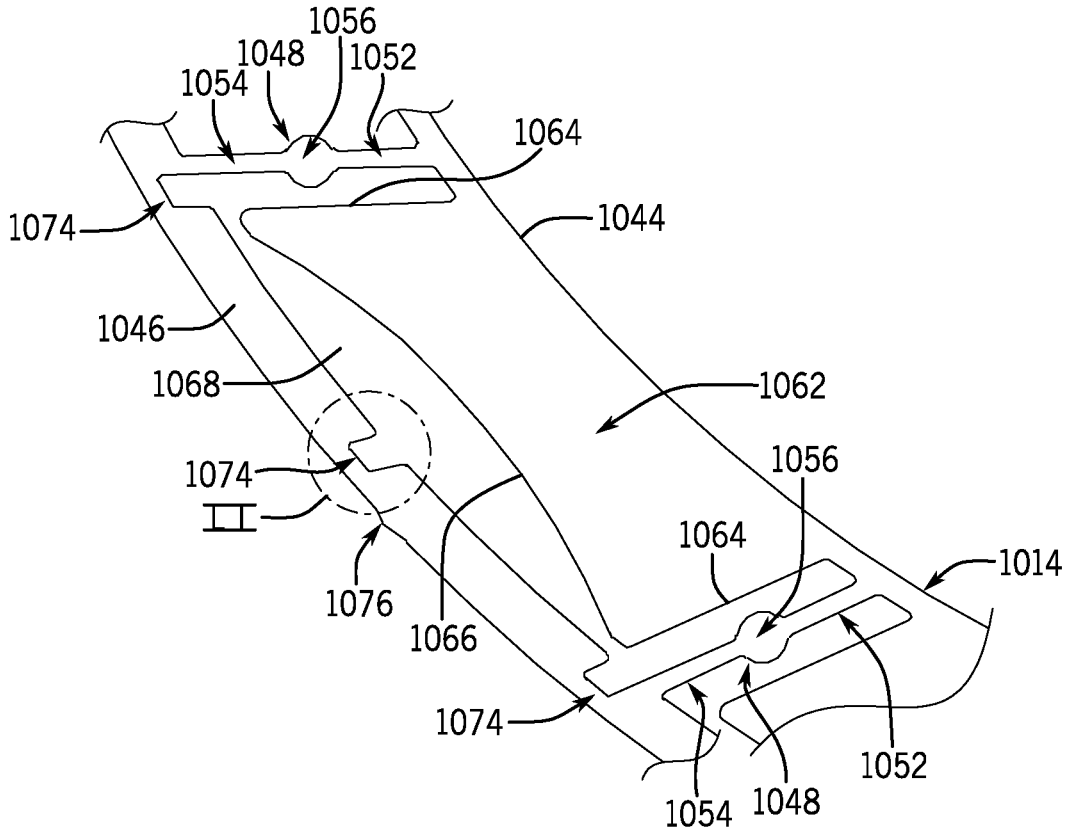
FIG. 48 is an enhanced view of area XLVIII of FIG. 46 illustrating an exemplarily crumple zone of the ring according to some embodiments.
Figure 49:
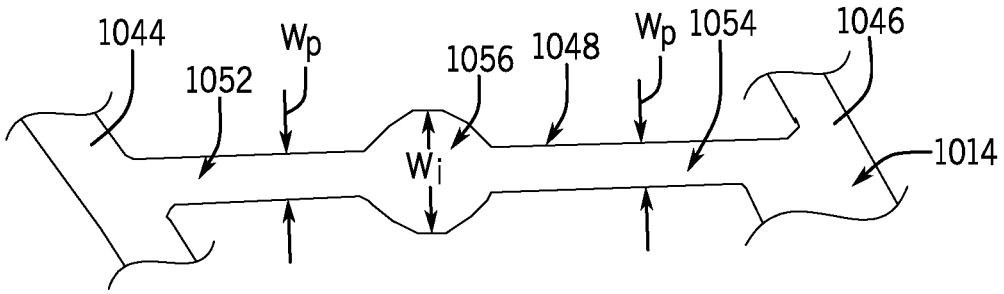
FIG. 49 is an enhanced view of area XLIX of FIG. 46 illustrating an exemplarily rib positioned between an inner and an outer ring of the ring according to some embodiments.

Referring to FIGS. 47-49, each of the ribs 1048 may define a pair of peripheral portions 1052, 1054 coupled by an intermediate portion 1056. In some examples, the intermediate portion 1056 may have a width wi that is larger than a width wp of the peripheral portions 1052, 1054. However, it will be appreciated that the peripheral portions 1052, 1054 may have a width wp that is equal to or larger than the width wi of the intermediate portion 1056 without departing from the scope of the present disclosure. Moreover, in some instances, some of the ribs 1048 may incorporate an intermediate portion 1056 that is varied in width and/or geometry while other ribs 1048 may have a consistent width and/or geometry without departing from the teachings provided herein.

Referring back to FIGS. 46-48, as provided herein, the support flanges 1058 may extend from the perimeter of the inner ring 1044 in any pattern between the ribs 1048. In some examples, first and second sets 1060, 1062 of support flanges 1058 may extend from the inner ring 1044 between the pair of ribs 1048. In some instances, opposing sides 1064 of the first and second sets 1060, 1062 of support flanges 1058 may extend radially outwardly of respective intermediate portions 1056 of the ribs 1048 disposed proximately to each of the opposing sides 1064. In some instances, an end portion 1066 of the support flanges 1058 may couple with each of the opposing sides 1064 and extend there between. In some examples, the end portion 1066 of the first set 1060 of support flanges 1058 may define an arcuate surface that is oriented in a first direction while the second set 1062 of support flanges 1058 may define an arcuate surface that is oriented in an opposing or different direction. For example, the end portion 1066 of the first set 1060 of flanges 1058 may be concentric with the outer ring 1046 while the end portion 1066 of the second set 1062 of flanges 1058 may have an axis that is disposed outwardly of the outer ring 1046. Further, the second set 1062 of flanges 1058 and the outer ring 1046 may define an opening 1068 of varied width there between, which may be within a defined crumple zone.

As provided herein, the top protective membrane 902 may be adhered, or otherwise coupled, with the cover assembly 1010. The top protective membrane 902 can be removed from the cover assembly 1010 through any fashion, including through the use of pliers or other tools that can be used to puncture the protective membrane 902, which then can be peeled away from the cover assembly 1010 to expose the cover assembly 1010. In some instances, the top protective membrane 902 may extend over at least a portion of the outer ring 1046. Accordingly, in some cases, the top protective membrane 902 may be disposed over and possibly adhered to one or more of the support flanges 1058, which may assist in preventing premature puncturing and/or degradation of the top protective membrane 902.

Figure 50:
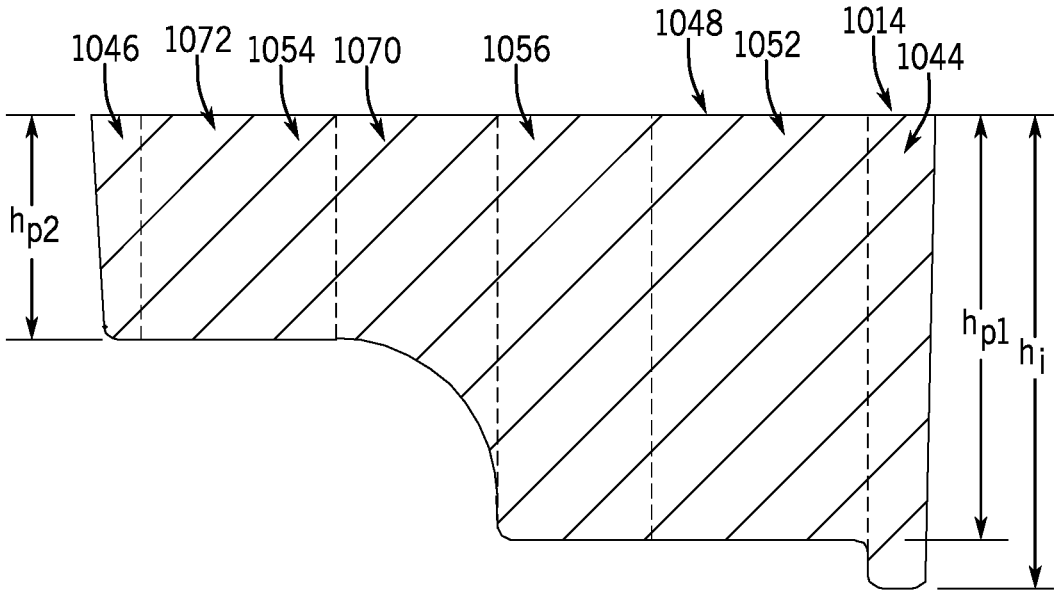
FIG. 50 is a cross-sectional view of the rib extending taken along the line L-L of FIG. 46.
Figure 51:
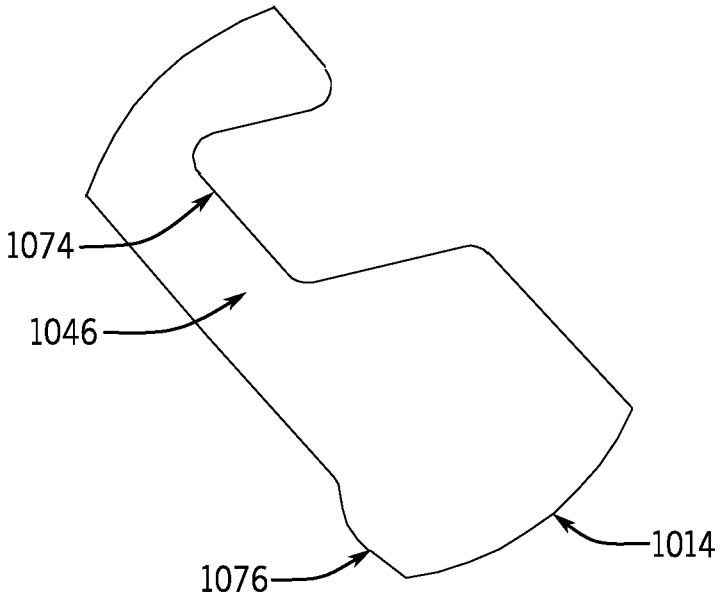
FIG. 51 is an enhanced view of area LI of FIG. 48 illustrating an exemplarily projection extending radially outward from the outer ring according to some embodiments.

Referring to FIG. 50, in some instances, the inner ring 1044 has a first height hi. The body of the rib 1048 may define a first peripheral height hp1 within a first peripheral portion 1052 and through the intermediate portion 1056. The second, outer peripheral portion 1054 may define a radiused portion 1070 and a linear portion 1072 of a third height hp2. The outer ring 1046 may include a vertical taper and be of a similar (or a different height) height hp2 as the linear portion 1072 of the outer peripheral portion 1054 of the rib 1048. It will be appreciated, however, that any of the heights and/or variances in heights defined herein may be varied without departing from the teachings provided herein.

Referring to FIGS. 48-51, as provided herein, the outer ring 1046 includes discontinuities 1074 in the form of slots, as discussed above with reference to the ring 90. The example projections 1076 extend outwardly away from the outer ring 1046 to help deform or collapse the crumple zone in the example collapsible annular ring 1014 that is created by the discontinuities 1074 formed in the outer ring 1046, as explained above. The projections 1076 may be offset, as exemplarily illustrated in FIGS. 48 and 51, or aligned with the discontinuities 1074 without departing from the scope of the present disclosure.

It should be appreciated that various other modifications and variations to the preferred embodiments can be made within the spirit and scope of the disclosure. Therefore, the disclosure should not be limited to the described embodiments. To ascertain the full scope of the disclosure, the following claims should be referenced.

I claim:

1. A fixture assembly comprising:

a body defining an interior; and a cover assembly removably coupled to the body and extending above the interior, the cover assembly configured to move relative to the body and having a cover and an outer component removably coupled to the cover and configured to move with the cover, the outer component having a crumple zone that facilitates deformation of at least a portion of the outer component as the cover assembly is decoupled from the body, the outer component including an inner ring and an outer ring coupled to the inner ring, the cover including a notch, and the outer component including a tab extending radially inward from the inner ring that is configured to engage the notch to rotatably couple the cover and the outer component.

2. The fixture assembly of claim 1, wherein the cover has a generally cylindrical shape and the inner ring and the outer ring are spaced apart from one another and coupled to one another by ribs.

3. The fixture assembly of claim 1, wherein the crumple zone comprises a discontinuity.

4. The fixture assembly of claim 3, wherein the discontinuity is one or more notches extending into the outer component.

5. The fixture assembly of claim 3, wherein the discontinuity is one or more gaps in the outer component.

6. A cover assembly comprising:

a cover defining a notch;

a movable component configured to engage the cover, wherein the movable component defines a projection that extends radially outward and a crumple zone that facilitates deformation of at least a portion of the movable component in response to urging the projection toward the cover as the cover assembly is decoupled from a body; and a ring having an inner ring and an outer ring coupled to the inner ring, wherein the projection extends from the outer ring, wherein the movable component defines a tab extending radially inward from the inner ring that is configured to engage the notch to rotatably couple the cover and the movable component.

7. The cover assembly of claim 6, wherein the crumple zone comprises a discontinuity formed in the outer ring.

8. The cover assembly of claim 7, wherein a peak radial thickness of the projection is less than a radial thickness of the ring.

9. The cover assembly of claim 7, wherein the discontinuity reduces a radial thickness of the outer ring by about one-third.

10. The cover assembly of claim 6, wherein the projection defines a leading edge extending from the outer ring at an angle of about ten degrees relative to an adjacent outer surface of the outer ring.

11. The cover assembly of claim 6, wherein the ring has a frustoconical outer surface.

* * * * *